US006761925B2

(12) United States Patent
Banno et al.

(10) Patent No.: US 6,761,925 B2
(45) Date of Patent: Jul. 13, 2004

(54) ELECTRON-EMITTING DEVICE, ELECTRON SOURCE SUBSTRATE, ELECTRON SOURCE, DISPLAY PANEL AND IMAGE-FORMING APPARATUS, AND PRODUCTION METHOD THEREOF

(75) Inventors: Yoshikazu Banno, Machida (JP); Etsuro Kishi, Sagamihara (JP); Mitsutoshi Hasegawa, Yokohama (JP); Kazuhiro Sando, Atsugi (JP); Kazuya Shigeoka, Tokyo (JP); Masahiko Miyamoto, Isehara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/288,823

(22) Filed: Apr. 9, 1999

(65) Prior Publication Data

US 2002/0028285 A1 Mar. 7, 2002

Related U.S. Application Data

(62) Division of application No. 08/572,113, filed on Dec. 14, 1995, now Pat. No. 6,060,113.

(30) Foreign Application Priority Data

| | | |
|---|---|---|
| Dec. 16, 1994 | (JP) | 6-313440 |
| Dec. 19, 1994 | (JP) | 6-314420 |
| Jan. 17, 1995 | (JP) | 7-4581 |
| Jun. 22, 1995 | (JP) | 7-156321 |
| Dec. 11, 1995 | (JP) | 7-320927 |

(51) Int. Cl.[7] ..... B05D 1/04; B05D 5/12

(52) U.S. Cl. ..... 427/78; 427/299; 427/123; 427/126.3; 427/226; 427/383.1

(58) Field of Search ..... 427/77, 78, 299, 427/307, 126.3, 123; 445/226, 383.1

(56) References Cited

U.S. PATENT DOCUMENTS

| | | | | |
|---|---|---|---|---|
| 3,611,077 A | * | 10/1971 | Smith | 315/94 |
| 4,566,186 A | | 1/1986 | Bauer et al. | 29/852 |
| 4,668,533 A | | 5/1987 | Miller | 427/98 |

(List continued on next page.)

FOREIGN PATENT DOCUMENTS

| | | |
|---|---|---|
| CA | 2013233 | 9/1990 |
| EP | 0 394 698 | 10/1990 |
| EP | 0620581 A | 10/1994 |
| EP | 0658916 A2 | 6/1995 |
| JP | 62-181490 | 8/1987 |
| JP | 63-200041 | 8/1988 |
| JP | 64-5095 | 1/1989 |
| JP | 64-64290 | 3/1989 |
| JP | 1-296532 | 11/1989 |
| JP | 0256822 | 2/1990 |
| JP | 2-247939 | 10/1990 |
| JP | 3-55738 | 3/1991 |
| JP | 4-121702 | 4/1992 |

OTHER PUBLICATIONS

Patent Abstracts of Japan, vol. 014, No. 573 (E–1015), Dec. 19, 1990 & JP 02 247939 A (Canon Inc.) Oct. 3, 1990.

(List continued on next page.)

*Primary Examiner*—Brian K. Talbot
(74) *Attorney, Agent, or Firm*—Fitzpatrick, Cella, Harper & Scinto

(57) ABSTRACT

A method of producing an electron-emitting device includes the steps of forming a pair of electrodes and an electrically-conductive thin film on a substrate in such a manner that the pair of electrodes are in contact with the electrically-conductive thin film and forming an electron emission region using the electrically-conductive thin film, wherein a solution containing a metal element is supplied in a droplet form onto the substrate thereby forming the electrically-conductive thin film.

28 Claims, 35 Drawing Sheets

U.S. PATENT DOCUMENTS

| | | | | | |
|---|---|---|---|---|---|
| 4,891,242 | A | | 1/1990 | Ito et al. | 427/53.1 |
| 5,023,110 | A | * | 6/1991 | Nomura et al. | 427/545 |
| 5,066,883 | A | * | 11/1991 | Yoshioka et al. | 313/309 |
| 5,114,744 | A | | 5/1992 | Cloutier et al. | 427/96 |
| 5,275,646 | A | | 1/1994 | Marshall et al. | 106/20 B |
| 5,320,703 | A | | 6/1994 | Ikeda | 117/68 |
| 5,401,535 | A | | 3/1995 | Bishop | 427/229 |
| 5,569,974 | A | * | 10/1996 | Morikawa et al. | 313/310 |
| 5,627,111 | A | * | 5/1997 | Tsukamoto et al. | 427/77 |
| 5,650,199 | A | | 7/1997 | Chang et al. | 427/333 |
| 5,832,595 | A | | 11/1998 | Maruyama et al. | 29/829 |
| 5,861,227 | A | | 1/1999 | Ikeda et al. | 430/51 |

OTHER PUBLICATIONS

H. Araki et al., "Electroforming and Electron Emission of Carbon Thin Films", J. Vac. Soc. Jpn., 26, 1, 22–29 (1981).

M. Hartwell et al., "Strong Electron Emission From Patterned Tin–Indium Oxide Thin Films", Int'l Electron Devices Mtg., Washington, D.C., 519–21 (1975).

G. Dittmer, "Electrical Conduction and Electron Emission of Discontinuous Thin Films", Thin Solid Films, 9, 317–28 (1972).

W. Dyke et al., "Field Emission", Advances in Electronics and Electron Phys., 89–185 (1956).

M. Elinson et al., "The Emission of Hot Electrons and the Field Emission of Electrons from Tin Oxide", Radio Eng'g and Electronic Phys., 1290–96 (1965).

C. Mead, "Operation of Tunnel–Emission Devices", J. App. Phys., 32(4), 646–52 (1961).

C. Spindt et al., "Physical Properties of Thin–Film Field Emission Cathodes with Molybdenum Cone," J. App. Phys., 47(12), 5240–63 (1976).

* cited by examiner

FIG. 35A1
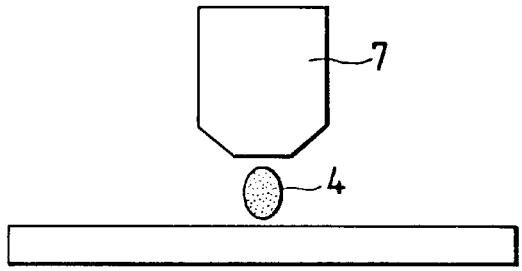
FIG. 35A2
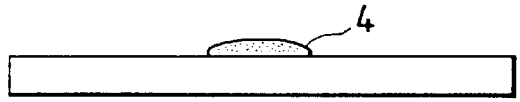
FIG. 35B1
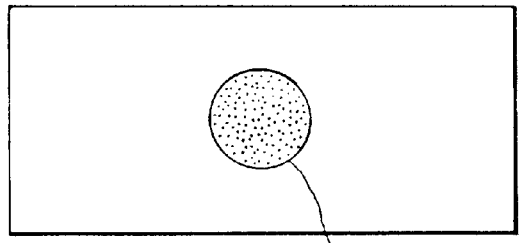
FIG. 35B2
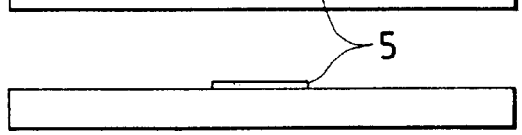
FIG. 35C1
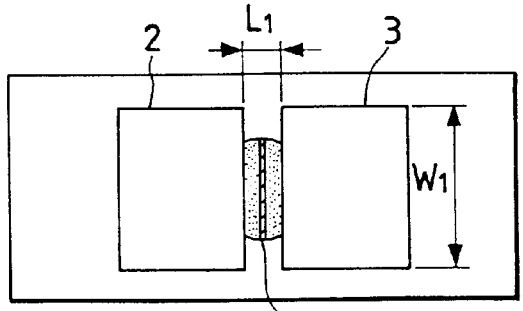
FIG. 35C2
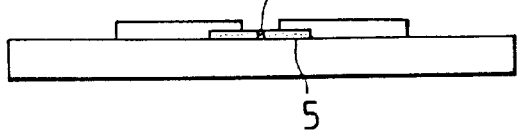

PRIOR ART

ELECTRON-EMITTING DEVICE, ELECTRON SOURCE SUBSTRATE, ELECTRON SOURCE, DISPLAY PANEL AND IMAGE-FORMING APPARATUS, AND PRODUCTION METHOD THEREOF

This application is a division of application Ser. No. 08/572,113, filed Dec. 14, 1995, now U.S. Pat No. 6,060, 113, issued May 9, 2000.

BACKGROUND OF THE INVENTION

1. Field of the Invention

The present invention relates to an electron-emitting device, and also to an electron source substrate, an electron source, a display panel and an image-forming apparatus, using the electron-emitting device. The present invention also relates to methods of producing these devices and apparatus.

2. Related Background Art

In the art of electron-emitting devices, two types are known, one is a thermionic emission source and the other is a cold-cathode emission source. Cold-cathode emission source types include a field emission type (hereafter referred to as an FE type), metal/insulator/metal type (hereafter referred to as an MIM type), and a surface conduction type electron-emitting device.

Examples of FE types are disclosed for example in "Field Emission" (W. P. Dyke and W. W. Dolan, Advance in Electron Physics 8, 89(1956)) and "Physical Properties of Thin-Film Field Emission Cathodes with Molybdenum Cones" (C. A. Spindt, J. Appl. Phys., 47, 5248(1976)).

An example of an MIM type has been reported by C. M. Mead (J. Appl. Phys., 32, 646 (1961)).

An example of a surface conduction type electron-emitting device has been reported by M. I. Elinson (Radio Eng. Electron Phys., 10 (1965)).

Surface conduction type electron-emitting devices use a phenomenon that electron emission occurs when a current is passed through a thin film with a small area formed on a substrate in a direction parallel to the film surface. Various types of surface conduction electron-emitting devices are known. They include a device using a thin $SnO_2$ film proposed by Elinson et. al., a device using a thin Au film (G. Dittmer, Thin Solid Films, 9, 317 (1972)), a device using a thin $In_2O_3/SnO_2$ film (M. Hartwell and C. G. Fonstad, IEEE Trans. ED Conf., 519 (1975)), and a device using a thin carbon film (Araki et. al., Vacuum, 26(1), 22 (1983)).

The device proposed by Hartwell is taken here as a representative example of a surface conduction type electron-emitting device, wherein its structure is shown in FIG. 39. In this figure, reference numeral 1 denotes a substrate. Reference numeral 4 denotes an electrically-conductive thin film which is formed of a metal oxide in an H pattern by means of sputtering. The electrically-conductive thin film 4 is subjected to a process called energization forming (hereafter referred to simply as a forming process), which will be described in greater detail later, so that an electron emission region 5 is formed in the electrically-conductive thin film 4. The distance L between electrodes is set to a value in the range from 0.5 mm to 1 mm and the width W' is set to 0.1 mm. The detailed position and shape of the electron emission region 5 are not described in the above reference, and thus FIG. 39 is a rough sketch of the structure.

In conventional surface conduction type electron-emitting devices, before using the devices to emit electrons, the electrically-conductive thin film 4 is subjected to an energization forming process thereby forming an electron emission region 5. In this energization forming, a DC voltage or a voltage which rises at a very slow rate for example 1 V/min is applied across the electrically-conductive thin film 4 so that the electrically-conductive thin film is locally broken, deformed, or changed in quality, thereby forming an electron emission region 5 having a high electric resistance. In the electron emission region 5, cracks are partially formed in the electrically-conductive thin film 4 and electrons are emitted via the cracks or via regions near the cracks. After completion of the forming process, a voltage is applied across the electrically-conductive thin film 4 so that a current flows through the electrically-conductive thin film 4 thereby emitting an electron from the electron emission region 5.

The electron-emitting device of the surface conduction type has a simple structure and thus can be easily produced. Therefore, it is possible to dispose a great number of similar devices over a large area. To take such advantages in practical applications such as an electron beam source, a display device or an image display device, etc., extensive research and development is being done.

The inventors of the present invention have investigated the electron-emitting device of the surface conduction type and have proposed a new method of producing an electron-emitting device in Japanese Patent Application Laid-Open No. 2-56822 (1990). FIG. 38 shows the device disclosed in this patent. In this figure, reference numeral 1 denotes a substrate, reference numerals 2 and 3 denote a device electrode, reference numeral 4 denote an electrically-conductive thin film, and reference numeral 5 denotes an electron emission region. This electron-emitting device can be produced as follows. First, device electrodes 2 and 3 are formed on a substrate 1 using a common technique such as vacuum evaporation and photolithography. Then an electrically conductive material is coated on the substrate by means of for example dispersive coating and then is patterned so as to form an electrically-conductive thin film 4. A forming process is then performed by applying a voltage across the device electrodes 2 and 3 thereby forming an electron emission region 5.

However, in the conventional production method described above, it is based on the semiconductor process and thus it is difficult to form a large number of electron-emitting devices over a large area. Besides, this technique needs a special and expensive production apparatus. Furthermore, the above patterning process requires a plurality of long steps. At present, therefore, high cost is required to form a great number of electron-emitting devices over a large area of a substrate. Thus there is a need for a simplified patterning technique.

SUMMARY OF THE INVENTION

It is an object of the present invention to solve the above problems. More particularly, it is an object of the present invention to provide a method of producing an electron-emitting device, capable of forming a large number of electron-emitting devices on a substrate at a low cost. It is another object of the present invention to provide an electron source substrate, an electron source, a display panel, and an image-forming apparatus using such an electron-emitting device.

It is still another object of the present invention to provide a method of producing an electron-emitting device, in which patterning is performed with a simplified process.

It is a further object of the present invention to provide a method of producing an electron-emitting device, capable of supplying a desired amount of conductive material at a desired location on a substrate, using a simplified production process.

It is still another object of the present invention to provide an electron source substrate, an electron source, a display panel, and an image-forming apparatus using such an electron-emitting device.

The above objects are achieved by the present invention having various aspects and features as described below.

In a first aspect of the present invention, there is provided a method of producing an electron-emitting device including the steps of: forming a pair of electrodes and an electrically-conductive thin film on a substrate in such a manner that the pair of electrodes are in contact with the electrically-conductive thin film; and forming an electron emission region using the electrically-conductive thin film, the method being characterized in that a solution containing a metal element is supplied in a droplet form onto the substrate thereby forming the electrically-conductive thin film.

In a second aspect of the present invention, there is provided a method of producing an electron-emitting device having a thin film forming an electron emission region between a pair of (each pair of) electrodes located at opposing positions on a substrate, the method including the steps of: supplying one or more droplets of solution onto the substrate, the solution including a material constituting the electrically-conductive thin film; detecting the state of the supplied droplets; supplying one or more droplets again on the basis of the obtained information of the state of the supplied droplets.

In a third aspect of the present invention, there is provided a method of producing an electron-emitting device, including the steps of: forming an electrically-conductive thin film by supplying a plurality of droplets so that the center-to-center distance between adjacent dots formed by the droplets is less than the diameter of the dot; and passing a current through the electrically-conductive thin film so that an electron emission region is formed in each electrically-conductive thin film.

In a fourth aspect of the present invention, there is provided a method of producing an electron-emitting device, including the steps of: treating the surface of the substrate so that the surface of the substrate becomes hydrophobic; and then supplying a solution in a droplet form containing a material constituting an electrically-conductive thin film to a location between a pair of electrodes thereby forming an electrically-conductive thin film, the above solution being hydrophilic.

In a fifth aspect of the present invention, there is provided a method of producing an electron-emitting device, including the steps of: supplying at least one droplet of solution onto a substrate, the solution including a material constituting an electrically-conductive thin film, thereby forming an electrically-conductive thin film in a dot shape; and then forming a pair of device electrodes in such a manner that the device electrodes are in contact with the electrically-conductive thin film.

It should be understood that an electron-emitting device produced according to the production method of the invention is also included in the scope of the invention.

The present invention also provides an electron source substrate characterized in that a plurality of electron-emitting devices according to the present invention are disposed on a substrate.

The present invention also provides an electron source characterized in that a plurality of electron-emitting devices on the electron source substrate of the invention are connected.

Furthermore, the present invention provides a display panel comprising: a rear plate provided with the electron source of the invention; and a face plate provided with a fluorescent film, the rear plate and the face plate being located at opposing positions, whereby the fluorescent film is irradiated by an electron emitted by the electron source thereby displaying an image.

The present invention also provides an image-forming apparatus including the display panel of the invention and further at least a driving circuit connected to the display panel.

The present invention also provides an apparatus for producing an electron-emitting device.

In one aspect of the invention, there is provided an apparatus for producing an electron-emitting device, the apparatus comprising: droplet supplying means for ejecting a droplet containing a metal element toward a substrate thereby supplying the droplet on the substrate; detection means for detecting the state of the supplied droplet; and control means for controlling the ejecting condition of the droplet supplying means on the basis of the information obtained via the detection means.

In another aspect of the invention, there is provided a method of producing an electron source substrate, including the steps of: forming a plurality of pairs of device electrodes on a substrate; and supplying one or more droplets of a solution containing a metal element onto a location between each pair of device electrodes thereby forming an electrically-conductive thin film at that location and thus forming a plurality of electron-emitting devices.

In still another aspect of the invention, there is provided a method of producing an electron source, including the steps of: forming a plurality of pairs of device electrodes on a substrate; supplying one or more droplets of a solution containing a metal element onto a location between each pair of device electrodes thereby forming an electrically-conductive thin film at that location and thus forming a plurality of electron-emitting devices; and connecting the electron-emitting devices via interconnections.

In a further aspect of the invention, there is provided a method of producing a display panel, including the steps of: forming a plurality of pairs of device electrodes on a substrate; supplying one or more droplets of a solution containing a metal element onto a location between each pair of device electrodes thereby forming an electrically-conductive thin film at that location and thus forming a plurality of electron-emitting devices; connecting the electron-emitting devices via interconnections; and connecting a rear plate, having the substrate on which electron-emitting devices are formed, to a face plate provided with a fluorescent film via a supporting frame so that both plates are located at opposing positions.

In still another aspect of the invention, there is provided a method of producing an image-forming apparatus, including the steps of: forming a plurality of pairs of device electrodes on a substrate; supplying one or more droplets of a solution containing a metal element onto a location between each pair of device electrodes thereby forming an electrically-conductive thin film at that location and thus forming a plurality of electron-emitting devices; connecting the electron-emitting devices via interconnections; connecting a rear plate, having the substrate on which electron-emitting devices are formed, to a face plate provided with a fluorescent film via a supporting frame so that both plates are located at opposing positions thereby forming a display panel; and connecting a driving circuit to the display panel.

In the method of producing an electron-emitting device according to the present invention, since a solution containing a metal element is supplied in a droplet form onto a substrate thereby forming an electrically-conductive thin film which constitutes an electron emission region, it is possible to supply a desired amount of solution at a desired location. Thus, it is possible to greatly simplify the process of producing an electron-emitting device.

Furthermore, in the second aspect of the invention regarding the method of producing an electron-emitting device, information of the sate of a supplied droplet is detected, then the ejecting conditions and the ejecting position are corrected on the basis of the obtained information, and finally a droplet is supplied again under the corrected conditions. Therefore, it is possible to produce a thin film having a very small number of defects. Furthermore, it is possible to achieve a great improvement in uniformity of device characteristics, and thus it is possible to solve the problem of the production yield which becomes serious with the increase in the size of the substrate.

Furthermore, it is possible to produce a high-quality electron source substrate, electron source, display panel, and image-forming apparatus, using the electron-emitting device of the invention.

In the third aspect of the present invention regarding the method of producing an electron-emitting device, a plurality of droplets of a solution in which a metal material which constitutes an electron emission region is dissolved or dispersed are supplied onto a substrate so that the center-to-center distance between adjacent dots formed by the droplets is less than the diameter of the dot. Thus, it is possible to form the electrically-conductive film constituting the electron emission region with very high accuracy.

In the fourth aspect of the present invention concerning the method of producing an electron-emitting device, the surface of the substrate is treated so that the surface of the substrate becomes hydrophobic, and then a hydrophilic solution in a droplet form is supplied onto a substrate. Thus, it is possible to produce an electrically-conductive thin film with good reproducibility. This means that it is possible to produce a great number of surface conduction electron-emitting devices having uniform characteristics over a large area.

Furthermore, in the fifth aspect of the invention regarding the method of producing an electron-emitting device, device electrodes are formed after forming an electrically-conductive thin film. This allows the present invention to be used in a wider range of applications.

Furthermore, in the production of an electron source, an electron source substrate, a display panel, an image-forming apparatus, and an electron-emitting device according to the present invention, an electrically-conductive thin film can be disposed precisely at a desired location, and thus it is possible to achieve uniform and excellent characteristics.

BRIEF DESCRIPTION OF THE DRAWINGS

FIGS. 4A and 4B illustrate voltage waveforms used in an energization forming process which is performed during the process of producing an electron-emitting device according to the invention, wherein FIG. 4A illustrates a waveform having a constant pulse height, and FIG. 4B illustrates a waveform with an increasing pulse height;

FIGS. 8A and 8B are schematic diagrams partially illustrating a fluorescent film wherein FIG. 8A illustrates a type having black stripes, and FIG. 8B illustrates a type having a black matrix;

FIGS. 18A to 18C are schematic diagrams illustrating the structure of an optical detecting system/ejection nozzle used in a production apparatus according to the present invention, wherein FIG. 18A illustrates a vertical reflection type, FIG. 18B illustrates an oblique reflection type, and FIG. 18C illustrates a vertical transmission type;

FIGS. 19A and 19B are schematic representations of the operation of the optical detecting system/ejection nozzle of the vertical reflection type used in the production apparatus according to the present invention, wherein FIG. 19A illustrates a droplet information detecting operation, and FIG. 19B illustrates an ejecting operation;

FIGS. 20A and 20B are schematic representations of the operation of the optical detecting system/ejection nozzle of the vertical transmission type used in the production apparatus according to the present invention, wherein FIG. 20A illustrates a droplet information detecting operation, and FIG. 20B illustrates an ejecting operation;

FIGS. 32A and 32B are schematic diagrams illustrating a basic pattern of a pad and dots wherein FIG. 32A illustrates the distance between adjacent dots, and FIG. 32B illustrates a pad formed between device electrodes;

FIGS. 35A1 to 35C2 are schematic representations of a production flow associated with a surface conduction electron-emitting device according to the present invention;

DETAILED DESCRIPTION OF THE PREFERRED EMBODIMENTS

The present invention will now be described in detail with reference to the accompanying drawings.

Figure 1A:
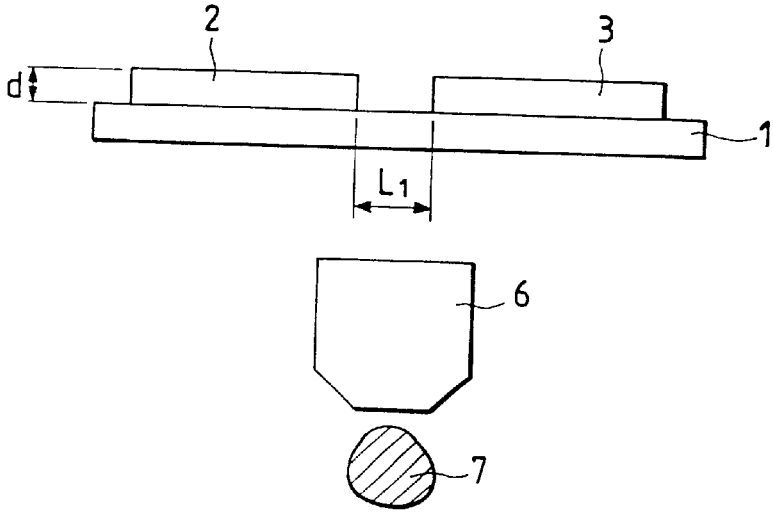
FIGS. 1A to 1D are schematic diagrams illustrating a method of producing an electron-emitting device according to the present invention.
Figure 1B:
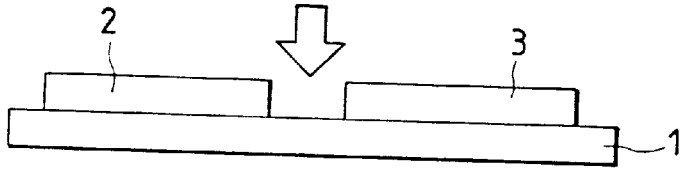
Figure 1C:
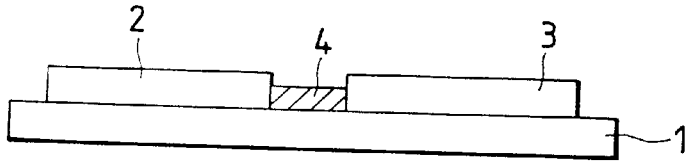
Figure 1D:
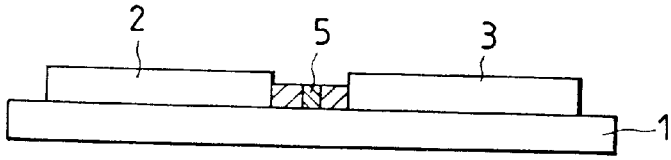
Figure 2A:
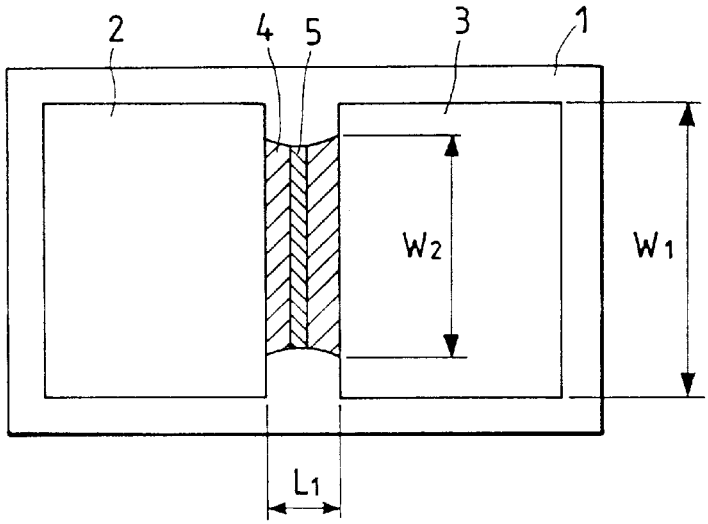
FIGS. 2A and 2B are schematic diagrams illustrating a surface conduction electron-emitting device according to the present invention.
Figure 2B:
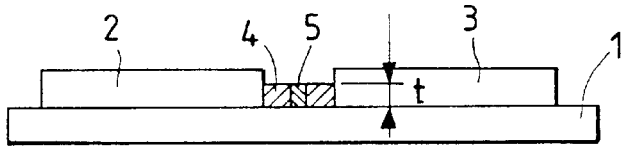
Figure 3:
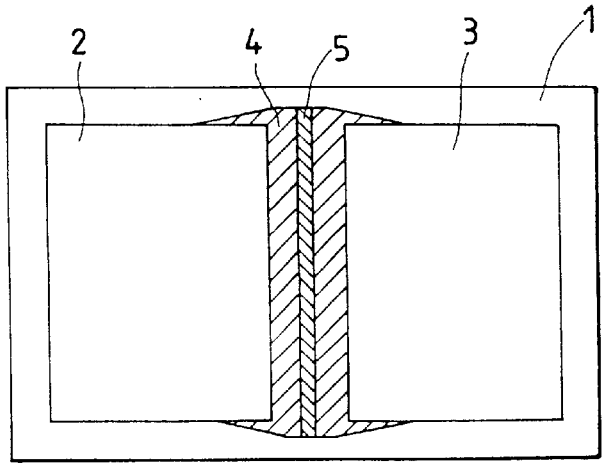
FIG. 3 is a plan view of another surface conduction electron-emitting device according to the present invention.

FIGS. 1A to 1D are schematic diagrams illustrating a method of producing an electron-emitting device according to the present invention, and FIGS. 2A to 3 are schematic diagrams illustrating a surface conduction type electron-emitting device produced according to the method of the present invention.

In FIGS. 1A to 1D, 2A and 2B, and 3, reference numeral 1 denotes a substrate, reference numerals 2 and 3 denote a device electrode, reference numeral 4 denotes an electrically-conductive thin film, reference numeral 5 denotes an electron emission region, reference numeral 6 denotes a droplet supplying mechanism, and reference numeral 7 denotes a droplet.

First, in this embodiment, device electrodes 2 and 3 are formed on the substrate 1 so that the device electrodes 2 and 3 are apart by a distance of L1 (FIG. 1A). Then, a droplet 7 consisting of a solution containing a metal element is ejected from the droplet supplying device (ink-jet printing apparatus) 6 (FIG. 1B), thereby forming an electrically-conductive thin film 4 so that the electrically-conductive thin film 4 is formed in contact with the device electrodes 2 and 3 (FIG. 1C). Cracks are then produced in the electrically-conductive thin film by means of for example a forming process, which will be described later, thereby forming an electron emission region 5.

In the above-described technique of supplying droplets, a small droplet of solution can be selectively deposited only at a desired location without uselessly consuming the material for forming devices. Furthermore, neither a vacuum process using an expensive apparatus nor a photolithographic patterning process including a large number of steps is required, and thus it is possible to greatly reduce the production cost.

As for the droplet supplying device 6, any apparatus can be employed as long as it can produce a droplet in a desired form. However, it is preferable to use an apparatus based on an ink-jet technique capable of easily producing a very small droplet in the range from 10 ng to a few ten ng and capable of control the amount of the droplet in that range.

The ink-jet type apparatus include an ink-jet ejecting apparatus using a piezo-electric device and an ink-jet ejecting apparatus based on a technique of forming a bubble in liquid by means of thermal energy thereby ejecting the liquid in the form of a droplet (hereafter referred to as a bubble jet technique).

As for the electrically-conductive thin film 4, it is preferable to employ a particle film formed of particles so as to achieve good performance in electron emission. The film thickness is set to a proper value taking into account various conditions such as step coverage over the device electrode 2 and 3, resistance between the device electrodes 2 and 3, and energization forming conditions, which will be described later, while it is preferably in the range from a few Å to a few thousand Å, and more preferably in the range from 10 Å to 500 Å. The sheet resistance is preferably in the range from $10^3$ to $10^7$ Ω/square.

Materials which can be employed to form the electrically-conductive thin film 4 include metal such as Pd, Pt, Ru, Ag, Au, Ti, In, Cu, Cr, Fe, Zn, Sn, Ta, W, or Pb, oxides such as PdO, $SnO_2$, $In_2O_3$, PbO, or $Sb_2O_3$, borides such as $HfB_2$, $ZrB_2$, $LaB_6$, $CeB_6$, $YB_4$, or $GdB_4$, carbides such as TiC, ZrC, HfC, TaC, SiC, or WC, nitrides such as TiN, ZrN, or HfN, semiconductors such as Si, or Ge, or carbon.

The term "particle film" is used herein to refer to a film composed of a plurality of particles, wherein the particles may be dispersed in the film, or otherwise the particles may be disposed so that they are adjacent to each other or they overlap each other (or may be disposed in the form of islands). The particle diameter is preferably in the range from a few Å to a few thousand Å, and more preferably from 10 Å to 200 Å.

As for the solution for creating a droplet 7, it is possible to employ a solution such as water or a solvent in which a material for forming the electrically-conductive thin film is dissolved, or an organometallic solution, wherein it is required that the solution should have a viscosity high enough to produce a droplet.

It is preferable that the solution should be supplied between the device electrodes so that the amount of the solution does not exceed the volume of a recessed portion formed with a substrate and a pair of device electrode, as shown in the following equation.

Volume of the recessed portion=Thickness of the device electrode (d)×Width (W1) of the device electrode×The distance (L1) between the device electrodes (1)

As for the substrate 1, quartz glass, glass with low contents of impurities such as Na, a plate glass, glass substrate coated with $SiO_2$, ceramic substrate such as aluminum oxide, etc., may be employed.

As for the material for the device electrodes 2 and 3, it is possible to employ a common electrically-conductive material for example metal or an alloy such as Ni, Cr, Au, Mo, W, Pt, Ti, Al, Cu, or Pd, a printed conductor composed of glass and a metal or a metal oxide such as Pd, Ag, Au, $RuO_2$, Pd—Ag, a transparent conductor such as $In_2O_3$ or $SnO_2$, or a semiconductor material such as polysilicon.

The distance L between the device electrodes is preferably in the range from a few hundred Å to a few hundred μm. It is desirable that the voltage applied between the device electrodes be as low as possible, and thus it is required to form device electrodes precisely. From this point of view, the distance between the device electrode is preferably in the range from a few μm to a few ten μm.

The length W' of the device electrode is set to a value in the range from a few μm to a few hundred μm to satisfy the requirements of the resistance of the electrode and the requirements of electron emission characteristics. The film thickness of the device electrodes 2 and 3 is preferably in the range from a few hundred Å to a few μm.

The electron emission region 5 includes cracks formed in a part of the electrically-conductive thin film 4 wherein the cracks are formed by means of for example energization forming. In the cracks, there may be electrically-conductive particles with a particle size of a few Å to a few hundred Å. The electrically-conductive particle contains at least a part of elements constituting the material of the electrically-conductive thin film 4. The electron emission region 5 and the electrically-conductive thin film 4 adjacent to it may include carbon or a carbon compound.

Figure 4A:
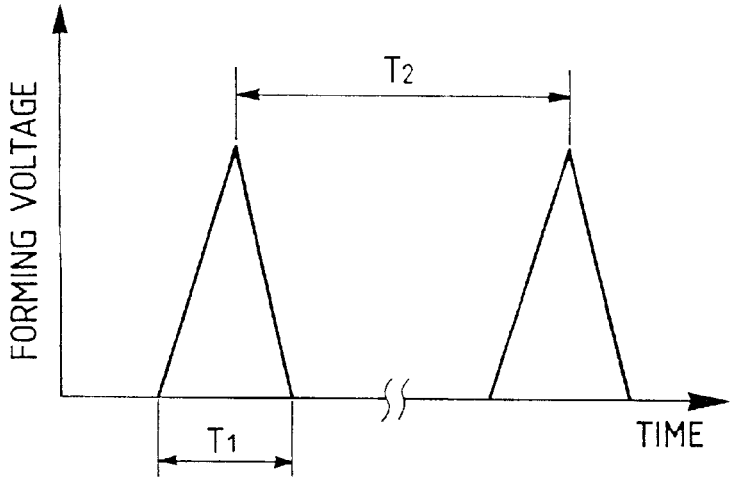
Figure 4B:
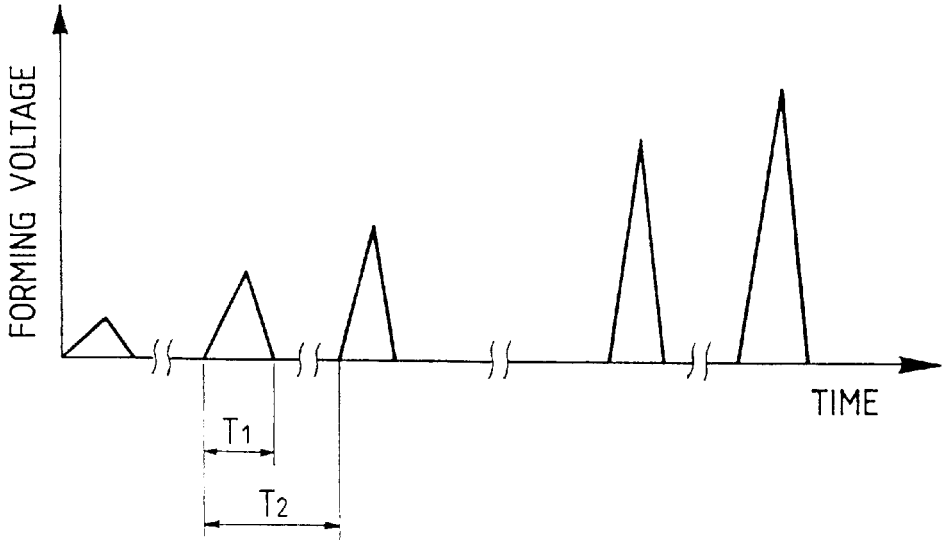

The electron emission region 5 is created by performing an energization forming process in which a current is passed through a device including the electrically-conductive thin film 4 and the device electrodes 2 and 3. In the energization forming, a voltage from a power supply (not shown) is applied between the device electrodes 2 and 3 so that the electrically-conductive thin film 4 is locally broken, deformed, or changed in quality, thereby creating a portion having a structure different from the other portions. Such the portion whose structure is locally changed is herein referred to as the electron emission region 5. FIGS. 4A and 4B illustrate examples of a voltage waveform used in the energization forming.

As for the voltage waveform, it is preferable to employ a pulse. A series of voltage pulses having a constant peak value may be applied (FIG. 4A) or otherwise voltage pulses having an increasing peak value may be applied (FIG. 4B). In the case where pulses having a constant peak value are employed, the forming process is performed as follows.

In FIGS. 4A and 4B, T1 and T2 denote the width and interval of the voltage pulses, respectively, wherein T1 is set to a value in the range from 1 μsec to 10 msec, and T2 in the range from 10 μsec to 100 msec. The peak voltage of the triangular waveform (the peak value of the forming voltage) is selected to a proper value according to the type of the surface conduction electron-emitting device. The forming is performed in a vacuum at a pressure of for example $1\times10^{-5}$ Torr wherein the voltage is applied for a time period in the range from a few sec to a few ten min. The waveform of the voltage applied between the electrodes of the device it not limited to a triangular waveform, and a rectangular wave or other proper waveforms may also be employed.

In the case of the waveform shown in FIG. 4B, T1 and T2 are selected to similar values to those in FIG. 4A. In this case, the peak voltage of the triangular waveform (the peak value of the forming voltage) is increased in steps of for example 0.1 V and applied to the device in a vacuum at a proper pressure.

During the forming process, a current is measured in each pulse interval using a voltage small enough, for example 0.1 V, not to locally destroy or deform the electrically-conductive thin film 4, thereby determining the resistance. When the resistance has achieved a high value, for example 1 MΩ or greater, the forming process is stopped.

After the forming process, it is desirable that the device is further subjected to an activation process.

In the activation process, as in the forming process, a voltage pulse having a constant peak voltage is applied repeatedly to the device in a vacuum at a pressure of for example $10^{-4}$ to $10^{-5}$ Torr so that carbon or a carbon compound originating from an organic substance present in the vacuum is deposited on the electrically-conductive thin film thereby greatly changing the device current $I_f$ and the emission current $I_e$. During the activation process, the device current $I_f$ and the emission current $I_e$ are monitored, and the process is stopped for example when the emission current $I_e$ has reached a saturated value. In the activation process, the pulse applied to the device preferably has a voltage equal to an operation driving voltage.

In this invention, the carbon and the carbon compound refer to graphite (single crystal or polycrystal) and amorphous carbon (mixture of amorphous carbon and polycrystal graphite), respectively. The film thickness thereof is preferably less than 500 Å and more preferably less than 300 Å.

The electron-emitting device obtained in the above-described manner is preferably operated in a vacuum at a lower pressure than in the energization forming process or the activation process. Furthermore, it is desirable that the electron-emitting device be used after heating it at a temperature of 80° C. to 150° C. in vacuum at a still lower pressure.

The "pressure lower than in the energization forming process or the activation process" refers to such a pressure less than about $10^{-6}$ Torr, and more preferably refers to an ultra-low pressure so that substantially no further deposition of carbon or carbon compound occurs onto the electrically-conductive thin film thereby obtaining stabilized device current $I_f$ and emission current $I_e$.

In the present invention, the electron-emitting device is of the surface conduction type which has a simple structure and thus can be easily produced.

The surface conduction electron-emitting device according to the present invention is basically of the flat panel type.

A distinctive feature of the method of the invention for producing an electron-emitting device is in that a solution containing a metal element is supplied in the form of a droplet onto a substrate thereby forming an electrically-conductive thin film. This can be achieved in various modes of the invention.

I. In a mode of the invention, the condition associated with a droplet supplied on a substrate is detected, and another droplet is supplied on the basis of the obtained information of the condition. This mode of the invention will be described in greater detail below.

Figure 14:
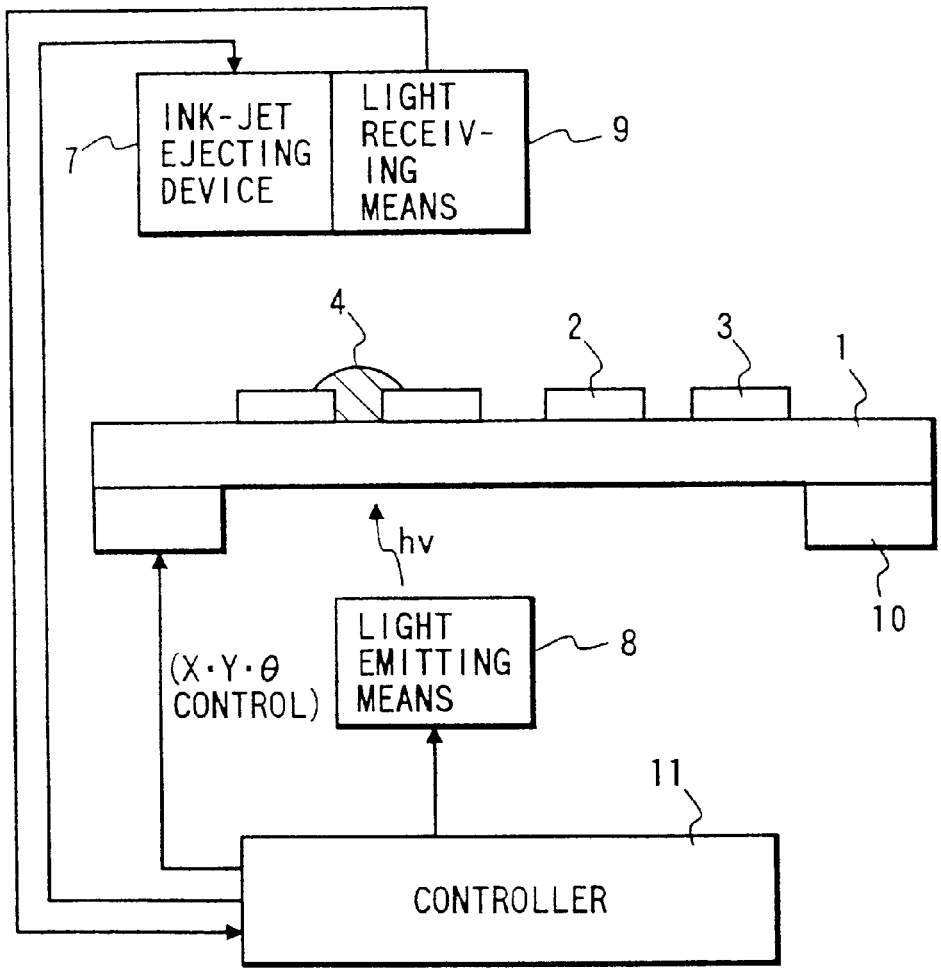
FIG. 14 is a schematic representation of an example of a process of supplying a droplet according to the present invention.
Figure 15:
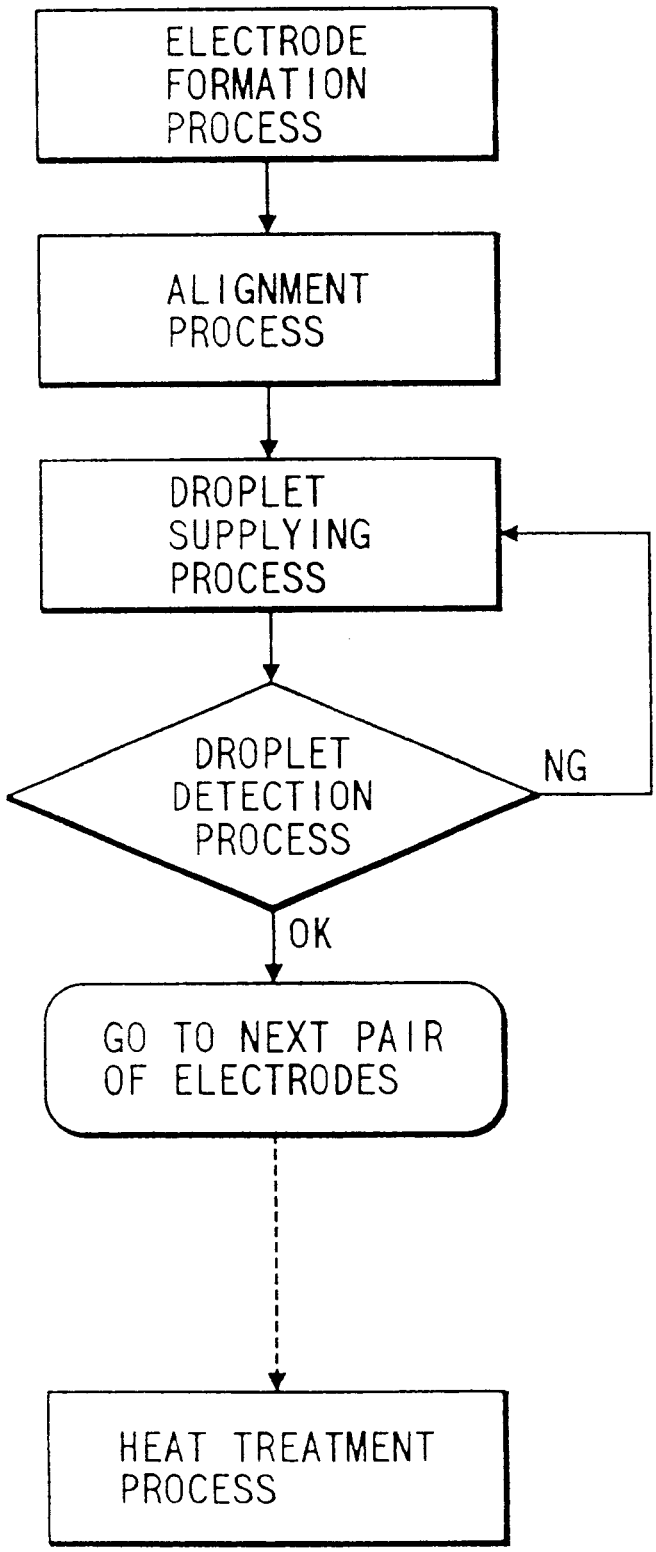
FIG. 15 is a flow chart associated with a production method according to the present invention.
Figure 16:
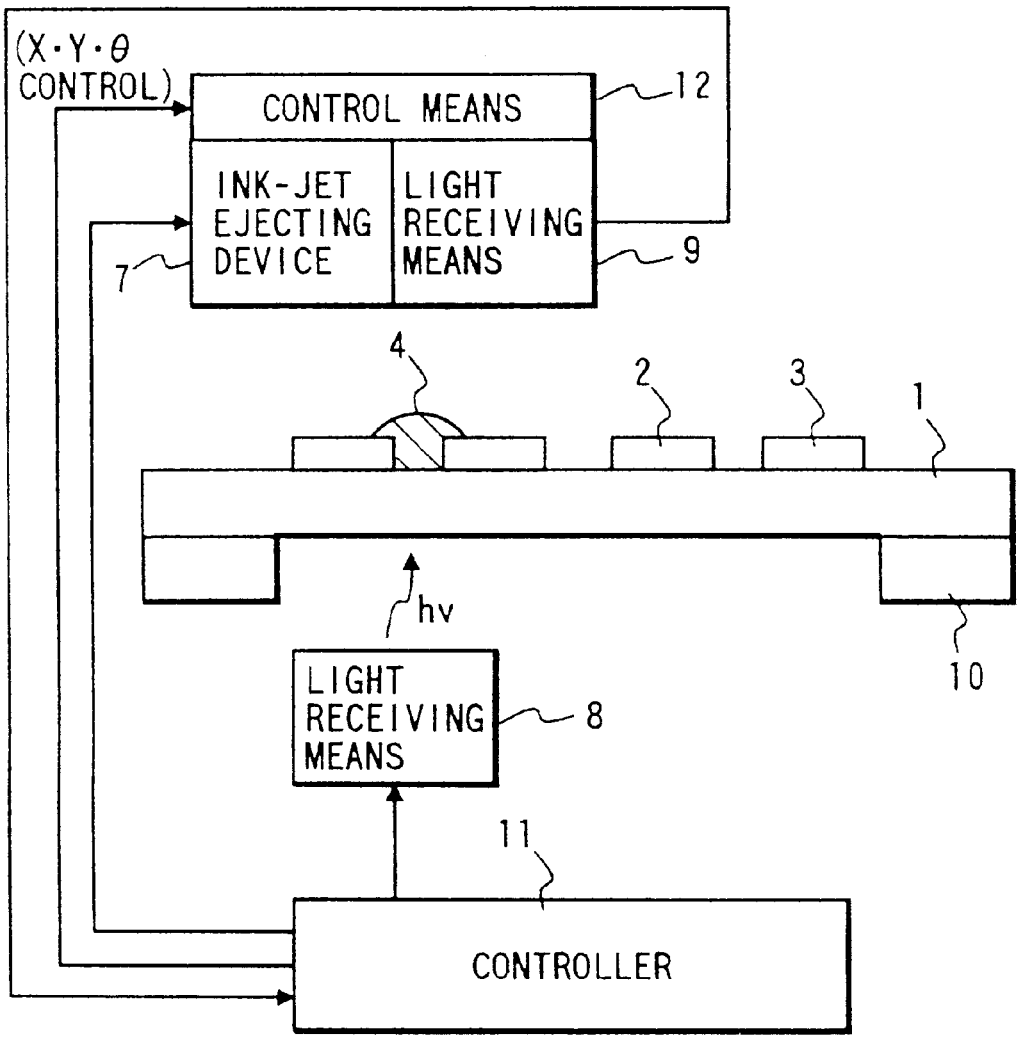
FIG. 16 is a schematic representation of another example of a process of supplying a droplet according to the present invention.
Figure 17:
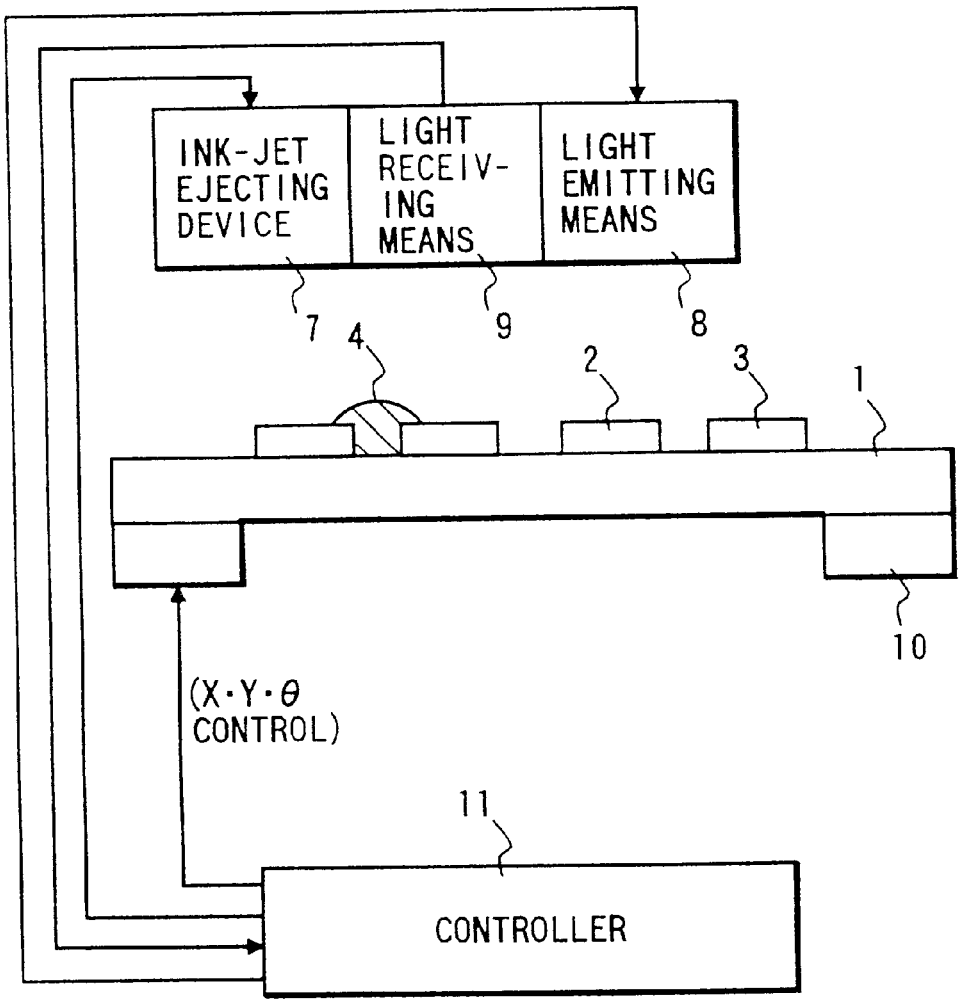
FIG. 17 is a schematic representation of still another example of a process of supplying a droplet according to the present invention.

FIGS. 14, 16 and 17 are schematic diagrams illustrating various modes of the apparatus for producing an electron-emitting device according to the present embodiment of the invention. FIG. 15 is a flow chart associated with a process of producing an electron-emitting device according to an embodiment of the present invention.

In FIGS. 14, 16 and 17, reference numeral 7 denotes an ink-jet ejecting device, reference numeral 8 denotes light emitting means, reference numeral 9 denotes light receiving means, reference numeral 10 denotes a stage, reference numeral 11 denotes a controller, and reference numeral 12 denotes control means. In this invention, the light emitting means is not limited to those which emit visual light, and variety types of light emitting devices such as an LED, an infrared laser, etc., may be employed. As for the light receiving means, any type of light receiving means may be employed as long as it can receive a signal (light) emitted by the light emitting means. It is required that the light emitting means and the light receiving means be constructed and disposed so that a signal (light) generated by the light emitting means is reflected from or transmitted through an insulating substrate and then the signal (light) is received by the light receiving means.

In the method and apparatus for producing an electron-emitting device according to the present embodiment, the conditions to be detected associated with the droplet include the amount of a droplet supplied into a gap or a recessed portion between a pair of device electrodes, the position of the droplet, the presence or the absence of the droplet, etc. On the basis of the obtained information regarding such the items, the control means controls the conditions such as the number of times of ejecting operations, and the ejecting position. Furthermore, in the case where an ink-jet ejecting apparatus using a piezo-electric device is employed, the ejecting conditions, including driving conditions, of the ink-jet ejecting apparatus are also controlled.

Furthermore, it is desirable that the means of detecting the above conditions include droplet information detecting means for detecting whether a droplet ejected from a nozzle by means of an ink-jet technique is present in the gap between the electrodes and further detecting its amount, and also include arrival position detecting means for detecting the droplet arrival position.

In this arrival position detecting means, the droplet arrival position is detected by optically detecting an electrode pattern or a dedicated alignment mark before ejecting a droplet, or otherwise by optically detecting the modulation of the transmittance due to the droplet. The droplet position is determined by detecting the transmittance at a plurality of points in the gap and also in the vicinity of the gap and further calculating the correlation among these points.

Furthermore, in the production apparatus of the present embodiment, it is desirable that both the droplet information and the droplet arrival position be detected by the same single optical detecting system without having another optical system dedicated for detecting the position. In a more preferable mode, both the droplet information and the position are detected successively or at the same time using the same optical system.

In the production method of the present embodiment, as shown in FIG. 15, the droplet supplying position is determined by detecting, with the light emitting means and the light receiving means, light passing through or being reflected from the area between the electrodes, and then the head of the ink-jet ejecting device is moved to the position between electrodes to which a droplet is to be supplied (positioning step). A droplet is then supplied between the electrodes using the ink-jet ejecting device (droplet supplying step), and then, as in the positioning step, it is determined whether a droplet has been supplied between the electrodes (to obtain information regarding the presence or absence of the droplet itself) on the basis of the signal passing through or being reflected from the area between the electrodes (droplet detecting step). If it is concluded in the droplet detecting step that a droplet has been deposited successfully at a desired position in a desired area, then the process goes to a next step to perform positioning of a next point between another pair of electrodes. On the other hand, if no droplet has been supplied, a droplet is supplied again.

In the moving and carrying operation of the ink-jet ejecting device and the stage, movement in the direction of X, Y, and/or θ may be performed for any combination of the stage and the ink-jet ejecting device, for example only for the stage, or only for the ink-jet ejecting device, or otherwise for both of these.

Furthermore, during the droplet supplying step, the ink-jet ejecting device and the stage may be either in motion or at rest. However, if the ink-jet ejecting device or the stage is in motion during a process of supplying a droplet, it is desirable that the movement or carriage is performed at a speed slow enough not to shift the droplet arrival position from a desired position.

Figure 18A:
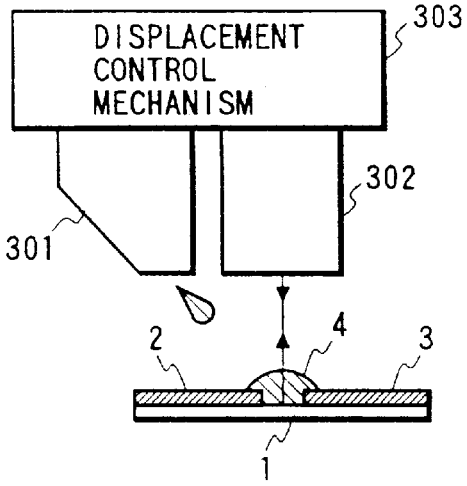
Figure 18B:
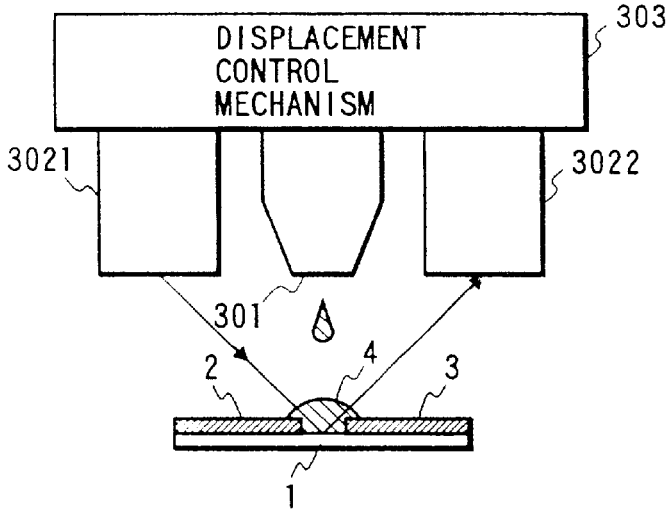
Figure 18C:
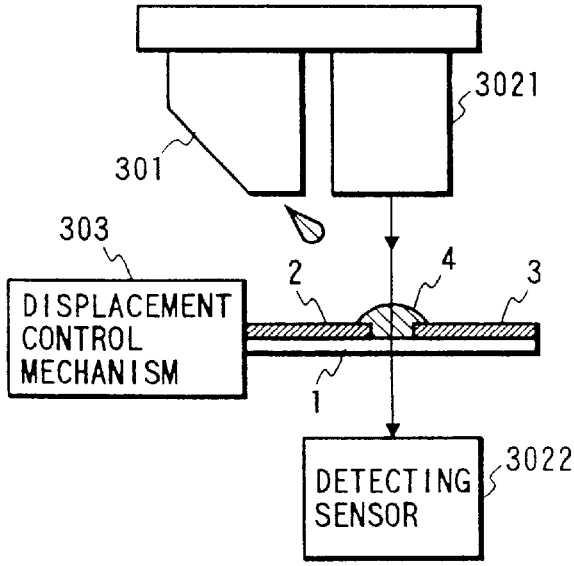

In the production apparatus of the present embodiment, the optical detecting means may be realized in various fashions. Among them, FIGS. 18A to 18C illustrate types in which the optical system and the ejection nozzle are disposed so that the optical axis of the optical system and the ejection axis of the ejection nozzle intersect each other at the focal point of the optical detecting system. In this type, it is possible to alternately perform ejection of a solution and detection of information of the supplied droplet while maintaining the ejection nozzle 301, the optical detecting system 302, and the device substrate (insulating substrate) 1 at fixed locations relative to each other. FIG. 18A illustrates a vertical reflection type in which an emission system and a detection system are integrated in a compact fashion, FIG. 18B illustrates an oblique reflection type in which an emission system and a detection system are disposed so that an ejection nozzle is located between them, and FIG. 18C illustrates a vertical transmission type in which an emission system and a detection system are disposed so that a device substrate is located between them.

Figure 19A:
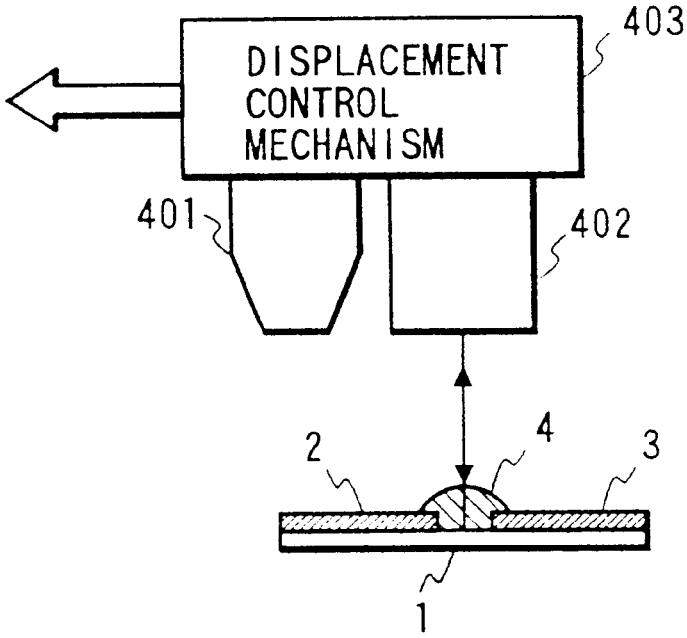
Figure 19B:
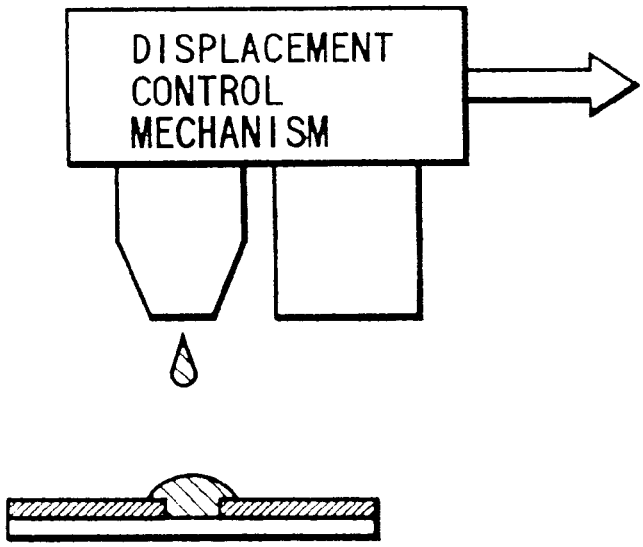
Figure 20A:
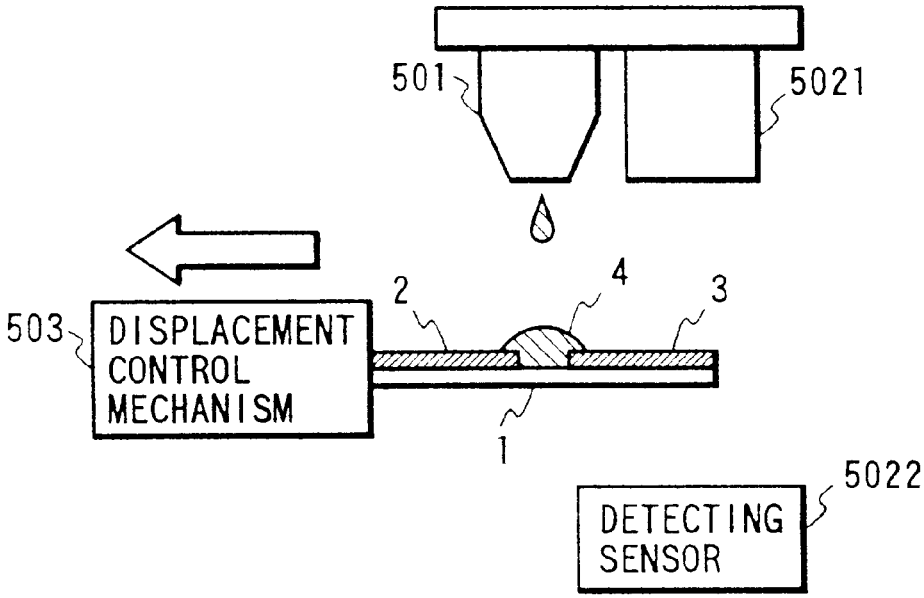
Figure 20B:
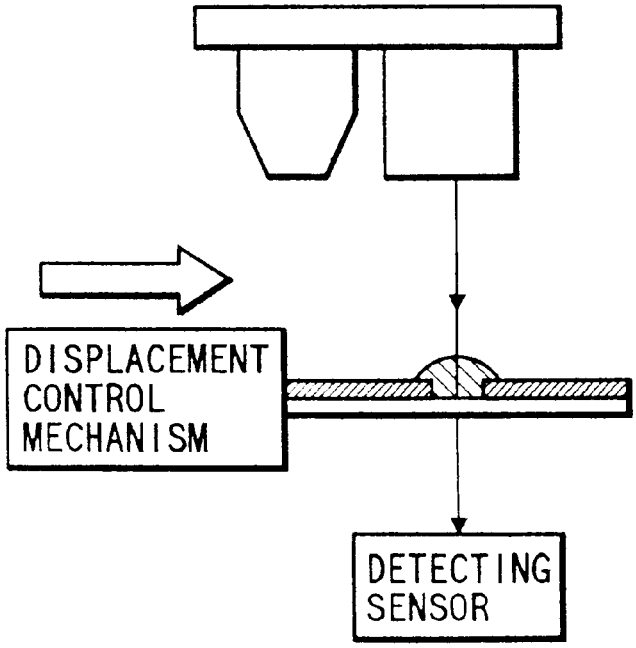

FIGS. 19A and 19B and 20A and 20B illustrate types in which the optical axis of the optical detecting system and the ejection axis do not intersect each other, wherein the one shown in FIGS. 19A and 19B is of a reflection type and the one shown in FIGS. 20A and 20B is of a transmission type. In this type, to perform alternate operations of ejecting a droplet and detecting information thereof, it is required to move the displacement control mechanism 403 or 503 alternately in either direction denoted by an arrow so that the axis of the optical detecting system and the ejection axis alternately comes to the center of the gap, as shown in the figures.

One technique of controlling the ejecting operation is to use a difference component of the detected signal associated with the droplet information as a correction signal. In this technique, at least one of parameters such as the height of the driving pulse, the pulse width, the pulse timing, and the number of pulses is fed back in real time to maintain the detected signal associated with the droplet information at an optimum value. Another technique is to correct at least one of the parameters according to a predetermined algorithm in response to the deviation of the detected value from an optimum value.

In the example shown in these figures, a droplet to be detected is formed between device electrodes. However, the present invention is not limited to such the mode. In a preliminary step, a dummy droplet may be deposited at some location other than a location between device electrodes, and this dummy droplet may be detected. According to the detection result, the ejection condition is optimized, and then an actual droplet is ejected onto a location between device electrodes.

In another mode of the present embodiment, there is provided droplet removing means for removing at least a part of the deposited droplet. In this mode, if the detected droplet information indicates that the amount of the droplet deposited in the gap is greater than an optimum value, a part of the droplet is removed so that the remaining amount of the droplet becomes optimum, or otherwise the entire droplet is removed once and then another droplet is ejected.

The droplet removing means may include a dedicated removing nozzle for ejecting a gas such as nitrogen thereby blowing away a droplet from a gap. It is desirable that the dedicated removing nozzle be disposed near the ejection nozzle so that no additional mechanism for control the position of the dedicated removing nozzle is required. In the case where ejection nozzles are disposed in a multi-array fashion, dedicated removing nozzles may be disposed at periodic locations over the array. In this mode, as described above, in addition to the means for supplying a droplet by means of ejection, there is also provided the means for removing a droplet. Thus, in this mode, it is possible to control the amount of the droplet more accurately.

In the present embodiment, the production apparatus includes means for optically detecting the information of the droplet arrival position and also means for controlling the ejection position and performing a finer position adjustment on the basis of the detected positional information.

The position detecting means detects the droplet arrival position by optically detecting an electrode pattern or a dedicated alignment mark before ejecting a droplet, or otherwise by optically detecting the modulation of the transmittance due to the droplet. The droplet position is determined by detecting the transmittance at a plurality of points in the gap and also in the vicinity of the gap and further calculating the correlation among these points.

In the present embodiment, both the droplet information and the droplet arrival position are preferably detected by the same single optical detecting system without having another optical system dedicated for detecting the position. More preferably, both the droplet information and the position are detected successively or at the same time using the same optical system.

II. In another mode of the invention, the diameter of a droplet dot and the position at which the droplet is supplied are determined in a distinctive fashion according to the invention.

Figure 32A:
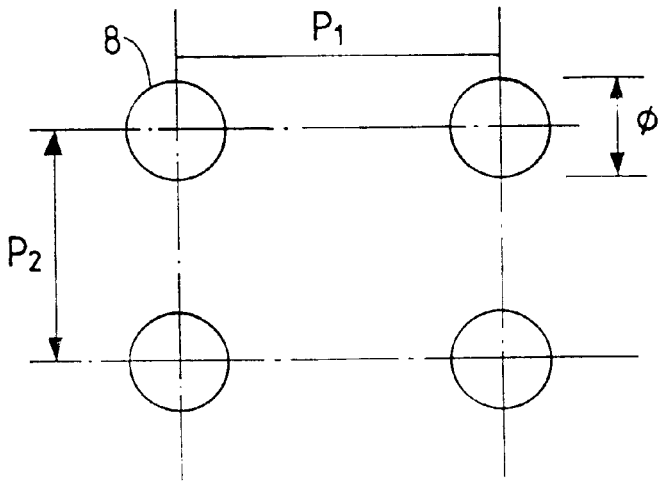
Figure 32B:
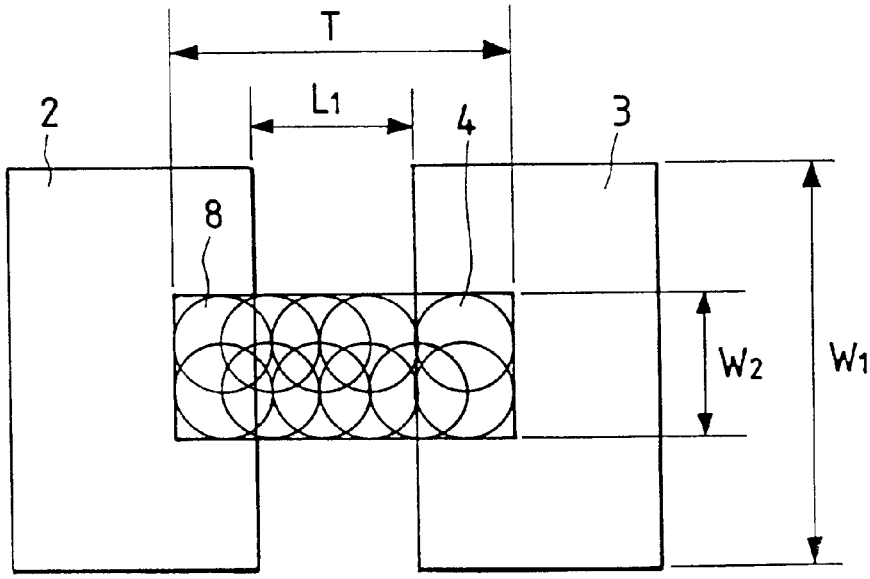

FIGS. 32A and 32B illustrate a multi-dot pattern (pad) of a surface conduction type electron-emitting device produced according to a production method of the present embodiment of the invention. FIG. 32A illustrates the distance between adjacent dots, and the diameter of dots. FIG. 32B illustrates an example of a pad. In this invention, the term "adjacent dots" refers to those dots which are located adjacent to each other either in the horizontal direction or in the vertical direction as shown in FIG. 32A, and those dots which are adjacent in an oblique direction are not regarded as "adjacent dots".

In FIGS. 32A and 32B, reference numerals 2 and 3 denote a device electrode, reference numeral 4 denotes an electrically-conductive thin film, and reference numeral 8 denotes a circular film (dot) in a liquid phase or in a solid state formed after supplying a droplet onto the substrate.

First, in a preliminary step, the diameter $\phi$ of a dot formed of the material described above is determined. That is, an insulating substrate is cleaned well with for example an organic solvent, and then dried. A dot is then formed using a droplet supplying mechanism, and the diameter $\phi$ of the dot is measured.

A plurality of dots are formed on the substrate on which, after cleaned, device electrodes have been formed by means of vacuum evaporation and photolithography, thereby producing a multi-dot pattern (pad), as shown in FIG. 32B. In the above process, center-to-center distances $P_1$ and $P_2$ between dots are set to a value less than the diameter $\phi$ of one dot so that adjacent dots overlap each other. As a result of the above process, droplets deposited on the substrate expand, and a pad having a substantially constant width $W_2$ is obtained. The width $W_2$ of the pad is preferably less than the width $W_1$ of the device electrodes, and the length T of the pad is preferably greater than the gap $L_1$, wherein the specific size of the pad is determined also taking into account the resistance to be achieved, the width of the device electrodes, the gap width, and the alignment accuracy.

After forming the thin film in the above-described manner, the substrate is heated at a temperature in the range from 300° C. to 600° C. so that the solvent is evaporated, thereby forming an electrically-conductive thin film. After that, forming and other processes are performed in a manner similar to that described above.

III. In still another mode of the invention, the surface of a substrate is subjected to a special treatment before supplying a droplet thereon. More specifically, the substrate surface on which a droplet is to be deposited is subjected to a process for making the substrate surface hydrophobic.

In this embodiment, before supplying a droplet onto a substrate having device electrodes, the surface of the substrate is treated so that the surface of the substrate becomes hydrophobic. More particularly, the treatment for achieving hydrophobicity is performed using a silane coupling agent such as HMDS(hexamethyldisilazane), PHAMS, GMS, MAP, or PES.

The hydrophobicity treatment is performed by coating a silane coupling agent on the substrate using for example a spinner and then heating the substrate at a temperature in the range from 100° C. to 300° C. (for example 200° C.) for a time duration in the range from a few ten min to a few hours (for example 15 min).

This surface treatment ensures that when a droplet is supplied onto the substrate using the droplet supplying mechanism, good reproducibility in the shape of the droplet on the substrate can be obtained. Thus, the droplet on the substrate does not expand into an irregular shape. This means that it is possible to easily control the shape of the electrically-conductive thin film by controlling the amount and the shape of the droplet. As a result, it is possible to obtain improved reproducibility or uniformity in the size and thickness of the electrically-conductive thin film. Thus, it is possible to form a great number of electron-emitting devices over a large area maintaining good uniformity in the electron emission performance.

Now, an image-forming apparatus according to the present invention will be described below.

An electron source substrate for use in an image-forming apparatus is produced by disposing a plurality of surface conduction type electron-emitting devices on a substrate.

One method of disposing surface conduction type electron-emitting devices is to dispose them in parallel to each other and connect each end of the respective devices to each other into the form of a ladder (hereafter referred to as a ladder-type electron source substrate). Another method is to dispose surface conduction type electron-emitting devices into a simple matrix form in which each pair of device electrodes are connected to each other via X-direction interconnections and Y-direction interconnections (hereafter referred to as a matrix-type electron source substrate). In an image-forming apparatus constructed with a ladder-type electron source substrate, a control electrode (grid electrode) is required to control the travel of electrons emitted from electron-emitting devices.

Figure 6:
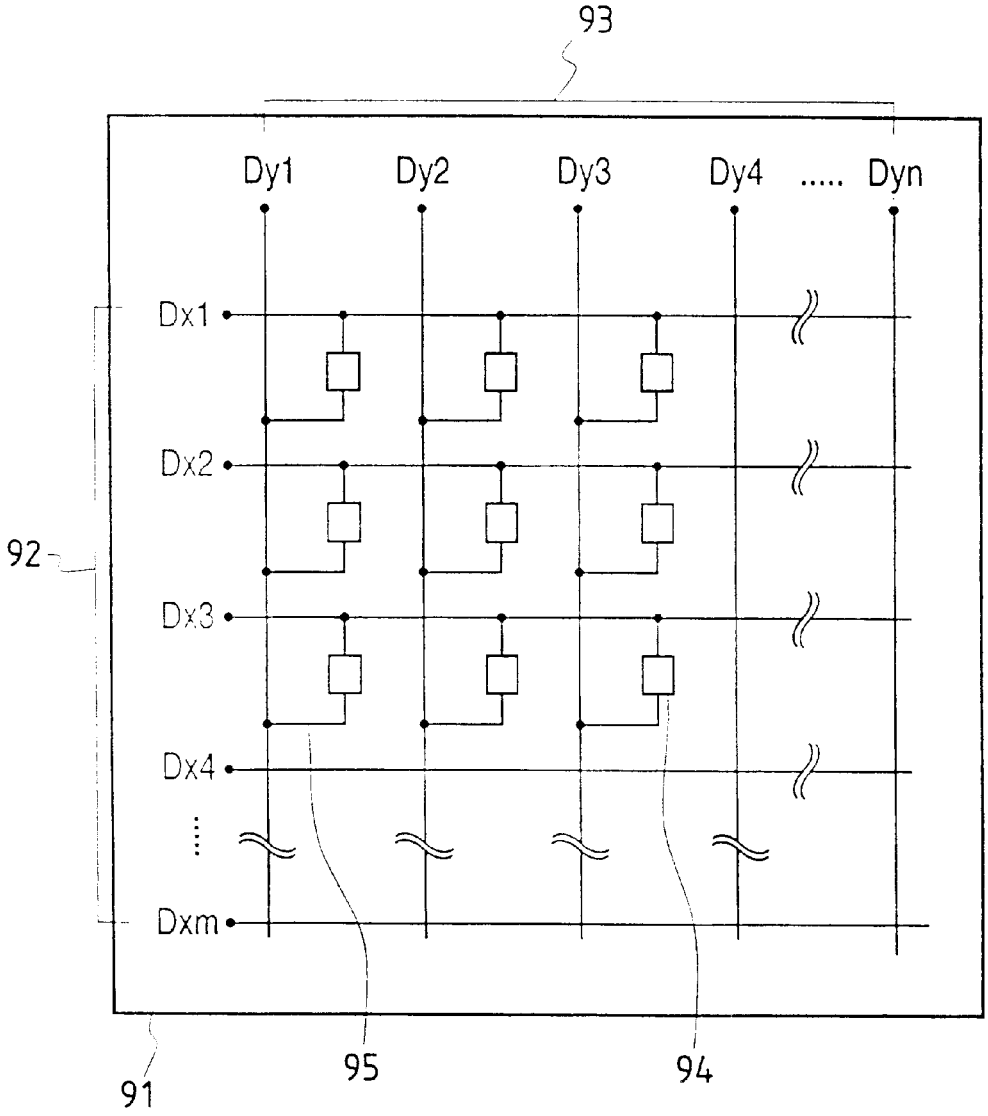
FIG. 6 is a plan view partially illustrating an electron source in a simple matrix form according to the present invention.

The construction of an electron source produced according to the present embodiment will be described in great detail below with reference to FIG. 6. In FIG. 6, reference numeral 91 denotes an electron source substrate, reference numeral 92 denotes an X-direction interconnection, reference numeral 93 denotes a Y-direction interconnection, reference numeral 94 denotes a surface conduction electron-emitting device, and reference numeral 95 denotes an interconnection.

In FIG. 6, a glass substrate or the like may be employed as a substrate for the electron source substrate 91, wherein its shape is selected according to a particular application.

The X-direction wires 92 include m lines Dx1, Dx2, . . . , Dxm, and the Y-direction wires 93 include n lines Dy1, Dy2, . . . , Dyn.

The material, film thickness, wire width are selected properly so that a voltage is supplied substantially uniformly to a great number of surface conduction type electron-emitting devices. These m X-direction wires 92 and n Y-direction wires 93 are electrically isolated from each other by an interlayer insulating layer (not shown), and these wires are disposed in a matrix form (m, n are both a positive integer).

The interlayer insulating layer (not shown) is formed over the X-direction wires 92 in the entire area or in a desired part of the surface of the electron source substrate 91. The X-direction wires 92 and the Y-direction interconnections 93 are each connected to a corresponding external terminal.

Furthermore, device electrodes (not shown) of surface conduction type electron-emitting devices 94 are electrically connected via m X-direction wires 92, n Y-direction wires 93, and wires 95.

The surface conduction type electron-emitting devices may be formed either directly on the substrate or on the interlayer insulating layer (not shown).

As will be described in greater detail later, the X-direction wires 92 are electrically connected to scanning signal generation means (not shown) so that a scanning signal generated by the scanning signal generation means is applied via the X-direction wires 92 to the surface conduction type electron-emitting devices 94 disposed in each X-direction row thereby scanning these surface conduction type electron-emitting devices in response to an input signal.

On the other hand, the Y-direction wires 93 are electrically connected to modulation signal generation means (not shown) so that a modulation signal generated by the modulation signal generation means is applied via the Y-direction wires 93 to the surface conduction type electron-emitting devices 94 disposed in each Y-direction column thereby modulating these surface conduction electron-emitting devices according to the input signal.

A voltage equal to the difference between the scanning signal and the modulation signal is applied as a driving voltage across each surface conduction type electron-emitting device.

In the arrangement described above, each device can be driven independently via the wires in the simple matrix form.

Figure 7:
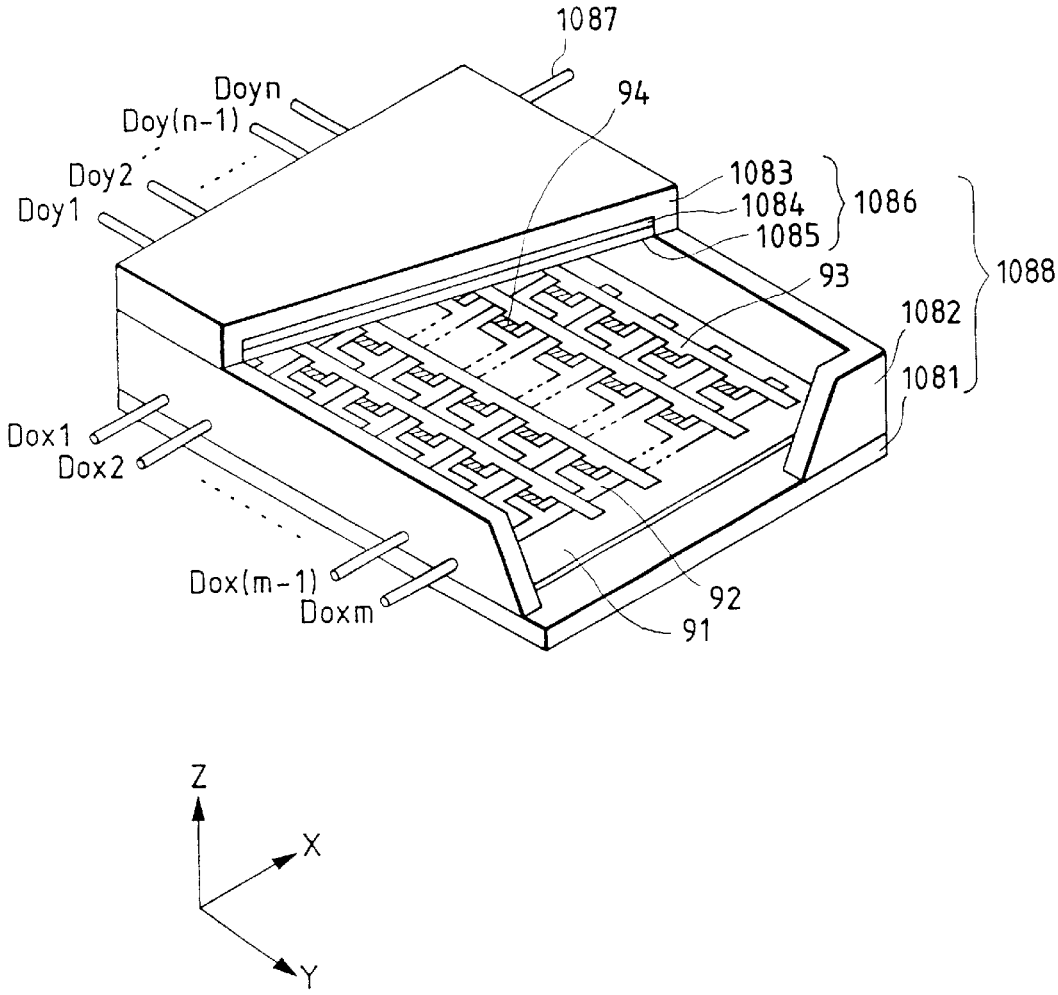
FIG. 7 is a schematic diagram of an image-forming apparatus according to the present invention.
Figure 8A:
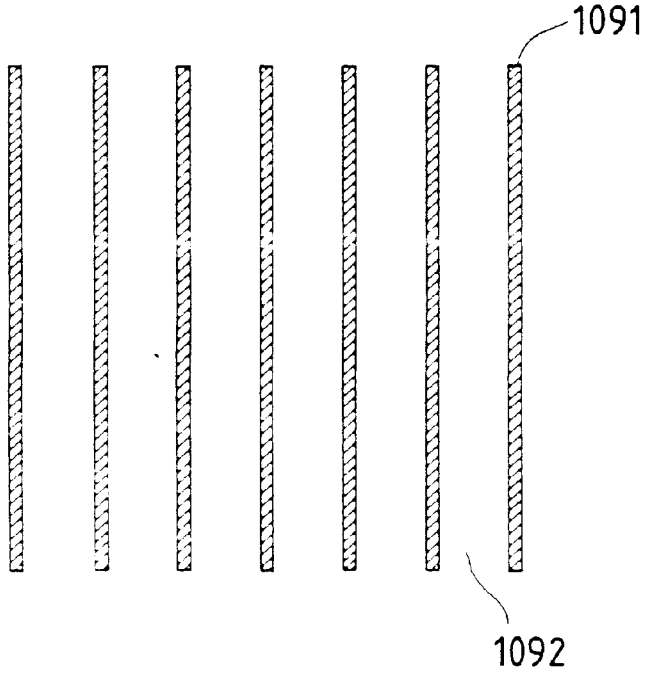
Figure 8B:
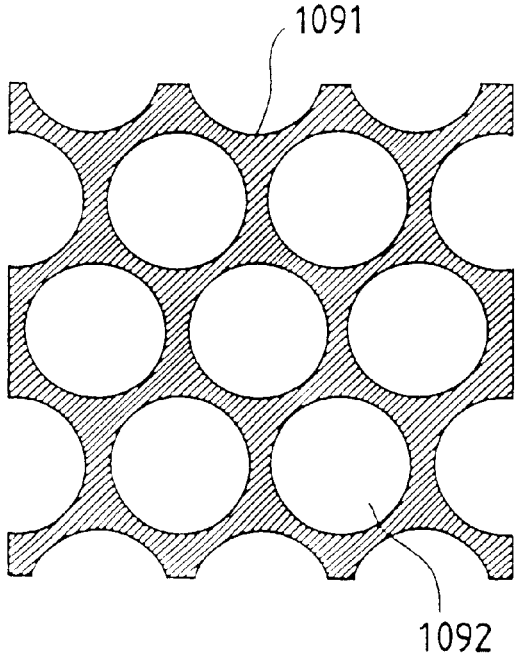
Figure 9:
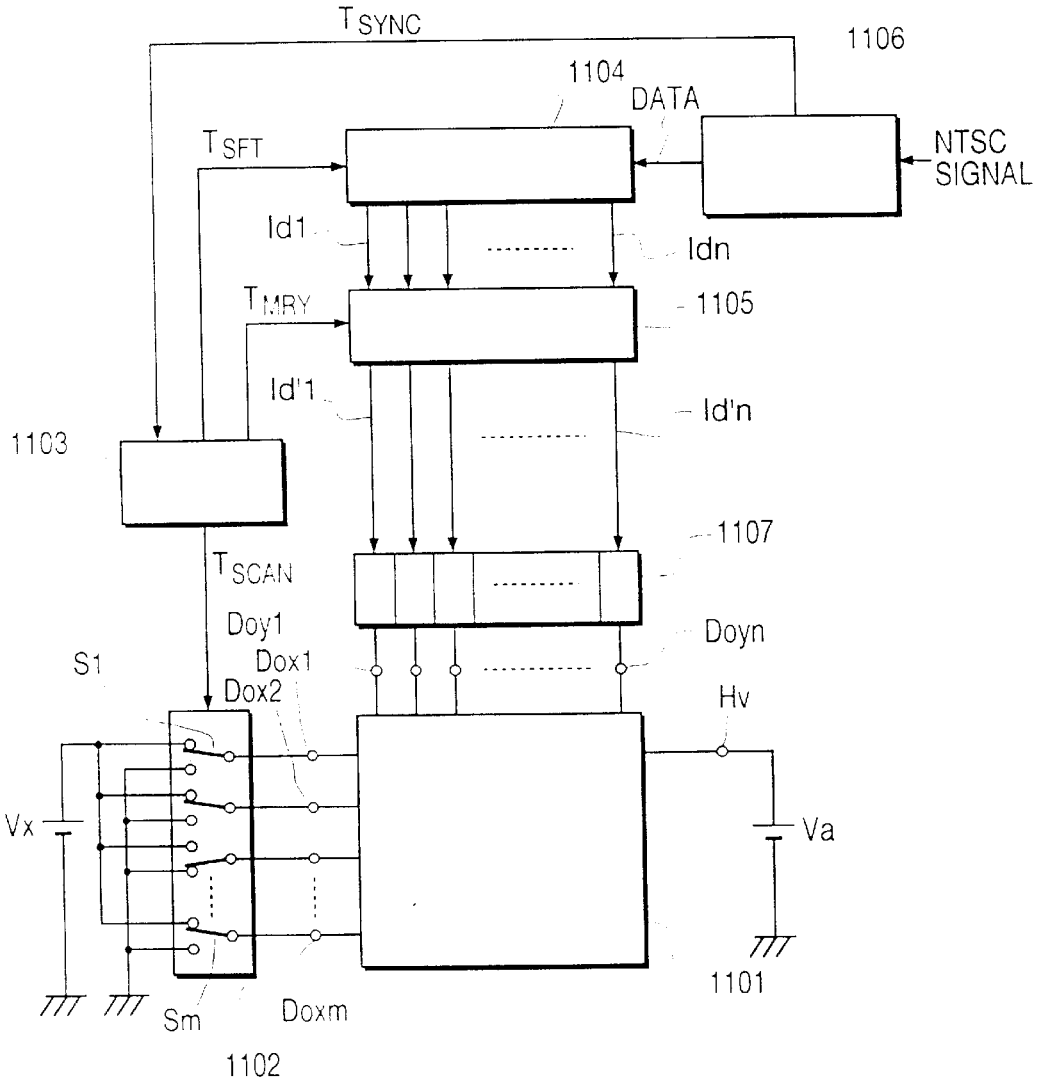
FIG. 9 is a block diagram of a driving circuit for driving an image-forming apparatus so as to display an image thereon in response to an NTSC TV signal, according to the present invention.

Referring to FIGS. 7, 8A and 8B, and 9, an image-forming apparatus using an electron source provided with simple matrix form wires produced in the above-described manner will be described below. FIG. 7 illustrates a basic construction of the image-forming apparatus, and FIGS. 8A and 8B illustrate fluorescent films. FIG. 9 is a block diagram illustrating the image-forming apparatus and a driving circuit for driving it according to an NTSC TV signal.

In FIG. 7, reference numeral 91 denotes an electron source substrate obtained by forming electron-emitting devices on a substrate, 1081 denotes a rear plate on which the electron source substrate 91 is fixed, 1086 denotes a face plate consisting of a glass substrate 1083 whose back surface is covered with a fluorescent film 1084 which is further backed with a metal (metal-back) 1085, and 1082 denotes a supporting frame, wherein an envelope 1088 is formed with these members.

Reference numeral 94 denotes an electron-emitting device, and 92 and 93 denote an X-direction wires and a Y-direction wires, respectively, connected to a pair of device electrodes of each surface conduction type electron-emitting device 94.

As described above, the envelope 1088 is composed of the face plate 1086, the supporting frame 1082, and the rear plate 1081. The principal purpose of the rear plate 1081 is to reinforce the mechanical strength of the electron source substrate 91. If the electron source substrate 91 itself has an enough mechanical strength, the rear plate 1081 is no longer necessary. In such a case, the supporting frame 1082 may be directly connected to the electron source substrate 91 so that the envelope 1088 is formed with the face plate 1086, the supporting frame 1082, and the electron source substrate 91.

In FIGS. 8A and 8B, reference numeral 1092 denotes a phosphor. In the case of monochrome type, the phosphor 1092 simply consists of the phosphor itself. However, in the case of a color type, the fluorescent film includes a phosphor 1092 and a black conductor 1091, which is called a black stripe or a black matrix depending on the arrangement of the phosphor. In color display devices, black stripes (black matrix) are disposed at boundaries between phosphors 1092 of three primary colors so as to reduce mixture of colors. The black stripes (black matrix) also prevent a reduction in contrast of the fluorescent film 1084 due to reflection of external light.

The phosphor may be coated on the glass substrate 1093 by means of deposition or printing in either case of monochrome type or color type fluorescent film.

The inner side of the fluorescent film 1084 (FIG. 7) is usually covered with a metal-back 1085. One purpose of the metal-back is to directly reflect light, which is emitted by the phosphor toward the inside, to the face plate 1086 thereby increasing the brightness. Another purpose is to act as an electrode to which an electron beam acceleration voltage is applied. Furthermore, the metal-back protects the phosphor from being damaged by collision of negative ions generated in the envelope. The metal-back is formed as follows. After forming a fluorescent film, the inner surface of the fluorescent film is smoothed (this smoothing process is usually called filming). Then, Al is deposited on the fluorescent film by means of for example evaporation.

The face plate 1086 may also be provided with a transparent electrode (not shown) on the outer side of the fluorescent film 1084 so as to increase the conductivity of the fluorescent film 1084.

In the case of a color image forming apparatus, when components are combined and sealed into a unit, phosphors of respective colors have to be disposed at correct locations corresponding to electron-emitting devices, and thus accurate positioning is required.

Sealing is performed after evacuating the inside of the envelope 1088 via an exhaust pipe (not shown) to a pressure of about $10^{-7}$ Torr. To maintain the pressure at a low enough value after sealing the envelope 1088, gettering may be performed. In the gettering process, a getter disposed at a proper location (not shown) is heated either immediately before or after the sealing of the envelope 1088 thereby evaporating a film. The getter usually contains Ba as a main ingredient, and the film formed by evaporating the getter has an adsorbent property. With the gettering, it is possible to maintain the pressure as low as $1\times10^{-5}$ Torr to $1\times10^{-7}$ Torr. Processes of surface conduction electron-emitting devices after the energization forming are determined properly as required.

Figure 5:
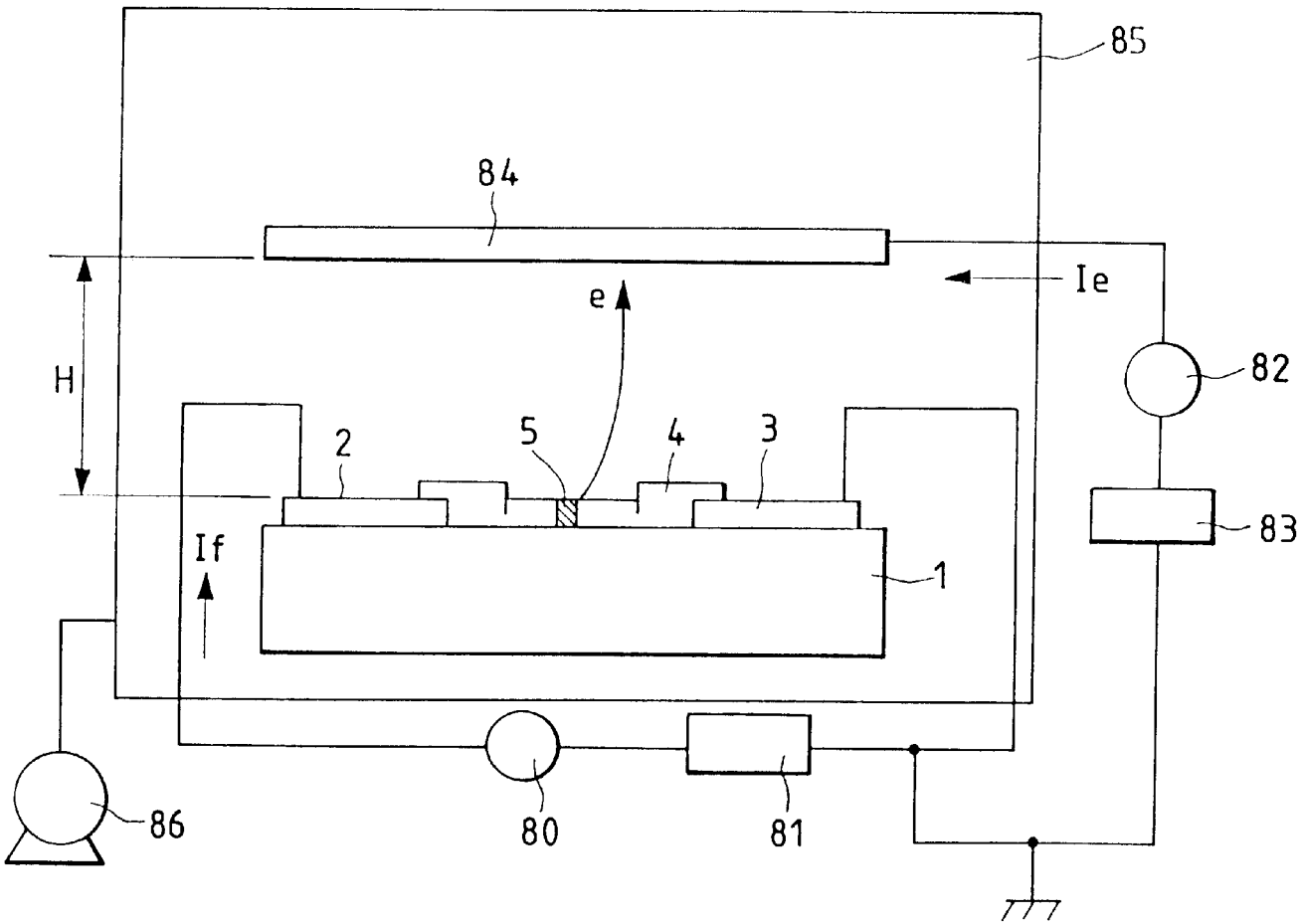
FIG. 5 is a schematic diagram of a system for measuring electron emission characteristics.

FIG. 5 is a schematic diagram of a measuring system for evaluating the electron emission performance. In FIG. 5, 81 denotes a power source for supplying a device voltage Vf to a device, 80 denotes an ammeter for measuring a device current $I_f$ flowing through the electrically-conductive thin film 4 between device electrodes 2 and 3, 84 denotes an anode electrode for measuring an emission current $I_e$ emitted by the electron emission region of the device, 83 denotes a high-voltage power source for supplying a voltage to the anode electrode 84, 82 denotes an ammeter for measuring an emission current $I_e$ emitted by the electron emission region of the device, 85 denotes a vacuum chamber, and 86 denotes a vacuum pump.

Referring to the block diagram shown in FIG. 9, the circuit configuration of the driving circuit for driving the image-forming apparatus provided with the electron source of the simple matrix type so that a television image is displayed thereon according to an NTSC television signal will be described below. As shown in FIG. 9, the driving circuit includes a display panel 1101, a scanning circuit 1102, a control circuit 1103, a shift register 1104, a line memory 1105, a synchronizing signal extraction circuit 1106, a modulation signal generator 1107, and DC voltage sources Vx and Va.

These components will be described in detail below.

The display panel 1101 is connected to external electric circuits via terminals Dox1 to Doxm, terminals Doy1 to Doyn, and a high-voltage terminal Hv. The electron source disposed in the display panel is driven via these terminals as follows. The surface conduction electron-emitting devices arranged in the form of an m×n matrix is driven row by row (n devices at a time) by a scanning signal applied via the terminals Dox1 to Doxm.

Via the terminals Doy1 to Doyn, a modulation signal is applied to each surface conduction type electron-emitting device disposed in the line selected by the above-described scanning signal, thereby controlling the electron beam emitted by each device. A DC voltage of for example 10 kV is supplied from the DC voltage source Va via the high-voltage terminal Hv. This voltage is used to accelerate the electron beam emitted from each surface conduction type electron-emitting device so that the electrons gain high enough energy to excite the phosphor.

The scanning circuit 1102 operates as follows. The scanning circuit 1102 includes m switching elements (S1 to Sm in FIG. 9). Each switching element selects either the voltage Vx output by the DC voltage source or 0 V (ground level) so that the selected voltage is supplied to the display panel 1101 via the terminals Dox1 to Doxm. Each switching element S1 to Sm is formed with a switching device such as an FET. These switching elements S1 to Sm operate in response to the control signal Tscan supplied by the control circuit 1103.

The output voltage of the DC voltage source Vx is set to a fixed value so that devices which are not scanned are supplied with a voltage less than the electron emission threshold voltage of the surface conduction electron-emitting device.

The control circuit 1103 is responsible for controlling various circuits so that an image is correctly displayed according to an image signal supplied from the external circuit. In response to the synchronizing signal Tsync received from the synchronizing signal extraction circuit 1106 which will be described in greater detail below, the control circuit 1103 generates control signals Tscan, Tsft, and Tmry and sends these control signals to the corresponding circuits.

The synchronizing signal extraction circuit 1106 is constructed with a common filter circuit in such a manner as to extract a synchronizing signal component and a luminance signal component from an NTSC television signal supplied from an external circuit. Although the synchronizing signal extracted by the synchronizing signal extraction circuit 1106 is simply denoted by Tsync in FIG. 9, the practical synchronizing signal consists of a vertical synchronizing signal and a horizontal synchronizing signal. The image luminance signal component extracted from the television signal is denoted by DATA in FIG. 9. This DATA signal is applied to the shift register 1104.

The shift register 1104 receives a DATA signal in time sequence and converts it to a signal in parallel form line by line of an image. The above-described conversion operation of the shift register 1104 is performed in response to the control signal Tsft generated by the control circuit 1103 (this means that the control signal Tsft acts as a shift clock signal to the shift register 1104).

After being converted into the parallel form, one line of image data consisting of parallel signals Id1 to Idn is output from the shift register 1104 (thereby driving n electron-emitting devices).

The line memory 1105 stores one line of image data for a required time period. That is, the line memory 1105 stores the data Id1 to Idn under the control of the control signal Tmry generated by the control circuit 1103. The contents of the stored data are output as data I'd1 to I'dn from the line memory 1105 and applied to the modulation signal generator 1107.

The modulation signal generator 1107 generates signals according to the respective image data I'd1 to I'dn so that each surface conduction electron-emitting device is driven by the corresponding modulation signals generated by the modulation signal generator 1107 wherein the output signals of the modulation signal generator 1107 are applied to the surface conduction electron-emitting devices of the display panel 1101 via the terminal Doy1 to Doyn.

The electron-emitting device used in the present invention has fundamental characteristics in terms of the emission current $I_e$ as described below. In the emission of electrons, there is a distinct threshold voltage Vth. That is, only when a voltage greater than the threshold voltage Vth is applied to an electron-emitting device, the electron-emitting device can emit electrons.

In the case where the voltage applied to the electron-emitting device is greater than the threshold voltage, the emission current varies with the variation in the applied voltage. The electron emission threshold voltage Vth and the dependence of the emission current on the applied voltage may vary depending on the materials, structure, and production technique.

When the electron-emitting device is driven by a pulse voltage, if the voltage is less than the electron emission threshold voltage, no electrons are emitted, while an electron beam is emitted when the pulse voltage is greater than the threshold voltage. Thus, it is possible to control the intensity of the electron beam by varying the peak voltage Vm of the pulse. Furthermore, it is also possible to control the total amount of charge carried by the electron beam by varying the pulse width Pw.

As can be seen from the above discussion, either technique based on the voltage modulation or pulse width modulation may be employed to control the electron-emitting device so that the electron-emitting device emits electrons according to the input signal. When the voltage modulation technique is employed, the modulation signal generator 1107 is designed to generate a pulse having a fixed width and having a peak voltage which varies according to the input data.

On the other hand, if the pulse width modulation technique is employed, the modulation signal generator 1107 is designed to generate a pulse having a fixed peak voltage and having a width which varies according to the input data.

According to the above operation, a TV image is displayed on the display panel 1101. In the above circuit, the shift register 1104 and the line memory 1105 may be either of analog type or of digital type as long as the serial-to-parallel conversion of the image signal and the storage operation are correctly performed at a desired rate.

When the digital technique is employed for these circuits, an analog-to-digital converter is required to be connected to the output of the synchronizing signal extraction circuit 1106 so that the output signal DATA of the synchronizing signal extraction circuit 1106 is converted from analog form to digital form. Furthermore, a proper type of modulation signal generator 1107 should be selected depending on whether the line memory 1105 outputs digital signals or analog signals.

When a voltage modulation technique using digital signals is employed, the modulation signal generator 1107 is required to include a digital-to-analog converter and an amplifier is added as required.

In the case of the pulse width modulation, the modulation signal generator 1107 is constructed for example with a combination of a high speed signal generator, a counter for counting the number of pulses generated by the signal generator, and a comparator for comparing the output value of the counter with the output value of the above-described memory. If required, an amplifier is further added to the above so that the voltage of the pulse-width modulation signal output by the comparator is amplified to a voltage large enough to drive the surface conduction electron-emitting devices.

On the other hand, in the case where a voltage modulation technique using analog signals is employed, an amplifier such as an operational amplifier is used as the modulation signal generator 1107. A level shifter is added to that if required. In the case where the pulse width modulation technique is coupled with the analog technique, a voltage controlled oscillator (VCO) can be used as the modulation signal generator 907. If required, an amplifier is further added to the above so that the output voltage of the VCO is amplified to a voltage large enough to drive the surface conduction electron-emitting devices.

In the image display device constructed in the above-described manner according to the present invention, electrons are emitted by applying a voltage to each electron-emitting device via the external terminals Dox1 to Doxm, and Doy1 to Doyn. The emitted electrons are accelerated by a high voltage which is applied via the high voltage terminal Hv to a back-metal 1085 or a transparent electrode (not shown). The accelerated electrons strike a fluorescent film and thus light is emitted from the fluorescent film. As a result, an image is formed by light emitted from the fluorescent film.

While the image-forming apparatus of the present invention has been described above with reference to a preferred embodiment thereof, the invention is not limited to the details shown, since various modifications in the construction or the material are possible. Furthermore, although it is assumed in the above description that an input signal according to the NTSC standard is used, an input signal according to another standard such as PAL, or SECAM may also be employed. A TV signal consisting of a greater number of lines than those of the above standards may also be employed (such standards include the MUSE and other the high definition television standards).

The ladder-type electron source substrate and an image display device using such the electron source substrate will be described below with reference to FIGS. 10 and 11.

Figure 10:
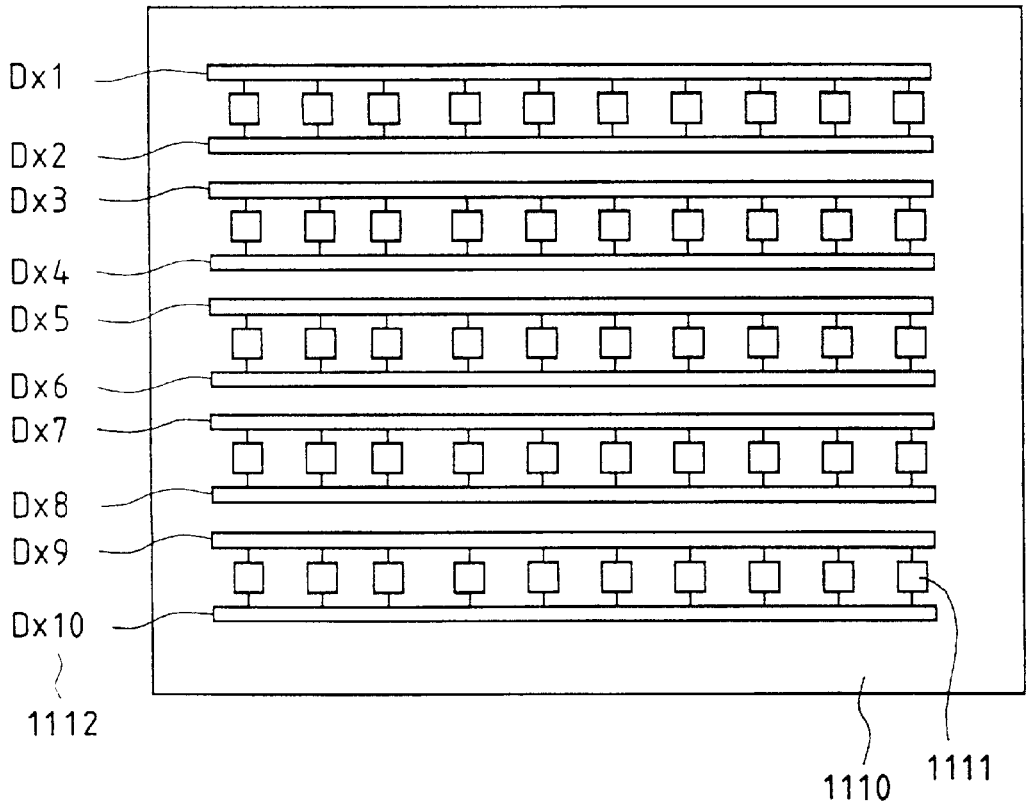
FIG. 10 is a schematic diagram of a ladder-type electron source.

In FIG. 10, reference numeral 1110 denotes an electron source substrate, 1111 denotes an electron-emitting device, and 1112 denotes an interconnection Dx1 to Dx10 for connecting electron-emitting devices in common. In the ladder-type electron source substrate, a plurality of electron-emitting devices 1111 are disposed on a substrate 1110 in a line along the X direction (this line is referred to as a device row), and a plurality of device lines are disposed on the substrate in parallel. A driving voltage is applied separately to each device row via a corresponding common interconnection thereby driving each device row independently. That is, if a voltage greater than an electron emission threshold is applied to a device row to be activated, an electron beam is emitted from this device row. On the other hand, no electrons are emitted by device rows which are applied with a voltage less than the electron emission threshold. Some of the row interconnections, for example Dx2 and Dx3, may be connected in common.

Figure 11:
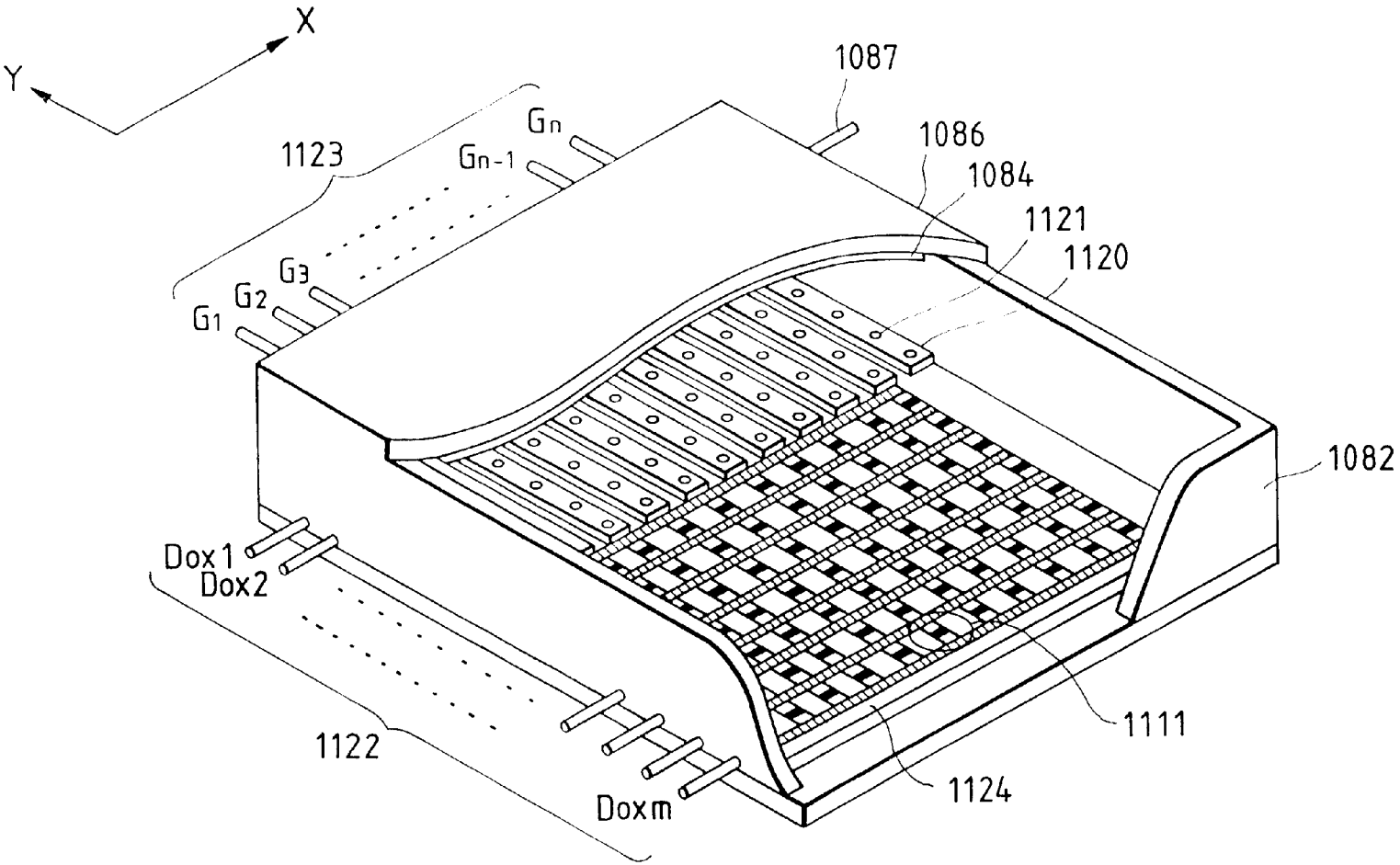
FIG. 11 is a perspective view, partially cut away, of an image display device according to the present invention.

FIG. 11 is a schematic diagram of an image-forming apparatus provided with a ladder-type electron source. In FIG. 11, reference numeral 1120 denotes a grid electrode, 1121 denotes an opening through which electrons may pass, 1122 denotes external terminals Dox1, Dox2, . . . , Dox extending toward the outside of the case, 1123 denotes external terminals G1, G2, . . . , Gn connected to the grid electrodes 1120 and extending toward the outside, and 1124 denotes an electron source substrate whose devices disposed in each row are connected in common in the manner as described above. In FIGS. 7 and 10, similar members are denoted by similar reference numerals. The image-forming apparatus of this embodiment differs from the simple-matrix image-forming apparatus (FIG. 7) described above in that the grid electrode 1120 is disposed between the electron source substrate 1110 and the face plate 1086.

As described above, the grid electrode 1120 is disposed in the middle between the substrate 1110 and the face plate 1086. The grid electrode 1120 is used to modulate the electron beam emitted by the surface conduction electron-emitting devices. The grid electrode 1120 includes stripe-shaped electrodes extending in a direction perpendicular to the device rows arranged in the ladder-form wherein the stripe-shaped electrodes have circular openings 1121 disposed at location corresponding to the respective electron-emitting devices so that an electron beam may pass through these openings. The shape and the location of the grid is not limited to that shown in FIG. 11. For example, many openings may be disposed in a mesh form. Furthermore, openings may also be provided at locations in the vicinities of, or in peripherals of, surface conduction electron-emitting devices.

The terminals 1122 extending outward from the case and the grid terminals 1123 extending outward from the case are electrically connected to a control circuit (not shown).

In this image-forming apparatus, one line of image modulation signal is applied to a grid electrode column in synchronization with the driving signal applied row to row (scanning operation) thereby controlling the irradiation of the electron beam to the phosphor and thus displaying an image line to line.

The image-forming apparatus according to the present invention can be applied not only to a television system, but also to other display systems such as a video conference system, a display for a computer system, etc. Furthermore, the image-forming apparatus according to the present invention can be coupled with a photosensitive drum and other elements so as to form an optical printer.

EXAMPLES

Referring to specific examples, the present invention will be described in further detail below.

Example 1

Figure 12:
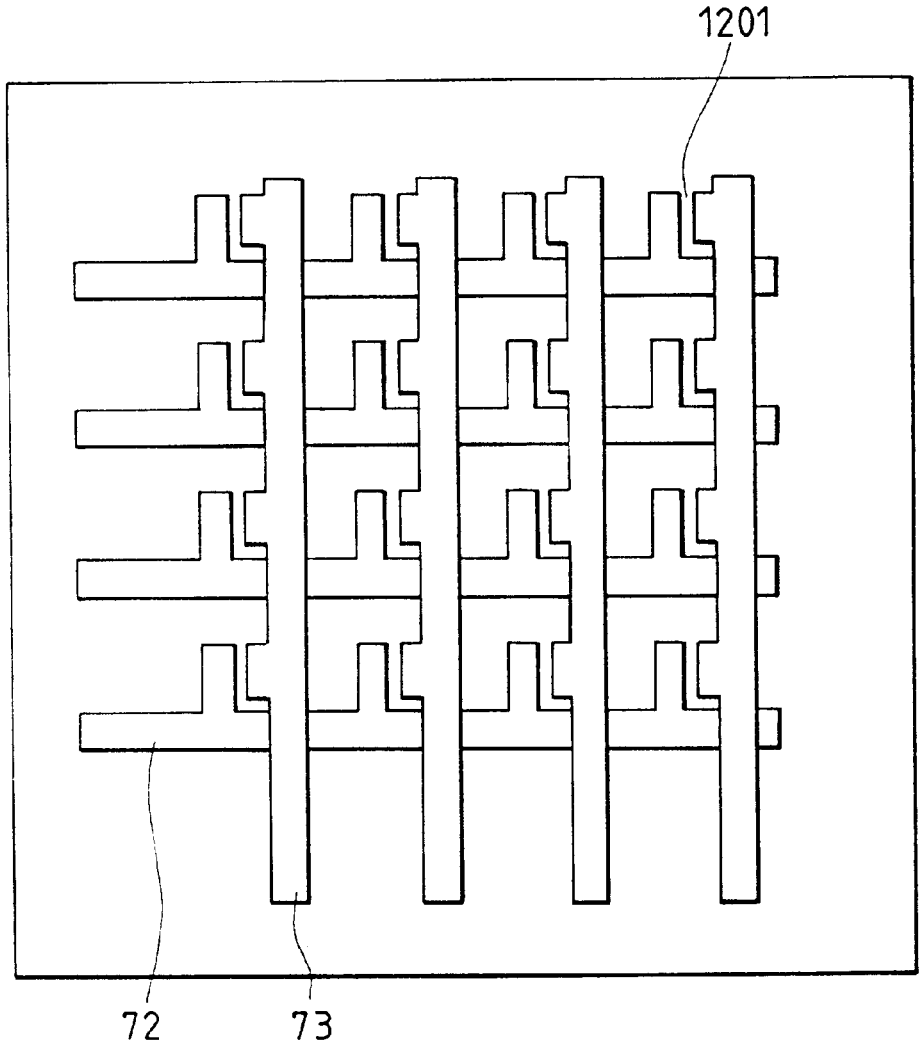
FIG. 12 is a schematic diagram of a substrate on which device electrodes are formed in a matrix fashion.

Using a photolithographic technique which will be described in detail later, electron emission regions were formed in areas 1201 assigned for the electron emission regions on a substrate on which device electrodes (X-direction wires 72 and Y-direction wires 73) are disposed in a matrix form as shown in FIG. 12 so as to produce an electron source substrate on which a plurality of surface conduction electron-emitting devices are disposed.

The electrodes were formed so that, at wires of the X-direction and Y-direction wires, they are electrically isolated from each other by an insulator (not shown). FIGS. 1A to 1D illustrate a production process flow associated with the surface conduction type electron-emitting device. FIGS. 2A and 2B illustrate a top view and a cross section of a surface conduction type electron-emitting device produced.

Device electrodes were formed on a substrate by means of photolithography according to the process steps described below.

(1) A quartz substrate was employed as the insulating substrate 1. The quartz substrate was cleaned well with an organic solvent. Then, electrodes 2 and 3 of Ni were formed on the substrate 1 using a common evaporation technique and a photolithography technique (FIG. 1A). The electrodes 2 were formed so that the distance L1 between the electrodes was 2 $\mu$m the width W1 of the electrodes was 600 $\mu$m, and the thickness thereof was 1000 Å.

(2) Using an ink-jet ejecting device provided with a piezoelectric device serving as the droplet supplying mechanism 6, a 60 $\mu m^3$ droplet (one dot) of a solution containing organic palladium (ccp-4230, available from Okuno-Seiyaku Co., Ltd.) was deposited between the electrodes 2 and 3 so that a thin film 4 having a width W2 of 300 $\mu$m was formed (FIG. 1B). In this example, the volume of the recessed space formed on the insulating substrate 1 between the electrodes 2 and 3 was 120 $\mu m^3$.

(3) Then, heat treatment was performed at 300° C. for 10 min so that a particle film serving as the thin film 4 (FIG. 1C) and consisting of palladium oxide (PdO) particles was formed. As described earlier, the term "particle film" is used herein to refer to a film composed of a plurality of particles, wherein the particles may be dispersed in the film, or otherwise the particles may be disposed so that they are adjacent to each other or they overlap each other (or may be disposed in the form of islands).

(4) A voltage was applied across the electrodes 2 and 3 so that the thin film 4 was subjected to a forming process (energization forming process) thereby forming an electron emission region 5 (FIG. 1D).

Using the electron source substrate produced in the above-described manner, an envelope 1088 was formed with a face plate 1086, a supporting frame 1082, and rear plate 1081. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

The electron-emitting device produced according to the method described above, the electron source substrate produced using this electron-emitting device, the display panel, and the image-forming apparatus all showed good performance, and no problems were observed. Furthermore, according to the method of producing a surface conduction type electron-emitting device described in the present example, the thin film 4 was formed by supplying a droplet onto the substrate and thus a process for patterning the thin film 4 was no longer required. Furthermore, the thin film 4 was formed with only one droplet (one dot) without uselessly consuming the solution.

Example 2

Figure 13:
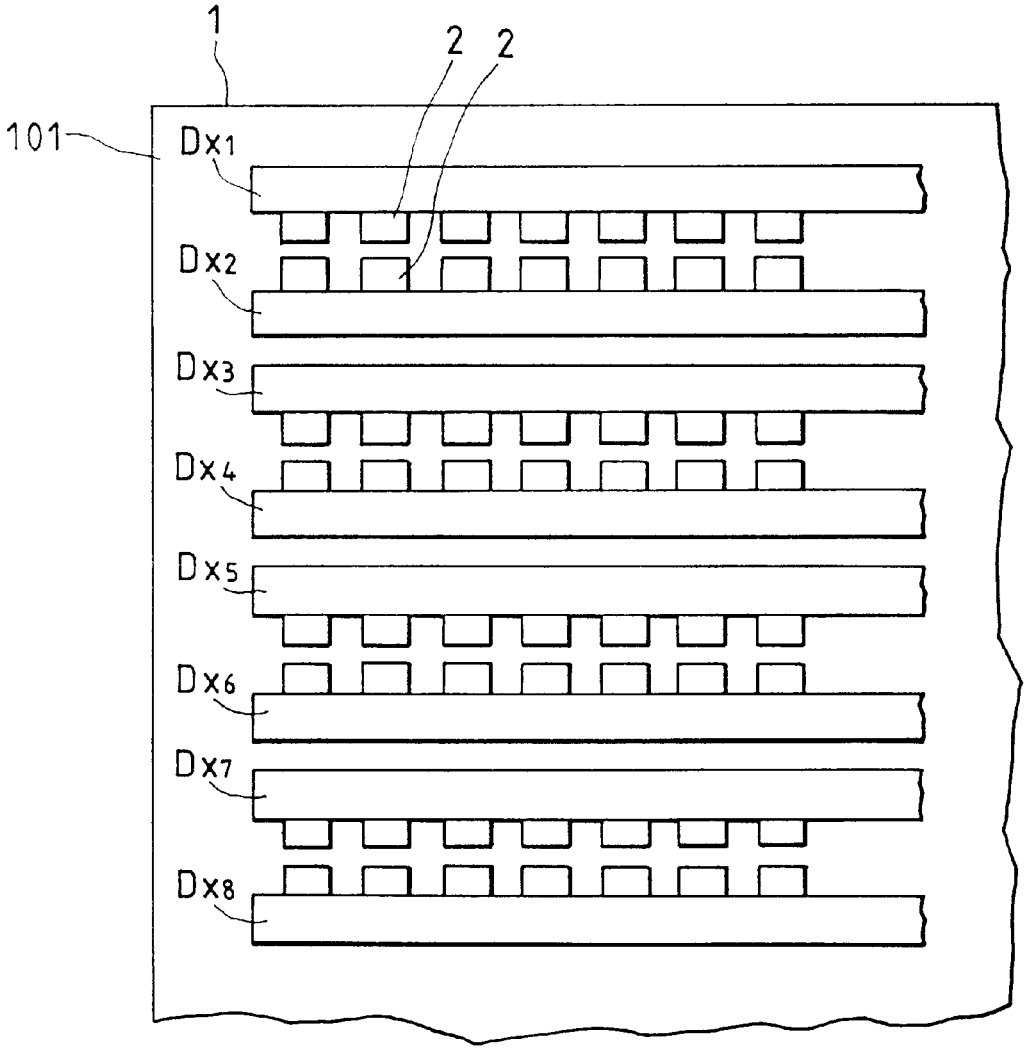
FIG. 13 is a schematic diagram of a substrate on which device electrodes are formed in a ladder fashion.

Device electrodes were formed on a substrate in a ladder form so that the width (W1) of the device electrodes was 600 $\mu$m, the distance (L1) between the device electrodes was 2 $\mu$m, and the thickness of the device electrodes was 1000 Å. Using this substrate (FIG. 13), surface conduction electron-emitting devices were produced in a manner similar to that in Example 1. In FIG. 13, reference numeral 1301 denote the substrate, and reference numeral 1302 denotes an wire.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed as good performance as in Example 1.

Example 3

Device electrodes were formed in a matrix form on a substrate in the manner described above. Then, surface conduction type electron-emitting devices were produced on this substrate (FIG. 12) using the above-described ink-jet ejecting device of the bubble jet type in a manner similar to that in Example 1.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed as good performance as in Example 1.

Example 4

Device electrodes were formed in a ladder form on a substrate in the manner described above (FIG. 13). Then, surface conduction type electron-emitting devices were produced on this substrate using the ink-jet ejecting device of the bubble jet type in a manner similar to that in Example 1.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed as good performance as in Example 1.

Example 5

Surface conduction type electron-emitting devices were produced in the same manner as in Example 1 except that the thin film 4 was formed of a 0.05 wt % palladium acetate aqueous solution. Although the solution used in this example was different from that in Example 1, the obtained devices showed as good performance as in Example 1.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed as good performance as in Example 1.

Example 6

Surface conduction type electron-emitting devices were produced in the same manner as in Example 1 except that the amount of one droplet was 30 $\mu m^3$ and two droplets (two dots) were supplied for each device. The obtained devices showed as good performance as in Example 1. This means that if a proper amount of solution is supplied, a desired thin film can be formed.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed as good performance as in Example 1.

Example 7

Surface conduction type electron-emitting devices were produced in the same manner as in Example 1 except that the amount of one droplet was 200 $\mu m^3$.

Although the width of the thin film 4 became greater than the width of the electrodes 2 and 3 as shown in FIG. 3, the resultant devices showed good electron emission performance.

Using the obtained electron source substrate, an envelope 1088 was formed with a face plate 1086, a supporting frame 1082, and rear plate 1081 in a manner similar to that in Example 1. Then the envelope 1088 was sealed. Thus a display panel was obtained. Furthermore, an image-forming apparatus provided with a driving circuit capable of displaying a television image according to an NTSC television signal, such as that shown in FIG. 9, was produced. The resultant devices showed similar performance to that in Example 1.

However, the increase in the length of the electron emission region 5 exceeding the length of the device electrodes resulted in a variation in the performance and thus the picture quality was poor relative to that in Examples 1 to 6.

Example 8

Electron-emitting devices were produced using the apparatus shown in FIG. 14. The process of supplying a droplet was performed in the manner shown in the flow chart of FIG. 15.

In FIG. 14, reference numeral 1 denotes an insulating substrate, 2 and 3 denote an electrode, 4 denotes a droplet, 5 denotes a thin film, 6 denotes an electron emission region, 7 denotes an ink-jet ejecting device, 8 denotes light emitting means, 9 denotes light receiving means, 10 denotes a stage, and 11 denotes a controller.

The production was performed as follows.

(1) Electrode Formation Process

A flat glass substrate was employed as the insulating substrate 1. The glass substrate was cleaned well with an organic solvent. Then, electrodes 2 and 3 of Ni were formed on the substrate 1 using an evaporation technique and a photolithography technique. The electrodes 2 were formed so that the distance between the electrodes was 3 $\mu m$ the width of the electrodes was 500 $\mu m$, and the thickness thereof was 1000 Å.

(2) Positioning Process

As for the ink-jet ejecting device 7, an ink-jet print head capable of ejecting a droplet of solution by bubble jet type ink-jet ejecting device was employed. An optical sensor serving as the light receiving means 9 for detecting an optical signal and converting it into an electrical signal was disposed at a side of the print head. An insulating substrate 1 having electrodes 2 and 3 was placed on the stage 10 and fixed thereon. The back face of the insulating substrate 1 was illuminated by light emitted from a light emitting diode serving as the light emitting means 8. Under the control of the controller 11, the stage 10 was moved while monitoring, with the light receiving means 9, the light passing through the area between the device electrodes 2 and 3 so that the ink jet position comes to a correct position between the device electrodes 2 and 3.

(3) Droplet Supplying Process

Using an ink-jet ejecting device 7, a droplet 4 of a solution containing organic palladium (ccp-4230, available from Okuno-Seiyaku Co., Ltd.) serving as a material of a thin film (particle film) 5 was deposited between the electrodes 2 and 3.

(4) Droplet Detection Process

In a manner similar to that in the positioning process, it was checked whether a droplet 4 was supplied properly.

While the droplet 4 was deposited at a correct position in this example, if the droplet 4 was not supplied between the device electrodes 2 and 3, the droplet supplying process is performed repeatedly until it is concluded in the droplet detection process that a droplet 4 has been supplied successfully. This reduces the number of defects which are produced in the thin film 4 during the process of forming the thin film 4.

(5) Heating Process

The insulating substrate 1 on which the droplet 4 was deposited was heated at 300° C. for 10 min so that a particle film consisting of palladium oxide (PdO) particles was formed. Thus, a thin film 5 was obtained. The diameter of the resultant thin film was 150 μm and it was located at a substantially central position between the device electrodes 2 and 3. The thickness was 100 Å, and the sheet resistance was $5\times10^4$ Ω/square.

As described earlier, the term "particle film" is used here to refer to a film composed of a plurality of particles, wherein the particles may be dispersed in the film, or otherwise the particles may be disposed so that they are adjacent to each other or they overlap each other (or may be disposed in the form of islands).

The surface conduction type electron-emitting devices obtained in the above-described manner were subjected to a forming process. The resultant devices showed good performance.

Example 9

FIG. 16 illustrates the droplet supplying process using the production apparatus employed in this example.

In this example, electrodes were formed in a manner similar to that in Example 8. Then, positioning was performed in the same manner as in Example 8 except that instead of moving the stage 10, the ink-jet ejecting device 7 and the light receiving means 9 disposed adjacent to each other were moved by means of control means 12. After that, a droplet supplying process, a droplet detection process, and a heating process were performed in the same manner as in Example 8 thereby obtaining surface conduction type electron-emitting devices. In this example, the light emitting means 8 was provided with a mechanism (not shown) capable of moving in synchronization with the movement of the light receiving means 9.

The surface conduction type electron-emitting devices obtained in the above-described manner showed as good device performance as in Example 8.

Example 10

FIG. 17 illustrates the droplet supplying process using the production apparatus employed in this example.

In this example, electrodes were formed in a manner similar to that in Example 8. In this example, the light emitting means, the ink-jet 7, and the light receiving means 9 were located adjacent to each other, and the position between the device electrodes 2 and 3 was detected by detecting the light emitted by the light emitting means 8 and then reflected from the substrate. After that, a droplet supplying process, a droplet detection process, and a heating process were performed in the same manner as in Example 8 thereby obtaining surface conduction electron-emitting devices.

The surface conduction electron-emitting devices obtained in the above-described manner showed as good device performance as in Example 8.

Example 11

Figure 21:
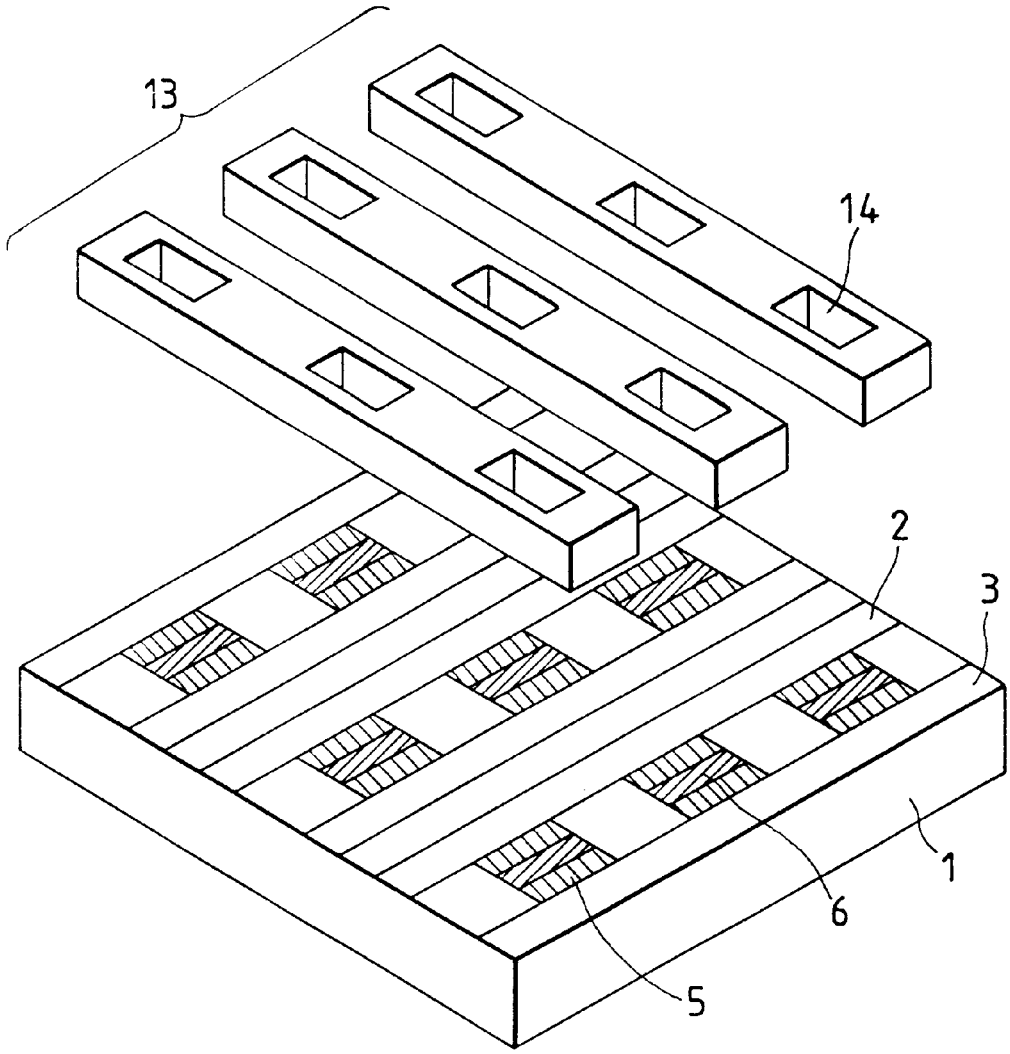
FIG. 21 is a perspective view of an example of an electron beam generation apparatus provided with a device produced according to the production method of the present invention.

In this example, an electron beam generation apparatus using an electron source substrate such as that shown in FIG. 21 was produced.

First, a plurality of electron-emitting devices were formed on an insulating substrate 1 in a manner similar to that in Example 8. A grid (modulation electrode) 13 having electron transmission holes 14 was disposed above the insulating substrate 1 so that the orientation of the grid 13 was perpendicular to the device electrodes 2 and 3 thereby forming an electron beam generation apparatus.

The performance of the electron source obtained in the above-described manner was evaluated. The electron beam emitted by the electron-emitting devices was switched in an on-off fashion in response to information signal applied to the grid 13. It was also possible to continuously control the amount of electrons of the electron beam according to information signal applied to the grid 13. Furthermore, there was a very small variation in the amount of electrons of the electron beam among electron-emitting devices.

Example 12

Using a substrate on which a plurality of electron-emitting devices were formed in a manner similar to that in Example 11, an image-forming apparatus provided with a grid such as that shown in FIG. 11 was produced. The resultant image-forming apparatus showed good performance without having any problems.

Example 13

Using a substrate on which a plurality of electron-emitting devices were formed in a manner similar to that in Example 8, an image-forming apparatus such as that shown in FIG. 7 was produced. The resultant image-forming apparatus showed good performance without having any problems.

Example 14

Figure 22:
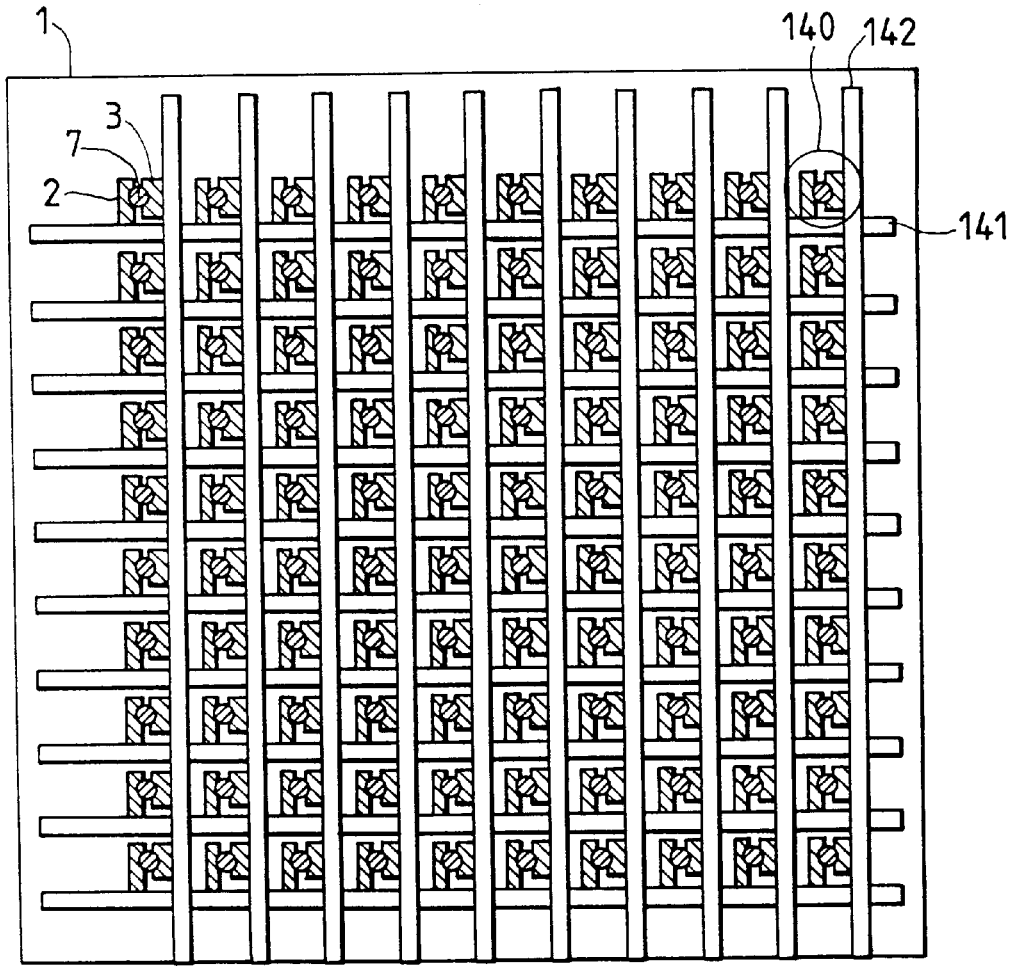
FIG. 22 is a schematic diagram illustrating an example of an electron source substrate on which electron-emitting devices are formed by means of an ink-jet technique on a substrate having a simple 10×10 matrix-shaped interconnection.
Figure 31A:
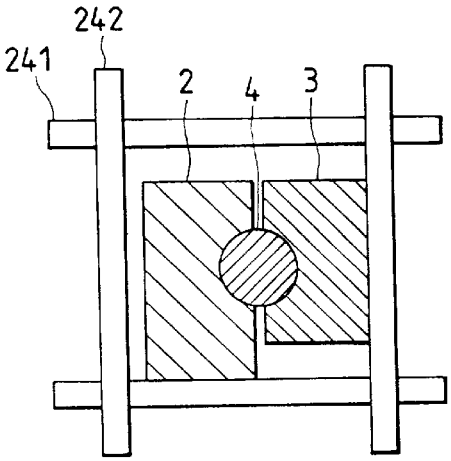
FIGS. 31A to 31C illustrate possible variations of the device structure of a surface conduction electron-emitting device produced by a production method using an ink-jet technique according to the present invention.

According to the ink-jet method of the invention, surface conduction electron-emitting devices were formed on a substrate on which interconnections were formed in a 10×10 matrix form, as shown in FIG. 22. FIG. 31A is an enlarged view illustrating each unit cell. Each unit cell is composed of: wires 241 and 242 extending in directions perpendicular to each other; and device electrodes 2 and 3 disposed at opposing locations wherein each device electrode is connected to either wire. The wires 241 and 242 were formed by means of a printing technique. At intersections of these wires, they are electrically isolated from each other by an insulator (not shown). The opposing device electrodes 2 and 3 were formed of an evaporated film which was patterned by means of photolithography. The width of the gap between the device electrodes was about 10 μm, the gap length was 500 μm, and the film thickness of the device electrodes was 30 nm. According to the ink-jet method of the invention, an ink droplet of a solution containing organic palladium (Pd concentration of 0.5 wt %) was ejected a few times onto the central position of the gap between device electrodes thereby forming a droplet 7. Then, a drying process and a baking process (at 350° C. for 30 min) were performed. Thus, an electrically-conductive thin film in a circular form having a diameter of about 300 μm and a thickness of 20 nm consisting of PdO particles was obtained.

Figure 23:
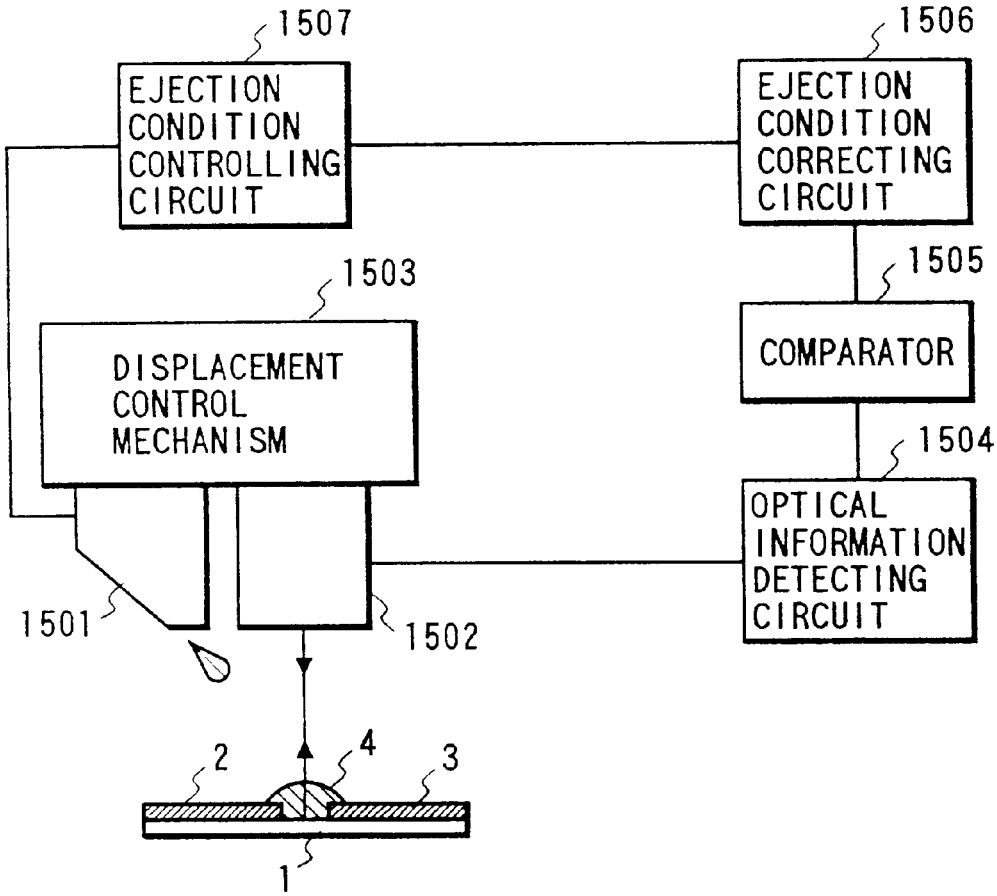
FIG. 23 is a block diagram illustrating an example of an ejecting operation control system used in a production apparatus according to the present invention.

FIG. 23 is a block diagram of an ejection control system used to form a thin film according to the ink-jet method of the invention. In this figure, reference numeral 1 denotes a substrate on which a unit cell is formed. Reference numerals 2 and 3 denote opposing device electrodes. Reference numeral 1501 denotes an ejection nozzle of the ink-jet ejecting device, and 1502 denotes an optical system for detecting information associated with a droplet. Reference numeral 1503 denotes a displacement control mechanism on which there are mounted the detection optical system and an ink-jet cartridge composed of the ejection nozzle, an ink tank, and a supplying system. The displacement control mechanism 1503 includes: a coarse adjustment mechanism responsible for movement from a unit cell to another cell on a substrate provided matrix-shaped wires; and a fine adjustment mechanism responsible for horizontal positioning within a unit cell and for adjustment of distance between the substrate and the ejection nozzle. In this example, a piezoelectric ink-jet ejecting device was employed as the ink-jet ejecting device. As for the optical detecting system, the vertical reflection type was used.

In this example, information associated with a droplet is detected according to the method of the invention, and the ejecting operation is controlled on the basis of the detected information, as will be described in detail below.

In this example, the amount of a droplet is controlled by controlling the number of times of ejecting operations while the amount of a droplet in each ejecting operation is maintained to a fixed value. In the piezoelectric ink-jet device, the amount of a droplet ejected in each operation is controlled by controlling the height and the width of a voltage pulse applied to the piezoelectric element for ejecting a droplet. In this specific example, the amount of a droplet ejected through the ejecting nozzle in each ejecting operation is set to 10 ng so that a droplet of 100 ng in total amount is obtained by 10 ejecting operations.

The displacement control mechanism is driven on the basis of preset coordinate information so that the end of the ejection nozzle comes to a location at a height of 5 mm above the center of a gap between electrodes in a unit cell. Then, an ejecting operation is started according to the given driving conditions. At the same time, the optical detecting system starts detecting droplet information at the center of a gap between device electrodes.

Figure 24:
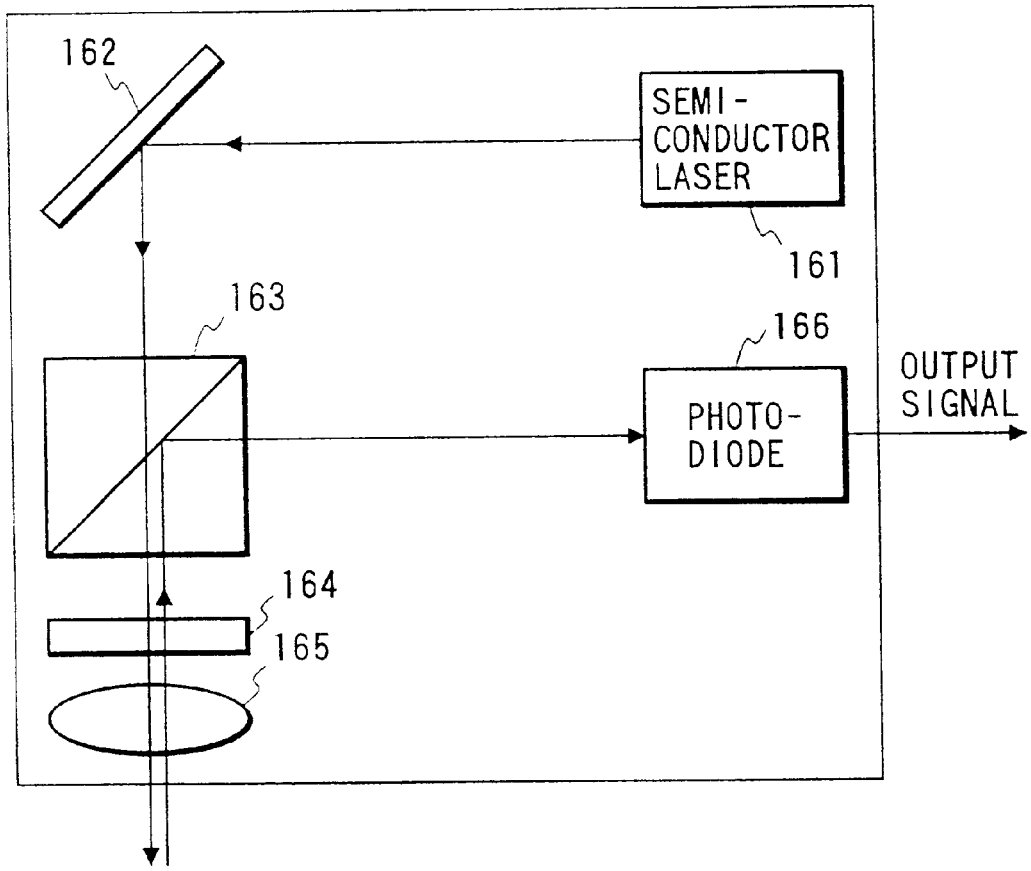
FIG. 24 is a schematic diagram illustrating an example of an optical detecting system of the vertical reflection type used in a production apparatus according to the present invention.

FIG. 24 illustrates a detail of optical detecting system of the vertical reflection type. Linearly polarized light is emitted by a semiconductor laser 161. The light is reflected by a mirror 162, and then passes through a beam splitter 163, a ¼λ plate 164, and a focusing lens 165. Finally, the light is incident on a droplet at a right angle. After passing through the droplet, a part of the light is reflected at the surface of the substrate, and travels backward. The reflected light passes again through the droplet and is incident on the ¼λ plate 164. As a result of the second passage through the ¼λ plate 164, the reflected light becomes linearly polarized light whose polarization direction is shifted by 90° relative to that of the incident light. The reflected light is further reflected by the beam splitter 163 into a direction perpendicular to the previous path so that the light is incident on a photo detector 166 such as a photodiode. The intensity of the reflected light is modulated by scattering and absorption during the two times of passage through a droplet. Therefore, it is possible to determine the thickness of the droplet from the intensity of the reflected light.

The output of the photodiode is amplified by an optical information detecting circuit 1504 and then sent to a comparator 1505. The comparator 1505 compares the input signal with a reference value and outputs a difference signal. The reference value is set to a value determined experimentally so that the film thickness becomes 20 nm after baked. The intensity of the reflected light decreases as the thickness of the droplet increases, and thus difference signal defined as "(detection signal)−(reference signal)" decreases as the thickness of the droplet increases toward the optimum value. The difference signal becomes zero when the droplet thickness reaches the optimum value. If the droplet thickness increases further exceeding the optimum value, the difference signal has a negative value. The difference signal output by the comparator 1505 is applied to an ejection condition correcting circuit 1506. The ejection condition correcting circuit 1506 outputs a HI-level signal when the difference signal has a positive value, while a LOW-level signal is output when the difference signal has a negative value. The output of the ejection condition correcting circuit 1506 is applied to an ejection condition controlling circuit 1507. The ejection condition controlling circuit 1507 performs an ejecting operation under fixed conditions at fixed time intervals as long as the output signal of the ejection condition correcting circuit 1506 is maintained at a HI level. If the output of the ejection condition correcting circuit 1506 goes to a LOW level, the ejection condition controlling circuit 1507 stops the ejecting operation.

After depositing the droplet, the 10×10 matrix-electrode substrate was baked at 350° C. for 30 min so that the droplet became a thin film consisting of PdO particles. The resistance between the device electrodes was measured. A normal resistance around 3 kΩ was observed even in those cells which needed an unusual number of times of ejecting operations. A forming process was then performed by applying a forming voltage across the device electrodes from unit cell to unit cell thereby forming an electron emission region at the center of a gap between device electrodes of each unit cell.

The electron source substrate obtained in the above-described manner was set in the electron emission characteristic measuring system shown in FIG. 5, and electron emission performance was evaluated. All of 100 devices showed uniform electron emission performance. Furthermore, a greater number of cells were formed on a large-sized substrate (such as that shown in FIG. 12), and a droplet was deposited on each unit cell, in a manner similar to that in the case of the substrate having 10×10 cells, using the ejection control system shown in FIG. 23, the piezoelectric ink-jet ejecting device, and the optical detecting system of the vertical reflection type. A baking process was then performed at 350° C. for 30 min. Thus, a thin film consisting of PdO particles was formed in all unit cells. The resistance between the device electrodes was measured. A normal resistance around 3 kΩ was observed even in those unit cells which needed an unusual number of times of ejecting operations. A forming process was then performed by applying a forming voltage across the device electrodes from cell to cell thereby forming an electron emission region at the center of a gap between device electrodes of each cell.

Using the electron source substrate obtained in the above-described manner, an envelope 1088 was formed with a face plate 1086, a supporting frame 1082, and rear plate 1081, in the manner described above in connection with FIG. 7. Then the envelope 1088 was sealed. Thus a display panel was obtained. Furthermore, an image-forming apparatus provided with a driving circuit was produced. All devices, including those which needed an unusual number of times of ejecting operations, showed uniform characteristics. Thus, the resultant image-forming apparatus showed good performance in displaying a TV image with a small variation in brightness.

In the present invention, as described above, even in the case where deposition of a droplet needs an unusual number of ejecting operations due to some unusual condition in the ejection nozzle, wettability of a substrate, droplet arrival location, etc., a thin film can be formed in a gap between device electrodes uniformly in the composition, homology, and thickness. This indicates that the ejecting operation can be controlled effectively according to the present invention.

Example 15

In Example 14 described above, the ejecting operation is controlled by controlling the number of times of ejecting operations. Instead, in this example, either the height or the width of the ejection driving pulse is controlled. In the piezoelectric ink-jet device, as described above, the amount of a droplet ejected in each ejecting operation is determined by the height and the width of a voltage pulse applied to the piezoelectric element for ejecting a droplet. Therefore, it is possible to control the amount of a droplet to a desired value by controlling at least either the height or the width of the driving pulse on the basis of the information associated with the droplet. In this example, the number of ejecting operations is fixed to two, wherein the standard amount of a droplet ejected in one ejecting operation is set to 50 ng, and thus a droplet having a total amount of 100 ng is produced by two ejecting operations.

In this example, information associated with a droplet is detected, and the ejecting operation is controlled on the basis of the detected information, as will be described in detail below with reference to FIG. 24. Except the method of controlling the ejecting operation, the other parts of this example are the same as those in Example 14. As for the optical detecting system 1602, the vertical reflection type is employed as in Example 14. The displacement control mechanism 1603 is driven on the basis of preset coordinate information so that the end of the ejection nozzle 1601 comes to a location at a height of 5 mm above the center of a gap between electrodes 2 and 3 in a unit cell. Then, a first ejecting operation is performed according to the 50-ng driving conditions given previously. Then, information associated with a droplet at the center of a gap between device electrodes is detected with the optical detecting system.

A signal including the information associated with the droplet ejected in the first ejecting operation is output by the photodiode and amplified by an optical information detecting circuit 1604 and then sent to a comparator 1605. The comparator 1605 compares the received signal with a reference value and outputs a difference signal. The reference value is determined experimentally so that the reference value corresponds to the intensity of the light reflected from a correct amount of droplet deposited in a first ejecting operation so that, after a second droplet is further deposited, the total amount of the deposited droplet has a thickness of 20 nm when measured after baked. The intensity of the reflected light decreases as the thickness of the droplet increases, and thus difference signal defined as "(detection signal)−(reference signal)" changes as a function of the deviation of the droplet thickness from an optimum value. The difference signal output by the comparator 1605 is applied to an ejection condition correcting circuit 1606. Correction signal data is experimentally determined on the basis of the relationship between the difference signal and the deviation in the droplet amount and stored in the ejection condition correcting circuit 1606. On the basis of this data, the ejection condition correcting circuit 1606 calculates a correction signal corresponding to the difference signal and outputs the resultant correction signal to an ejection condition controlling circuit 1607. The ejection condition controlling circuit 1607 corrects the height or the width of the driving pulse on the basis of the correction signal received from the ejection condition correcting circuit 1606, and performs a second ejecting operation.

After completion of depositing the droplet, the 10×10 matrix-electrode substrate was baked at 350° C. for 30 min so that the droplet became a thin film consisting of PdO particles. The resistance between the device electrodes was measured. A normal resistance around 3 kΩ was observed even in those cells which showed an unusual operation in the first ejecting operation. A forming process was then performed by applying a forming voltage across the device electrodes from unit cell to unit cell thereby forming an electron emission region at the center of a gap between device electrodes of each unit cell.

The electron source substrate obtained in the above-described manner was set in the electron emission characteristic measuring system shown in FIG. 5, and electron emission performance was evaluated. All of 100 devices showed uniform electron emission performance.

Furthermore, a greater number of unit cells were formed on a large-sized substrate (such as that shown in FIG. 12), and a droplet was deposited on each cell, in a manner similar to that in the case for the substrate having 10×10 cells, according to the ejection control method shown in FIG. 24, using a piezoelectric ink-jet ejecting device. A baking process was then performed at 350° C. for 30 min. Thus, a thin film consisting of PdO particles was formed in all cells. The resistance between the device electrodes was measured. A normal resistance around 3 kΩ was observed even in those cells which showed an unusual operation in the first ejecting operation. A forming process was then performed by applying a forming voltage across the device electrodes from cell to cell thereby forming an electron emission region at the center of a gap between device electrodes of each unit cell.

Using the electron source substrate obtained in the above-described manner, an envelope 1088 was formed with a face plate 1086, a supporting frame 1082, and rear plate 1081, in the manner described above in connection with FIG. 7. Then the envelope 1088 was sealed. Thus a display panel was obtained. Furthermore, an image-forming apparatus provided with a driving circuit capable of displaying a television image according to an NTSC television signal, such as that shown in FIG. 9, was produced. All devices, including those which needed an unusual number of times of ejecting operations, showed uniform characteristics. Thus, the resultant image-forming apparatus showed good performance in displaying a TV image with a small variation in brightness.

In the present invention, as described above, even in the case where deposition of a droplet needs an unusual number of ejecting operations in a first ejecting operation due to some unusual condition in the ejection nozzle, wettability of a substrate, droplet arrival location, etc., a thin film can be formed in a gap between device electrodes uniformly in the composition, homology, and thickness.

Example 16

In Examples 14 and 15 described above, an optical detecting system is employed as the means of detecting information associated with a droplet. Instead, in this example, an electrical detecting system is employed. Except the detection method, the other parts of this example are the same as those in Example 7.

Figure 25:
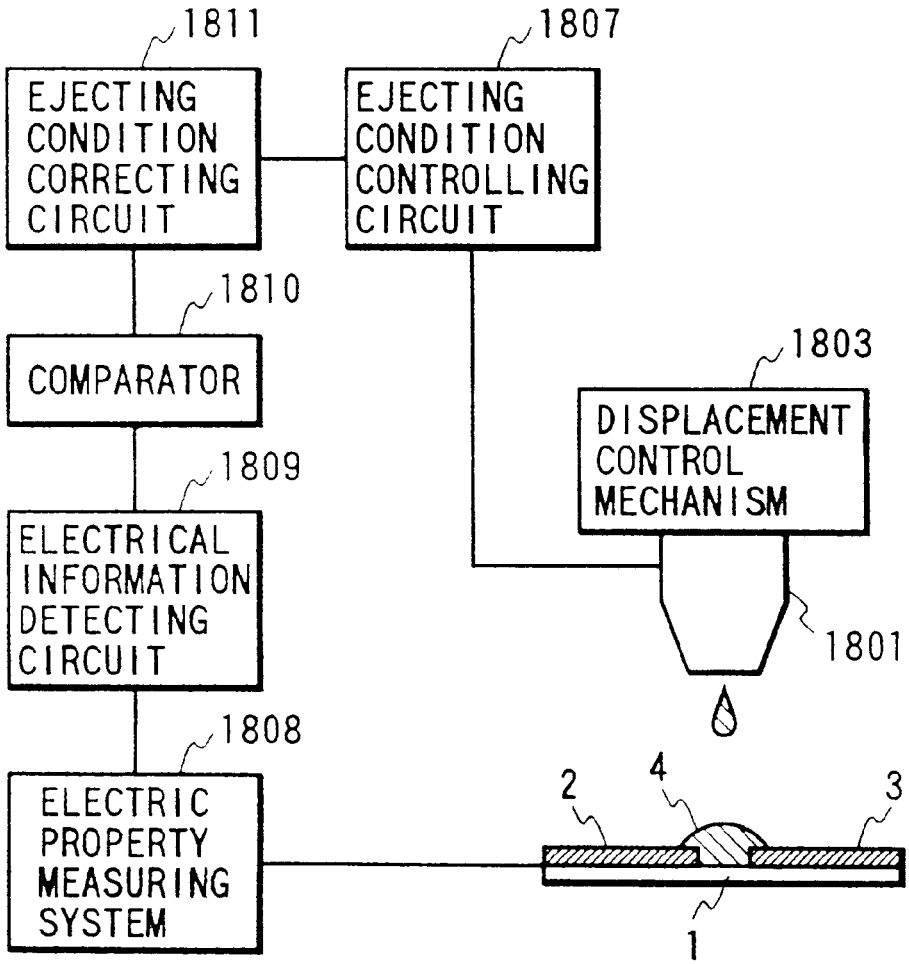
FIG. 25 is a block diagram illustrating an example of an ejecting operation control system used in a production apparatus according to the present invention.

Referring to FIG. 25, the method of forming a thin film using an ink-jet ejecting system according to the invention will be described in detail below. In this figure, reference numeral 1 denotes a substrate on which a unit cell is formed. Reference numerals 2 and 3 denote opposing device electrodes. Reference numeral 1801 denotes an ejection nozzle of the ink-jet ejecting device, and 1808 denotes an electric system for detecting an electrical property of a droplet. Reference numeral 1803 denotes a displacement control mechanism on which there is mounted an ink-jet cartridge comprising the ejection nozzle, an ink tank, and a supplying system. The displacement control mechanism 1503 includes: a coarse adjustment mechanism responsible for movement from a unit cell to another cell on a matrix-shaped interconnection substrate; and a fine adjustment mechanism responsible for horizontal positioning within a unit cell and for adjustment of distance between the substrate and the ejection nozzle. In this example, a bubble-jet ejecting device is employed as the ink-jet ejecting device.

In this example, information associated with a droplet is detected, and the ejecting operation is controlled on the basis of the detected information, as will be described in detail below. In this example, as in Example 14, the amount of a droplet is controlled by controlling the number of times of ejecting operations while the amount of a droplet in each ejecting operation is maintained to a fixed value. In this specific example, a droplet of 100 ng is formed by 10 ejecting operations.

The displacement control mechanism 1803 is driven on the basis of preset coordinate information so that the end of the ejection nozzle comes to a location at a height of 5 mm above the center of a gap between electrodes 2 and 3 in a unit cell. Then, an ejecting operation is started according to the given driving conditions. At the same time, the electric measuring system 1808 starts detecting droplet information at the center of a gap between device electrodes.

The electric measuring system 1808 detects electrical properties of a droplet by measuring a current which flows in response to a voltage applied across device electrodes 2 and 3. Electrical properties to be detected include resistance of a droplet, capacitance of a droplet, etc. The amount of a droplet in a gap between device electrodes can be estimated on the basis of the relationship between the amount of a droplet and the electric properties. Although a DC voltage may be employed as the applied voltage for detection, an AC voltage having a relatively small amplitude in the range from 10 mV to 500 mV at a relatively large frequency in the range from 100 Hz to 100 kHz is more preferable to suppress a chemical reaction such as generation of gas in a solution. The AC voltage is phase-detected thereby extracting a current component having the same phase as that in the applied voltage and a current component having a phase delayed by amount of 90°. This technique allows simultaneous detection of both the resistance and capacitance of a droplet. In this specific example, only the resistance of a droplet is detected. The type of ink is not limited to a special one as long as it is possible to measure its resistance. In this example, an aqueous solution containing organic palladium (Pd concentration of 0.5 wt %) exhibiting good ionic conduction is employed.

The current signal output by the electric measuring system 1808 is applied to an electric information detecting circuit 1809. In the electric information detecting circuit 1809, the received current signal is converted into a voltage form and amplified. Furthermore, the signal is phase-detected with a lock-in amplifier. Then the resistance is calculated and the result is sent to a comparator 1810. The comparator 1810 compares the received signal with a reference value and outputs a difference signal. The reference value is experimentally determined so that the reference value corresponds to a resistance which will result in a final film thickness of 20 nm after baked. In the case of the aqueous solution containing organic palladium (Pd concentration of 0.5 wt %), the reference value is set to 70 kΩ. The resistance decreases as the thickness of the droplet increases, and thus difference signal defined as "(detection signal)−(reference signal)" decreases as the thickness of the droplet increases toward the optimum value. The difference signal becomes zero when the droplet thickness reaches the optimum value. If the droplet thickness increases further exceeding the optimum value, the difference signal has a negative value. The difference signal output by the comparator 1810 is applied to an ejection condition correcting circuit 1811. The ejection condition correcting circuit 1811 outputs a HI-level signal when the difference signal has a positive value, while a LOW-level signal is output when the difference signal has a negative value. The output of the ejection condition correcting circuit 1811 is applied to an ejection condition controlling circuit 1807. The ejection condition controlling circuit 1807 performs an ejecting operation under fixed conditions at fixed time intervals as long as the output signal of the ejection condition correcting circuit 1811 is maintained at a HI level. If the output of the ejection condition correcting circuit 1811 goes to a LOW level, the ejection condition controlling circuit 1807 stops the ejecting operation.

The electron source substrate obtained in the above-described manner was set in the electron emission characteristic measuring system shown in FIG. 5, and electron emission performance was evaluated. All of 100 devices showed uniform electron emission performance.

Furthermore, a greater number of cells were formed on a large-sized substrate (such as that shown in FIG. 12), and a droplet was deposited on each unit cell, in a manner similar to that in the case of the substrate having 10×10 cells, using the ejection control system shown in FIG. 23, the piezoelectric ink-jet ejecting device, and the optical detecting system of the vertical reflection type. A baking process was then performed at 350° C. for 30 min. Thus, a thin film consisting of PdO particles was formed in all cells. The resistance between the device electrodes was measured. A normal resistance around 3 kΩ was observed even in those cells which needed an unusual number of times of ejecting operations. A forming process was then performed by applying a forming voltage across the device electrodes from cell to cell thereby forming an electron emission region at the center of a gap between device electrodes of each cell.

In the present invention, as described above, even in the case where deposition of a droplet needs an unusual number of ejecting operations due to some unusual condition in the ejection nozzle, wettability of a substrate, droplet arrival location, etc., a thin film can be formed in a gap between device electrodes uniformly in the composition, morphology, and thickness. This indicates that the ejecting operation can be controlled effectively according to the present invention.

Example 17

Figure 26:
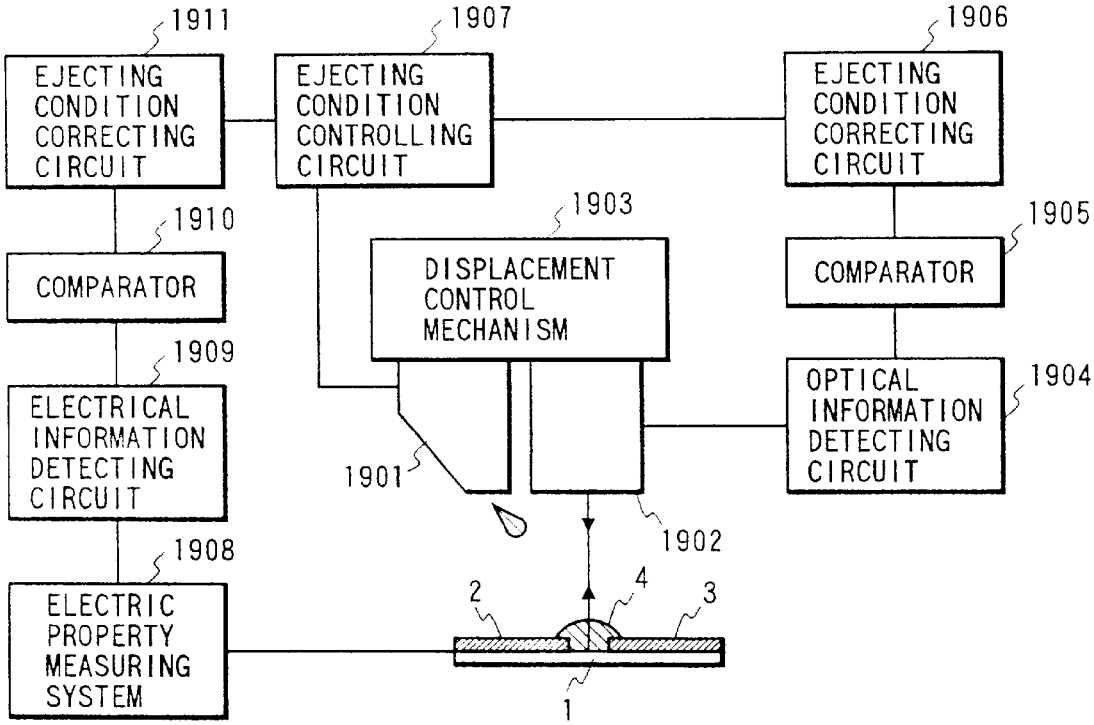
FIG. 26 is a block diagram illustrating another example of an ejecting operation control system used in a production apparatus according to the present invention.

FIG. 26 is a block diagram of a system for controlling the ejection conditions while the system includes two separate detection systems, an electric detection system and an optical detecting system. In this system, although a detailed description is not given here, an error is compensated on the basis of information obtained via the two detection systems and thus more accurate control of the ejection operation is possible according to hybrid information.

Example 18

In this example, there is provided a droplet amount correcting system including a removal nozzle. There are two techniques of correcting the amount of a droplet using a removal nozzle. One technique is to remove a part of a droplet so that the remaining amount becomes optimum when the detected droplet information indicates that the amount of the droplet present in a gap is greater than the optimum value. Another technique is to remove the entire droplet once and then eject another droplet. The removal of a droplet may be performed either by sucking the droplet or by ejecting a gas such as nitrogen thereby blowing away the droplet from a gap. In this specific example, the entire droplet is removed by sucking the droplet with a removal nozzle.

Furthermore, in this example, information associated with a droplet is detected, and the ejecting operation is controlled on the basis of the detected information, as will be described in detail below with reference to FIG. 27. Except the removal nozzle, the other parts of this example are the same as those in Example 14. The removal nozzle 2012 is mounted on the same position control mechanism 2003 as that on which an ejection nozzle and an optical detecting system are mounted, without having an additional position control mechanism dedicated for the removal nozzle. In this example, the standard amount of a droplet ejected at a time via the ejection nozzle is set to 100 ng, and thus a 100 ng droplet is deposited by one ejecting operation.

The displacement control mechanism 2103 is driven on the basis of preset coordinate information so that the end of the ejection nozzle 2001 comes to a location at a height of 5 mm above the center of a gap between electrodes 2 and 3 in a unit cell. An ejecting operation is then performed according to the given driving conditions. Then, information associated with a droplet at the center of a gap between device electrodes is detected with the optical detecting system 2002.

A signal including the information associated with the droplet is output by a photodiode and amplified by an optical information detecting circuit 2004 and then sent to a comparator 2005. The comparator 2005 compares the received signal with a reference value and outputs a difference signal. The reference value is experimentally determined so that the reference value corresponds to the intensity of reflected light which will result in a final film thickness of 20 nm after baked. The intensity of the reflected light decreases as the thickness of the droplet increases, and thus difference signal defined as "(detection signal)−(reference signal)" changes as a function of the deviation of the droplet thickness from an optimum value. Therefore, the difference signal decreases as the thickness of the droplet increases toward the optimum value, and the difference signal becomes zero when the droplet thickness reaches the optimum value. If the droplet thickness increases further exceeding the optimum value, the difference signal has a negative value. The difference signal output by the comparator 2005 is applied to an ejection condition correcting circuit 2006. The ejection condition correcting circuit 2006 outputs a LOW-level signal when the difference signal has a positive value, while a HI-level signal is output when the difference signal has a negative value. The output of the ejection condition correcting circuit 2006 is applied to a removal nozzle control circuit 2013. On the basis of correction signal data which represents the relationship between the difference signal and the deviation in the droplet amount from the optimum value, the ejection condition correcting circuit 2006 calculates a correction signal corresponding to the difference signal and outputs the resultant correction signal to an ejection condition controlling circuit 2007. When the output signal is at a HI level, the removal nozzle control circuit 2013 does not perform any operation. In this case, during an ejecting operation, the ejection condition controlling circuit 2007 controls the height or the width of the driving pulse in response to the correction signal. On the other hand, in the case where a LOW-level signal is output, the removal nozzle control circuit 2013 operates first so as to remove the entire amount of a droplet by sucking it with the removal nozzle 2012, then an ejecting operation is performed under the control of the ejection condition controlling circuit 2007.

Figure 28A:
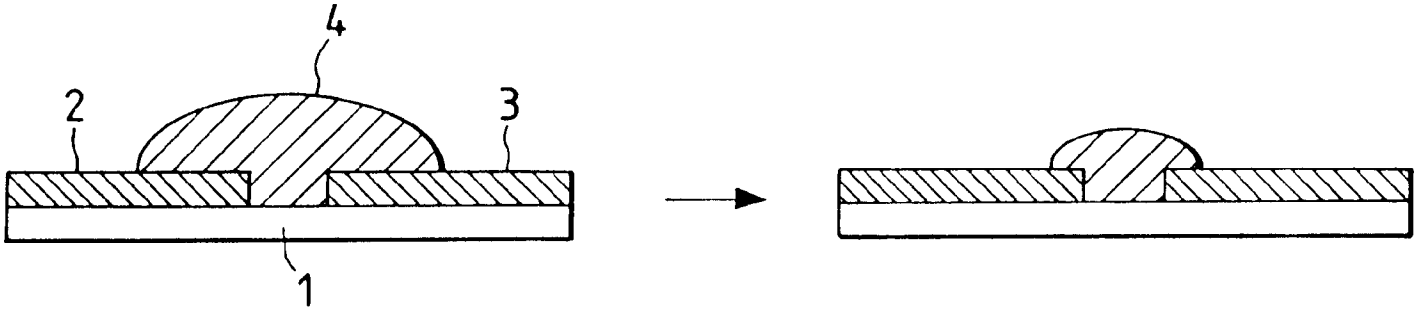
FIGS. 28A and 28B are schematic representations of a process of correcting an abnormal cell with a removal nozzle used in a production apparatus according to the present invention.
Figure 28B:
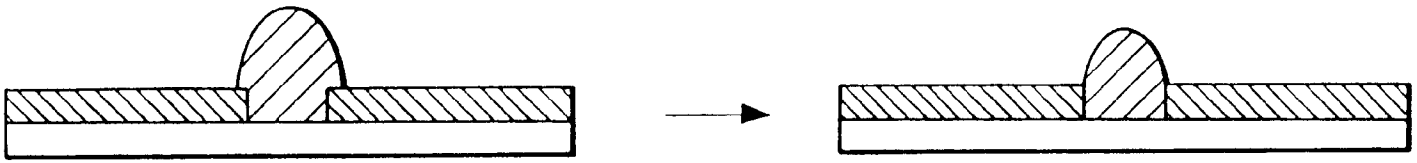

A droplet was deposited on each of 100 unit cells on a 10×10 matrix-electrode substrate according to the technique described above. In almost all cells, the thickness of the droplet obtained after the first ejecting operation was in an allowable range. In a few percent of unit cells, however, the thickness was greater than the upper acceptable limit. In the example shown in FIG. 28A, an extremely great amount of droplet was ejected in one ejecting operation and thus the droplet thickness became greater than the acceptable upper limit. In this case, the entire droplet was sucked via the removal nozzle, and the another droplet was ejected under corrected conditions. As a result of the re-ejection, a droplet having a thickness within the allowable range was deposited as shown on the right side of FIG. 28A. In the example shown in FIG. 28B, the wettability of the substrate used was unusually low, and the droplet thickness became greater than the acceptable upper limit although the ejected amount was proper. Also in this case, re-ejection was performed in a manner similar to that in the case of FIG. 28A, and the resultant thickness fell within the allowable range.

After completion of depositing the droplet, the 10×10 matrix-electrode substrate was baked at 350° C. for 30 min. Thus, a thin film consisting of PdO particles was obtained. The resistance between the device electrodes was measured. A normal resistance around 3 kΩ was observed even in those cells which showed an unusual operation in the first ejecting operation. A forming process was then performed by applying a forming voltage across the device electrodes from unit cell to unit cell thereby forming an electron emission region at the center of a gap between device electrodes of each cell.

The electron source substrate obtained in the above-described manner was set in the electron emission characteristic measuring system shown in FIG. 5, and electron emission performance was evaluated. All of 100 devices showed uniform electron emission performance.

Figure 27:
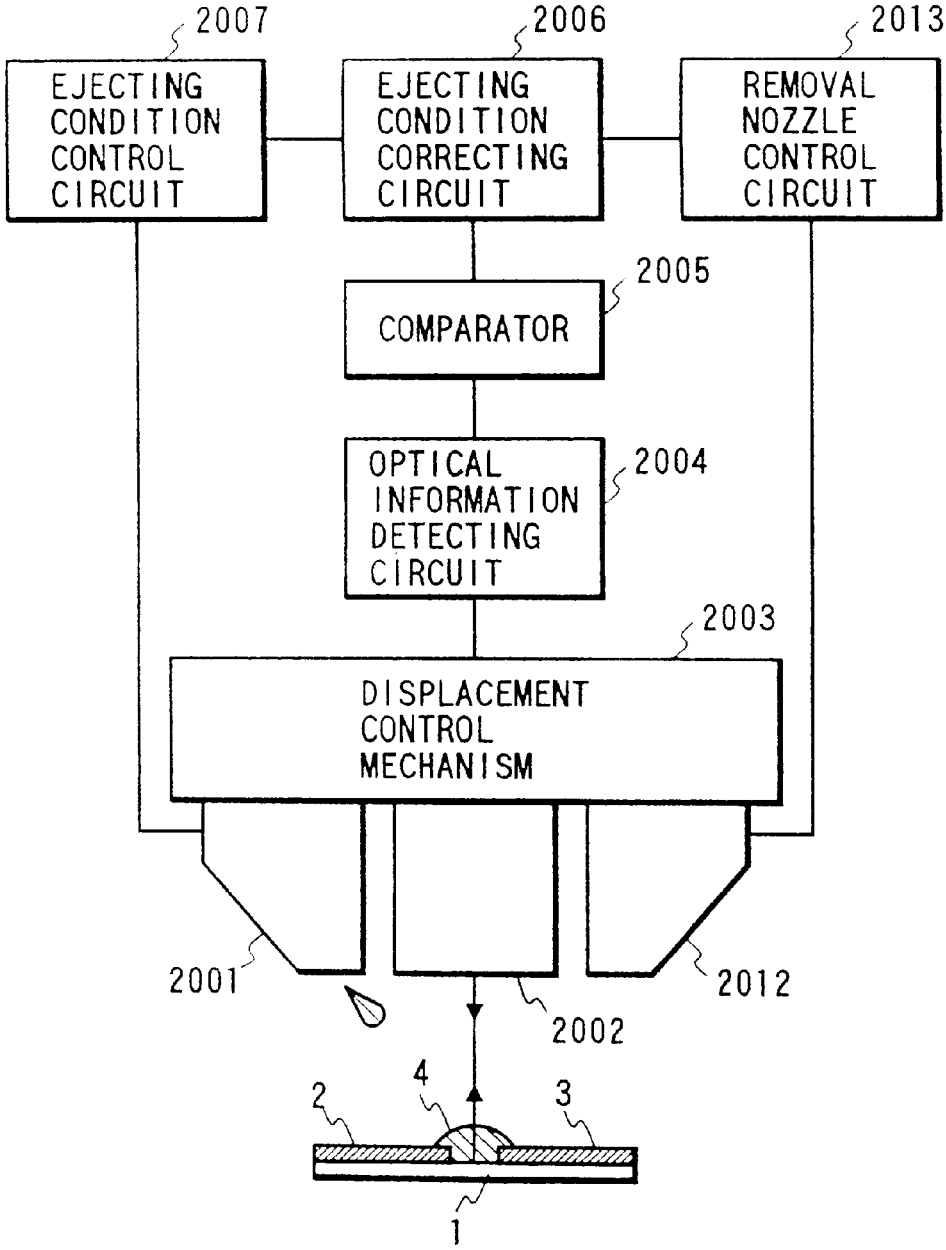
FIG. 27 is a block diagram illustrating still another example of an ejecting operation control system used in a production apparatus according to the present invention.

Furthermore, a greater number of cells were formed on a large-sized substrate (such as that shown in FIG. 12), and a droplet was deposited on each cell, in a manner similar to that in the case of the substrate having 10×10 unit cells, using the ejection control system including the removal nozzle shown in FIG. 27, and the piezoelectric ink-jet ejecting device. A baking process was then performed at 350° C. for 30 min. Thus, a thin film consisting of PdO particles was formed in all unit cells. The resistance between the device electrodes was measured. A normal resistance around 3 kΩ was observed even in those cells which needed an unusual number of times of ejecting operations. A forming process was then performed by applying a forming voltage across the device electrodes from unit cell to unit cell thereby forming an electron emission region at the center of a gap between device electrodes of each cell.

Using the electron source substrate obtained in the above-described manner, an envelope 1088 was formed with a face plate 1086, a supporting frame 1082, and rear plate 1081, in the manner described above in connection with FIG. 7. Then the envelope 1088 was sealed. Thus a display panel was obtained. Furthermore, an image-forming apparatus provided with a driving circuit was produced. All devices, including those which needed an unusual number of times of ejecting operations, showed uniform characteristics. Thus, the resultant image-forming apparatus showed good performance in displaying a TV image with a small variation in brightness.

In the present invention, as described above, even in the case where deposition of a droplet needs an unusual number of ejecting operations in a first ejecting operation due to some unusual condition in the ejection nozzle, wettability of a substrate, droplet arrival location, etc., a thin film can be formed in a gap between device electrodes uniformly in the composition, morphology, and thickness.

Example 19

In this example, in addition to the means of controlling the ejection operation on the basis of the information of a droplet, there are also provided means of optically detecting the droplet arrival position and means of adjusting the ejection position on the basis of the information of the droplet arrival position.

Figure 29:
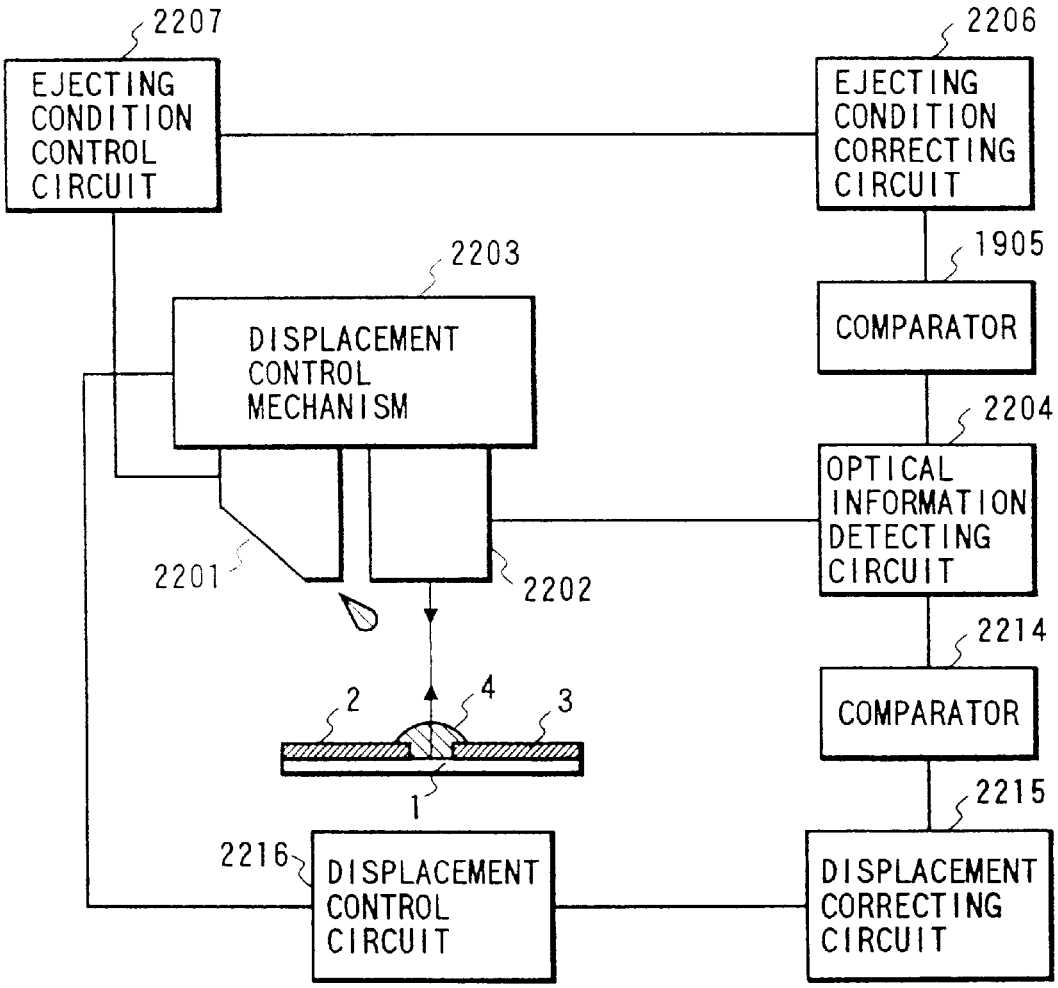
FIG. 29 is a block diagram illustrating another example of an ejecting operation control system used in a production apparatus according to the present invention.

FIG. 29 is a block diagram illustrating the system of detecting the information of a droplet and controlling the ejecting position on the basis of the information of the droplet. Except the optical detecting system, the other parts of this example are the same as those in Example 14. Since the control of the ejecting operation has been described in detail above in connection with the previous examples, only the control of the positioning operation will be described herein below.

The optical detecting system 2202 used in this example is of a vertical reflection type similar to that used in Example 14. However, unlike the system in Example 14, the optical detecting system 2202 uses two beams, that is, a beam for detecting information of a droplet, and a sub-beam for detecting the position. This multi-beam type optical system is similar to an optical detecting system which is broadly used to achieve a tracking operation in a compact disk system. A light beam emitted by a semiconductor laser is divided by a diffraction grating into three beams aligned in one line. These three beams are reflected and modulated at different locations, and detected by separate sensors. From the relationship among the intensities of these reflected light beams, the information of the position is detected.

The detection and the control of the position may be performed either for an electrode pattern or a dedicated alignment mark before ejecting a droplet, or for a deposited droplet after completion of an ejecting operation. The droplet arrival position may be detected either by comparing the intensities of the three reflected beams with each other after an ejecting operation, or by comparing the intensities of the three reflected beams before an ejecting operation with those after the ejecting operation. The control of the ejecting position may be either in a manner that a preliminary ejection is performed first, and then an actual ejection is performed at a position corrected on the basis of the result of the preliminary ejection or in a manner that a position is detected and a corresponding correction is performed for each ejecting operation.

Figure 30:
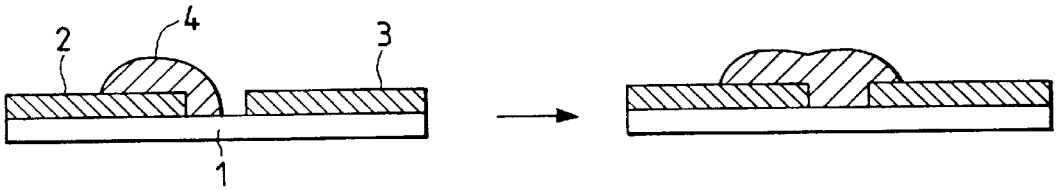
FIG. 30 is a schematic representation of a process of correcting an abnormal cell with a complex system including a displacement correction/ejecting control system.

FIG. 30 illustrates an example of a manner in which the droplet position is controlled. After a first ejecting operation, the intensities of the three beams aligned in a line perpendicular to a gap between device electrodes are detected and compared with each other. From the comparison result, the deviation of the droplet arrival position from the center of the gap between the device electrodes is determined. In response to a correction signal representing the amount of the deviation, the displacement control mechanism 2203 (FIG. 29) corrects the ejecting position so that a droplet is ejected at a correct position in a next ejecting operation and also operations further following that.

Example 20

Figure 31B:
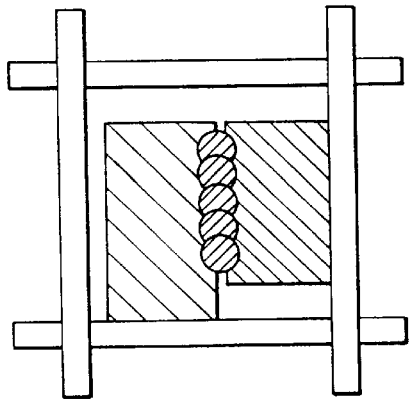
Figure 31C:
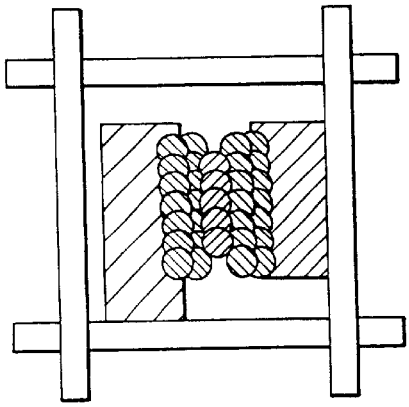

In Examples 14 to 19 described above, one droplet is ejected at a fixed position thereby forming a thin film in an electron emission region. However, the present invention is not limited to that, and various modifications are possible. FIGS. 31A to 31C illustrate some examples of possible device structures, wherein FIG. 31A illustrates the device structure employed in Examples 14 to 19, FIG. 31B illustrates a device structure which is formed by ejecting a plurality of droplets at different positions, and FIG. 31C illustrates a device structure which is formed by ejecting a plurality of droplets so that not only the thin film in the electron emission region but also a part of each device electrode are formed of the plurality of droplets. In any device structure, the techniques of controlling the ejecting operation and the techniques of controlling the ejecting position used in Examples 14 to 19 described above may be employed.

Furthermore, in Examples 14 to 19, wires are formed in a matrix fashion. However, the invention is not limited to that. The wires may also be formed in other shapes such as a ladder shape.

Example 21

Figure 33A:
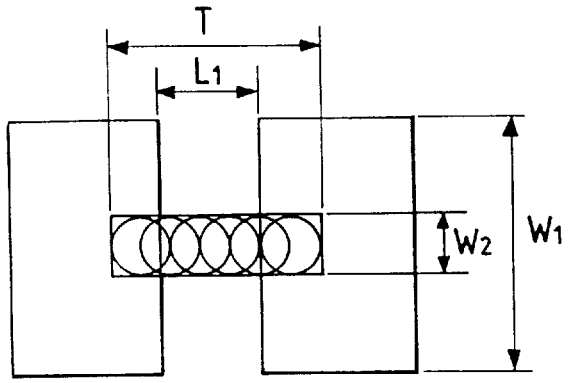
FIGS. 33A to 33D are schematic diagrams illustrating examples of pad patterns used in a production method according to the present invention.
Figure 33B:
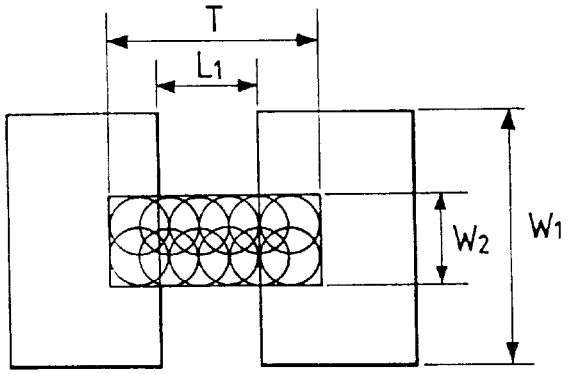
Figure 33C:
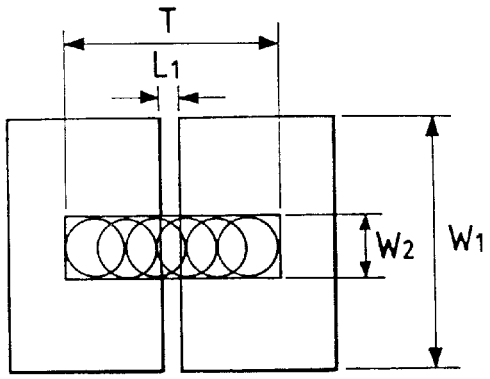
Figure 33D:
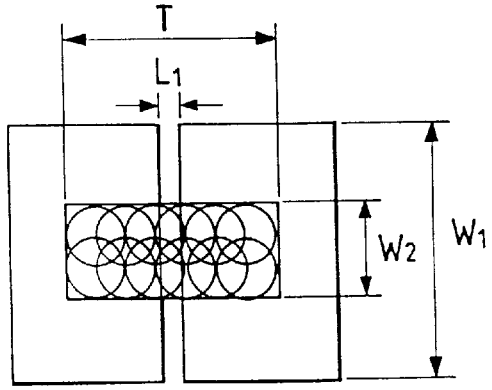

A substrate having device electrodes connected via matrix-shaped wires was prepared, and surface conduction type electron-emitting devices were produced thereon as described below. FIG. 33A is a plan view of the surface conduction electron-emitting device obtained. Referring to FIGS. 32A and 32B and 33A to 33D, the production process will be described in detail below.

(1) A quartz substrate was employed as an insulating substrate. The quartz substrate was cleaned well with an organic solvent. Then the substrate was dried at 120° C.

(2) Using an ink-jet ejecting device provided with a piezoelectric device serving as the droplet supplying mechanism, droplets of a solution containing organic palladium (ccp-4230, available from Okuno-Seiyaku Co., Ltd.) were deposited on the above cleaned substrate. The measured diameter of the obtained dots was 50 $\mu$m (FIG. 32A).

(3) Then, electrodes 2 and 3 of Ni were formed on the substrate 1 using an evaporation technique and a photolithography technique so that the gap length L1 between the device electrodes was 200 $\mu$m, the width W1 of the electrodes was 600 $\mu$m, and the thickness of the electrodes was 1000 Å.

(4) Droplets of a solution containing organic palladium (ccp-4230, available from Okuno-Seiyaku Co., Ltd.) described above were deposited between the device electrodes 2 and 3 as shown in FIG. 33A, using the ink-jet ejecting device provided with the piezo-electric device serving as the droplet supplying mechanism, wherein the ejecting operation was controlled so that the diameter of the resultant dots became 50 μm. Eleven dots having a diameter of 50 μm described in (2) were formed in the gap of 200 μm so that the center-to-center distance P1 between adjacent dots was 25 μm and thus each dot overlaps adjacent dots at either sides by an amount of 25 μm. The overlapping areas expanded after the dots were deposited. As a result, each edge along the length changed into a straight line. Thus, a line of dots (pad) having a width W2 of 50 μm and a length T of 300 μm was obtained.

(5) Then, heat treatment was performed at 300° C. for 10 min so that a particle film consisting of palladium oxide (PdO) particles was formed. Thus, a thin film 4 was obtained.

(6) A voltage was applied across the electrodes 2 and 3 so that the thin film 4 was subjected to a forming process (energization forming process) thereby producing an electron emission region 5.

In the electron source substrate obtained in the above-described manner, since the pad was formed of dots overlapping each other, the width W2 of the pad came to have a constant value along the length of the pad. Furthermore, the variation in the thickness was small and thus the variation in resistance was also small.

In this technique, a pad consisting of a PdO particle film can be formed in a gap between device electrodes with a margin of a few ten μm in both vertical and horizontal directions. Therefore, no difficult alignment process is required. This allows a reduction of defects due to an alignment error.

It is not necessary that dots be deposited successively from a dot to an adjacent dot from left to right or in the opposite direction, and dots may be deposited in an arbitrary order. For example, dots may be deposited at every other dot locations first, and then a dot may be further deposited in each space.

Furthermore, each dot was formed by ejecting two droplets instead of one droplet. In this case, the film thickness became about twice and the resistance became about half. This means that it is possible to control the resistance of the thin conductive film by changing the number of droplets ejected.

Furthermore, each dot was formed by ejecting a twice amount of droplet. The result was similar to that obtained with two droplets each having the original amount. This means that it is also possible to form a thin conductive film having an arbitrary resistance by controlling the amount of a droplet.

In the technique described in this example, it is possible to produce a plurality of devices with small variations in characteristics from device to device, and thus it is possible to improve the production yield. Furthermore, since no patterning process is required to form a thin film 4, the production cost can be reduced.

Using the electron source substrate having matrix-shaped wires obtained in the above-described manner, an envelope was formed with a face plate, a supporting frame, and rear plate. Then the envelope was sealed. Thus a display panel was obtained. Furthermore, an image-forming apparatus provided with a driving circuit capable of displaying a television image was produced. The resultant image-forming apparatus had only a small number of defects, and showed good performance in displaying a TV image with a small variation in brightness.

Example 22

Device electrodes were formed in a ladder form on a substrate so that the width W1 of the device electrodes was 600 μmm the gap length L1 between the device electrodes was 200 μm, and the thickness d of the device electrodes was 1000 Å. Then, surface conduction type electron-emitting devices were produced on this substrate in a manner similar to that in Example 21. Using the obtained electron source substrate, an envelope was formed with a face plate, a supporting frame, and rear plate. Then the envelope was sealed. Thus, an image-forming apparatus was obtained. The resultant image-forming apparatus showed as good performance as in Example 21.

Example 23

As in Example 21, device electrodes were formed on a substrate so that the width W1 of the device electrodes was 600 μmm the gap length L1 was 200 μm, and the thickness d of the device electrodes was 1000 Å. Then, droplets of a solution containing organic palladium were deposited on the above substrate using an ink-jet ejecting device similar to that used in Example 21. In this example, the droplets were deposited so that the shape of a pad became such as that shown in FIG. 35A2. Two lines of dots each including eleven dots having a diameter (ϕ) of 50 μm such as that described in (2) of Example 21 were formed in the gap of 200 μm so that the center-to-center distances P1 and P2 between adjacent dots were 25 μm (ϕ/2) and thus each dot overlaps adjacent dots at either sides by an amount of 25 μm. As a result, a rectangular pad having a width W2 of 75 μm and a length T of 300 μm was obtained. Electron-emitting devices were formed in the same manner as in Example 21 except that pads were formed into a different shape. The resultant devices showed good characteristics and the variation in characteristics from device to device was as small as in Example 21. In this example, since the pad was formed of two lines of dots, the resultant resistance was half that of a pad formed of one line of dots. This means that it is possible to obtain a desired resistance by changing the number of lines of dots. That is, the width W2 of the pad is determined so as to obtain a desired resistance within the upper limitation equal to the width W1 of the device electrodes, wherein the alignment accuracy should be also taken into account.

Example 24

Using a substrate which is similar to that used in Example 21 except that the gap length between device electrodes was 20 μm, droplets were deposited on the substrate in such a manner as to obtain a pad having a shape such as that shown in FIGS. 35B1 and 35B2. The obtained devices showed as good characteristics as in Example 21, and the variations in characteristics from device to device was small. In this example, since the gap length was as small as 20 μm, the alignment in a direction perpendicular to the gap was easier than Examples 21, 22, and 23. Furthermore, devices having a pad with a shape such as that shown in FIGS. 35C1 and 35C2 were also produced. The obtained devices also showed good characteristics.

Example 25

In this example, instead of the ink-jet ejecting device using a piezo-electric device employed in Examples 21 to 24, a droplet supplying mechanism of the bubble-jet type was employed to produce devices and an image-forming apparatus. The obtained devices and image-forming apparatus showed as good characteristics as in Examples 21 to 24.

Example 26

Figure 40A:
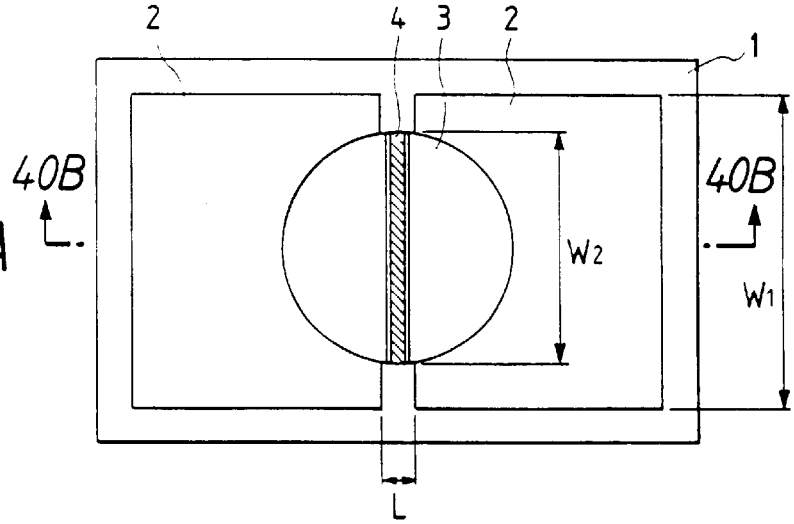
FIGS. 40A and 40B are schematic diagrams illustrating an example of a preparing process of an electron-emitting device of the present invention.
Figure 40B:
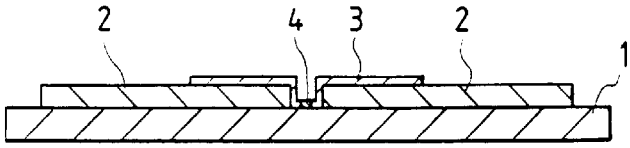

Device electrodes were formed in a matrix form on a substrate by means of photolithography. Then, surface conduction type electron-emitting devices were produced on this substrate, thereby forming an electron source substrate. FIG. 40A is a plan view of a surface conduction type electron-emitting device produced, and FIG. 40B is a cross-sectional view thereof. Referring to FIGS. 40A and 40B, the production process of the surface conduction electron-emitting device will be described below.

Step 1: A quartz substrate was employed as an insulating substrate 1. The quartz substrate was cleaned well with an organic solvent. Then, electrodes 2 and 3 of Ni were formed on the substrate 1 using an evaporation technique and a photolithography technique so that the distance (L1) between the device electrodes was 2 μm, the width (W1) of the device electrodes was 400 μm, and the thickness of the device electrodes was 1000 Å.

Step 2: The substrate on which the device electrodes 2 and 3 were formed was cleaned by means of ultrasonic with purified water. Then the substrate was dried by pulling it up from hot pure water. The hydrophobicity treatment was then performed using HMDS (HMDS was coated on the substrate using a spinner and then the substrate was heated in an oven at 200° C. for 15 min) thereby making the surface of the substrate hydrophobic. Using an ink-jet ejecting device provided with a piezo-electric device, one droplet of an aqueous solution containing a 0.05 wt % palladium acetate was ejected toward a position between the device electrodes 2 and 3 formed on the substrate. After arriving on the substrate, the droplet remained in a limited area without expanding. This resulted in good stability and good reproducibility.

Step 3: Heat treatment was then performed at 300° C. for 10 min so that a particle film (electrically-conductive film 4) consisting of palladium oxide (PdO) particles was formed.

The term "particle film" is used here to refer to a film composed of a plurality of particles, wherein the particles may be dispersed in the film, or otherwise the particles may be disposed so that they are adjacent to each other or they overlap each other (or may be disposed in the form of islands). In this technique, the width (W2) of the obtained thin film is determined as a function of the shape of the droplet deposited on the substrate. As described above, it is possible to good reproducibility in the shape of the droplet, and thus it is possible to obtain a small variation in the width (W2) of the thin film. Furthermore, in this technique, no patterning process is required to form the electrically-conductive thin film 4.

Step 4: A forming process was then performed by applying a voltage across the device electrodes 2 and 3 so that a current was passed through the electrically-conductive thin film 4 thereby forming an electron emission region 5.

Thus, an electron source substrate provided with the above-described surface conduction electron-emitting devices connected via matrix-shaped interconnections was obtained. Using this electron source substrate, an envelope 1088 was formed with a face plate 1086, a supporting frame 1082, and rear plate 1081, in the manner described above in connection with FIG. 7. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

The obtained image-forming apparatus showed good performance in displaying a TV image with a small variation in brightness over a large screen area.

Example 27

Device electrodes were formed on a substrate in a ladder form so that the width (W1) of the device electrodes was 600 μm, the distance (L1) between the device electrodes was 2 μm, and the thickness of the device electrodes was 1000 Å. Using this substrate (FIG. 13), surface conduction electron-emitting devices were produced in a manner similar to that in Example 21. Using the obtained electron source substrate, an envelope was formed with a face plate 1286, a grid electrode 1120, a supporting frame 1082, and rear plate 1124, in the same manner as described above in connection with FIG. 11. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

The resultant image-forming apparatus showed as good characteristics as in Example 26.

Example 28

Device electrodes were formed in a matrix form on a substrate by means of photolithography (FIG. 13). Then, surface conduction electron-emitting devices were produced on this substrate, thereby forming an electron source substrate in a manner similar to that in Example 26. Using the obtained electron source substrate, as in Example 26, an envelope 1088 was formed with an above-described face plate 1086, a supporting frame 1082, and rear plate 1081. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

The resultant image-forming apparatus showed as good characteristics as in Example 26.

Example 29

Device electrodes were formed in a ladder form on a substrate by means of photolithography (FIG. 13). Then, surface conduction electron-emitting devices were produced on this substrate, thereby forming an electron source substrate in a manner similar to that in Example 26. Using the obtained electron source substrate, a display panel was produced in a manner similar to the previous examples. Furthermore, an image-forming apparatus provided with a driving circuit capable of displaying a television image according to an NTSC television signal, such as that shown in FIG. 9, was produced.

The resultant image-forming apparatus showed as good characteristics as in Example 26.

Example 30

Figure 34:
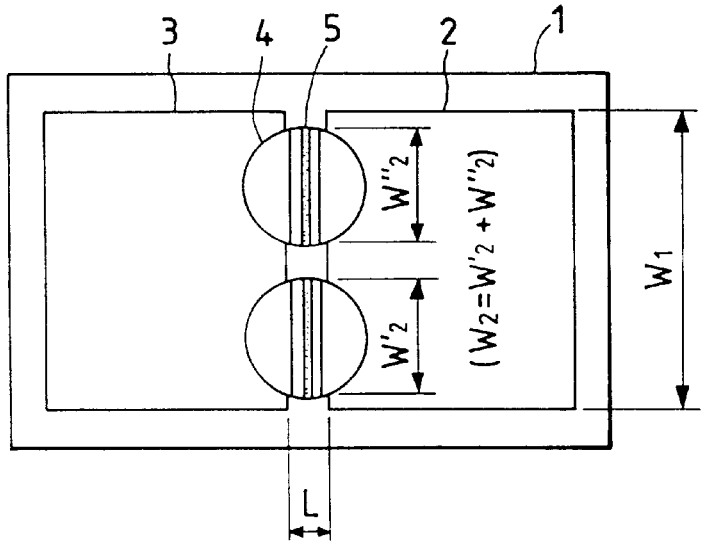
FIG. 34 is a plan view illustrating an example of a surface conduction electron-emitting device produced according to a production method of the present invention.

Device electrodes were formed in a matrix form on a substrate by means of photolithography (FIG. 13). Then, surface conduction type electron-emitting devices were produced on this substrate, thereby forming an electron source substrate. FIG. 34 is a plan view of a surface conduction type electron-emitting device produced. The production process of the surface conduction electron-emitting device will be described below.

Step 1: A quartz substrate was employed as an insulating substrate 1. The quartz substrate was cleaned well with an organic solvent. Then, electrodes 2 and 3 of Ni were formed on the substrate 1 using an evaporation technique and a photolithography technique so that the distance (L1)

between the device electrodes was 2 μm, the width (W1) of the device electrodes was 600 μm, and the thickness of the device electrodes was 1000 Å.

Step 2: The substrate on which the device electrodes 2 and 3 were formed was cleaned by means of ultrasonic with purified water. Then the substrate was dried by pulling it up from hot pure water. The hydrophobicity treatment was then performed using HMDS (HMDS was coated on the substrate using a spinner and then the substrate was heated in an oven at 200° C. for 15 min) thereby making the surface of the substrate hydrophobic. Using an ink-jet ejecting device provided with a piezo-electric device, two droplets of an aqueous solution containing a 0.05 wt % palladium acetate were ejected toward positions located near each other between the device electrodes 2 and 3 formed on the substrate. After arriving on the substrate, the droplet remained in a limited area without expanding. This resulted in good stability and good reproducibility.

Step 3: Heat treatment was then performed at 300° C. for 10 min so that a particle film (electrically-conductive film 4) consisting of palladium oxide (PdO) particles was formed. The term "particle film" is used here again to refer to a film composed of a plurality of particles, wherein the particles may be dispersed in the film, or otherwise the particles may be disposed so that they are adjacent to each other or they overlap each other (or may be disposed in the form of islands). In this technique, the width (W2) of the obtained thin film is determined as a function of the shape of the droplet deposited on the substrate. Therefore, as described above, it is possible to good reproducibility in the shape of the droplet, and thus it is possible to obtain a small variation in the width (W2) of the thin film. Furthermore, in this technique, no patterning process is required to form the electrically-conductive thin film 4.

Step 4: A forming process was then performed by applying a voltage across the device electrodes 2 and 3 so that a current was passed through the electrically-conductive thin film 4 thereby forming an electron emission region 5.

Using the obtained electron source substrate, an envelope 1088 was formed with a face plate 1086, a supporting frame 1082, and rear plate 1081, in the same manner as described above in connection with FIG. 7. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

The resultant image-forming apparatus showed as good characteristics as in Example 26.

Example 31

Device electrodes were formed in a matrix form on a substrate by means of photolithography (FIG. 12). Then, surface conduction type electron-emitting devices were produced on this substrate, thereby forming an electron source substrate in the same manner as in Example 26 except that two droplets were ejected to form one electrically-conductive thin film between device electrodes. Droplets were ejected using the same type of droplet supplying mechanism as that used in Example 26 under the same conditions as those employed in Example 26 and the amount of a solution contained in each droplet (one dot) was also the same as that in Example 26. The thickness of the obtained electrically-conductive thin film was twice that obtained in Example 26, since two droplets were ejected for each electrically-conductive thin film in this example. From this result, it can be concluded that it is possible to control the thickness of the electrically-conductive thin film by changing the amount of a droplet or by changing the number of droplets ejected for each electrically-conductive thin film.

Using the electron source substrate obtained in the above-described manner, a display panel and an image-forming apparatus were produced in a manner similar to that in Example 26.

The obtained display panel and image-forming apparatus showed as good characteristics as in Example 26.

Example 32

In the production of electron-emitting devices in any example described above, device electrodes (or device electrodes and interconnection electrodes) were formed first, and then droplets were deposited, and finally baking was performed. Instead, droplets may be deposited first and then baking may be performed so as to form electrically-conductive thin films. After that device electrodes (or device electrodes and interconnection electrodes) may be formed. A specific example according to the latter production step order will be described in detail below.

FIGS. 35A1 to 35C2 are schematic diagrams illustrating the process of producing one device.

A quartz substrate was employed as an insulating substrate 1. The quartz substrate was cleaned well with an organic solvent. Using an ink-jet ejecting device provided with a piezo-electric device, a droplet of an aqueous solution containing a 0.05 wt % palladium acetate was ejected toward a center of the substrate (FIGS. 35A1 and 35A2). (The number of droplets is not limited to one. As required, two or more droplets may be ejected.)

After that, baking was performed at 300° C. for 10 min thereby forming an electrically-conductive thin film 5 in a circular shape consisting of palladium oxide (PdO) particles (FIGS. 35B1 and 35B2).

Using an evaporation technique and a photolithography technique, electrodes 2 and 3 of Ni (FIGS. 35C1 and 35C2) were formed on the substrate having a dot of electrically-conductive thin film so that the distance L1 between the device electrodes was 10 μm, the width W1 of the device electrodes was 400 μm, and the thickness of the device electrodes was 1000 Å. In the above process, the device electrodes 2 and 3 were formed at locations so that the center of the gap between the device electrodes 2 and 3 was substantially coincident with the center of the dot of the electrically-conductive thin film.

A forming process was then performed by applying a voltage across the device electrodes 2 and 3 so that a current was passed through the electrically-conductive thin film 5 thereby forming an electron emission region 6 (FIGS. 35C1 and 35C2).

Figure 36:
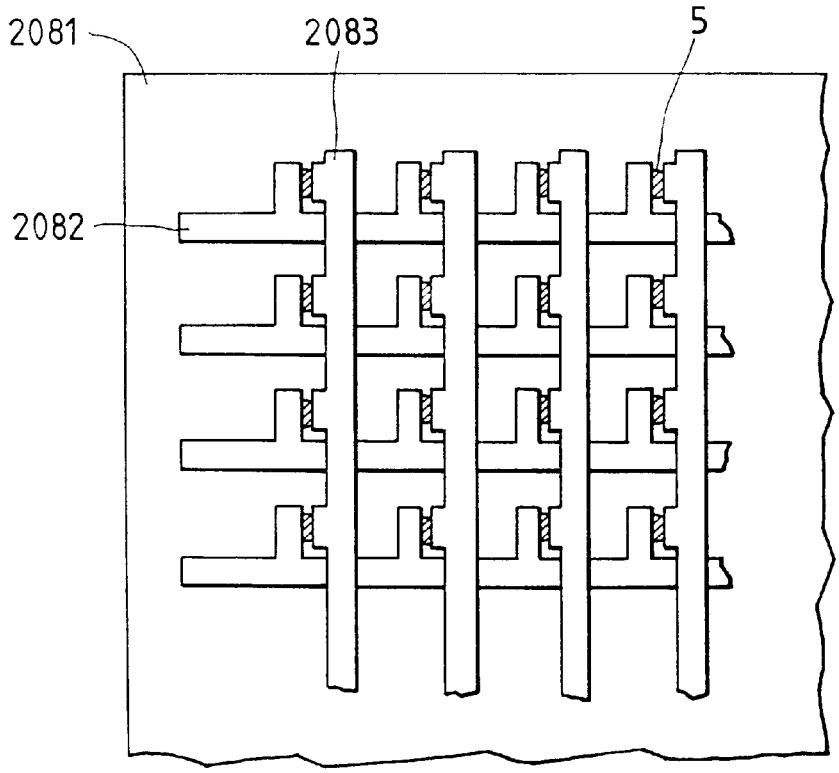
FIG. 36 is a schematic diagram illustrating an example of an electron source substrate having a matrix-shaped interconnection according to the present invention.

Although only one device was produced on a substrate in the above example, a plurality of surface conduction type electron-emitting devices may also be produced on a substrate thereby producing an electron source substrate having matrix-shaped wires as shown in FIG. 36. The matrix-shaped wires electrodes may be produced by means of evaporation and photolithography. In this structure, the X-direction wires and the Y-direction wires are electrically isolated from each other by an insulator (not shown) at each intersection. Furthermore, an envelope 1088 was formed with a face plate 1086, a supporting frame 1082, and rear plate 1081, in the same manner as described above in connection with FIG. 7. Then the envelope 1088 was sealed.

Figure 37:
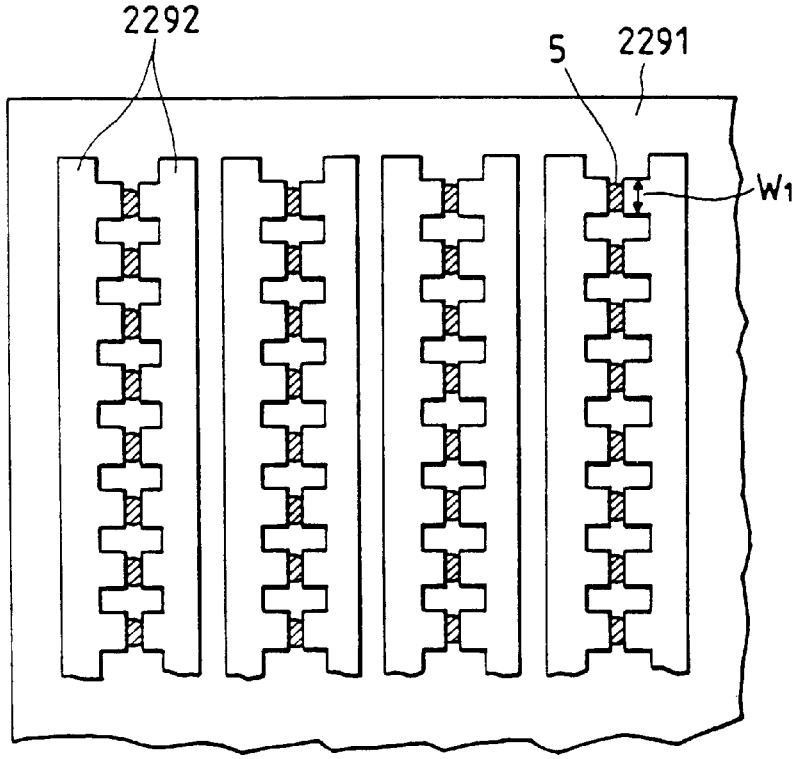
FIG. 37 is a schematic diagram illustrating an example of an electron source substrate having a ladder-shaped interconnection according to the present invention.
Figure 38:
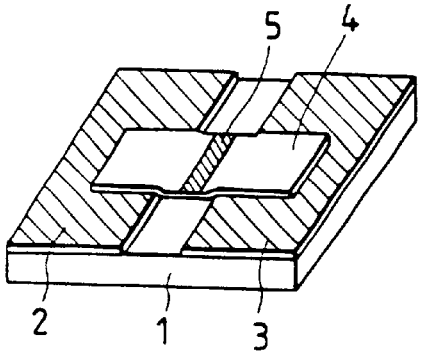
FIG. 38 is a schematic diagram illustrating an example of a conventional surface conduction electron-emitting device.

Thus a display panel was obtained. Furthermore, an image-forming apparatus provided with a driving circuit capable of displaying a television image according to an NTSC television signal, such as that shown in FIG. 9, was produced. As for the electron source substrate, the type shown in FIG. 37 may also be employed.

Also in this example, as in the previous examples, the obtained image-forming apparatus showed good performance in displaying a TV image with a small variation in brightness over a large screen area.

Example 33

Figure 39:
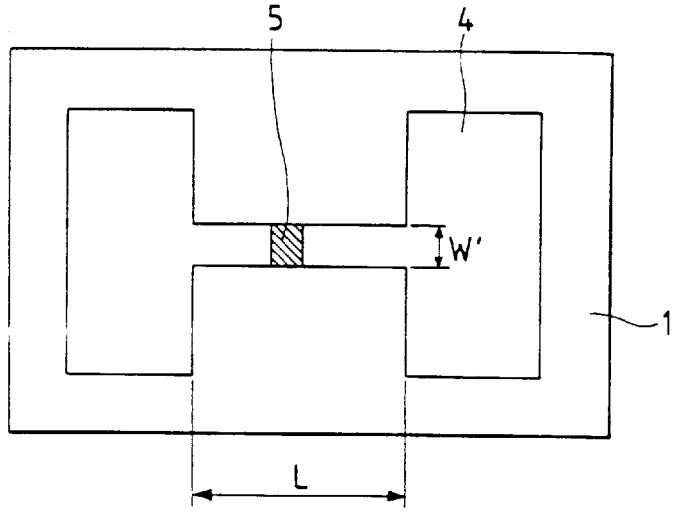
FIG. 39 PRIOR ART
FIG. 39 is a schematic diagram illustrating an example of a conventional surface conduction electron-emitting device.

After forming a plurality of dot-shaped electrically-conductive thin films on a substrate in the same manner as in Example 32, device electrodes 2 and 3 as well as ladder-form interconnections were formed on the substrate by means of evaporation and photolithography so that the width W1 of the device electrodes was 600 $\mu$m, the distance between the device electrodes was 10 $\mu$m, and the thickness of the device electrodes was 1000 Å thereby forming an electron source substrate as shown in FIG. 39. Furthermore, an envelope 1088 was formed with a face plate 1086, a supporting frame 1082, and rear plate 1124, in the same manner as described above in connection with FIG. 11. Then the envelope 1088 was sealed. Thus a display panel was obtained. Furthermore, an image-forming apparatus provided with a driving circuit capable of displaying a television image according to an NTSC television signal, such as that shown in FIG. 9, was produced.

Also in this example, as in Example 32, the obtained image-forming apparatus showed good performance in displaying an image.

Example 34

In Examples 32 and 33 described above, an ink-jet ejecting device provided with a piezo-electric device was employed. Instead, an ink-jet ejecting device of the bubble-jet type in which a bubble is generated by means of heat may also be employed. Using this type of ink-jet ejecting device, an image-forming apparatus with an electron source substrate having matrix-shaped interconnections as well as an image-forming apparatus with an electron source substrate having ladder-shaped wires were produced. The obtained image-forming apparatus showed as good performance as in Examples 32 and 33.

What is claimed is:

1. A method for producing an electron-emitting device comprising the steps of:

preparing a substrate on which a pair of electrodes with a space therebetween are disposed;

applying a droplet of liquid containing a liquid solvent and an ingredient constituting a thin film member for emitting an electron according to a voltage applied between the pair of electrodes, to a position of the space on the substrate by an inkjet system;

heating the droplet applied to the position of the space on the substrate in the applying, to form the thin film member including the ingredient, by vaporizing the liquid solvent of the applied droplet; and performing surface processing on a surface of the substrate to improve stability and reproducibility in a contour of the droplet on the substrate, wherein the droplet is applied after the surface processing is performed.

2. A method according to claim 1, wherein the droplet of liquid contains the liquid solvent and an organic metal compound.

3. A method according to claim 1, wherein the ingredient constituting said thin film member is a metal ingredient.

4. A method according to claim 1, wherein the surface processing is hydrophobic processing.

5. A method according to claim 4, wherein the hydrophobic processing comprises a step using a silane coupling agent.

6. A method according to claim 1, wherein the surface processing is performed for the substrate on which the pair of electrodes are disposed.

7. A method for fabricating an electron emission element, the method comprising the steps of:

preparing a substrate provided with a pair of electrodes arranged in a space on the substrate;

applying a droplet or droplets of liquid containing a liquid solvent and a material which forms a thin film for emitting electrons upon a voltage application between the pair of electrodes, onto the space on the substrate by an inkjet system;

heating the droplet or droplets applied onto the space on the substrate in the applying step, to form the thin film including the material, by vaporizing the liquid solvent of the applied droplet or droplets; and conducting a surface treatment in the substrate for improving stability and reproducibility in a contour of the droplet or droplets applied onto the space on the substrate by the applying, wherein the droplet or droplets are applied after the surface treatment is conducted.

8. A method according to claim 7, wherein the droplet or droplets of liquid contain the liquid solvent and an organic metal compound.

9. A method according to claim 7, wherein the material of the thin film is a metal or metal compound.

10. A method according to claim 7, wherein the surface treatment is conducted to the substrate provided with the pair of electrodes.

11. A method for fabricating an electron emission element, the method comprising the steps of:

preparing a substrate provided with a pair of electrodes arranged in a space on the substrate;

conducting a hydrophobicity treatment on the substrate;

applying a droplet or droplets of liquid containing a liquid solvent and a material which forms a thin film for emitting electrons upon a voltage application between the electrodes, onto the space on the substrate by an inkjet system, wherein the droplet or droplets are applied after the hydrophobicity treatment; and heating the droplet or droplets applied onto the space on the substrate in the applying, to form the thin film including the material, by vaporizing the liquid solvent of the applied droplet or droplets.

12. A method according to claim 11, wherein the hydrophobicity treatment is conducted by using a silane coupling agent.

13. A method according to claim 11, wherein the hydrophobicity treatment is conducted to the substrate provided with the pair of electrodes.

14. A method for producing an electron-emitting device, comprising the steps of:

performing surface processing on a surface of a substrate to improve stability and reproducibility in a contour of a liquid droplet to be applied onto the surface of the substrate;

applying a droplet of liquid containing a liquid solvent and an ingredient constituting a thin film member for emitting an electron, to the surface of the substrate processed in the performing, by an ink-jet system; and heating the droplet applied to the surface of the substrate in the applying, to form the thin film of the ingredient, by vaporizing the liquid solvent of the applied droplet.

15. A method according to claim 14, further comprising the step of forming an electron emission region in the thin film member.

16. A method according to claim 15, wherein the step of forming the electron emission region includes a step of flowing a current through the thin film member.

17. A method according to claim 14 or 15, wherein the liquid solvent is a liquid in which metal is dispersed.

18. A method according to claim 14 or 15, wherein the liquid solvent is a liquid in which metal is dissolved.

19. A method for producing an electron-emitting device, comprising the steps of:

conducting a hydrophobicity treatment on a substrate;

applying a droplet or droplets of liquid containing a liquid solvent and a material which forms a thin film for emitting electrons, onto the substrate on which the hydrophobicity treatment is conducted, by an ink-jet system; and heating the droplet or droplets applied onto the substrate in the applying, to form the thin film including the material, by vaporizing the liquid solvent of the applied droplet or droplets.

20. A method according to claim 19, further comprising the step of forming an electron emission region in the thin film.

21. A method according to claim 20, wherein the step of forming the electron emission region includes the step of flowing current through the thin film.

22. A method according to claim 19 or 20, wherein the liquid solvent is a liquid in which metal is dispersed.

23. A method according to claim 19 or 20, wherein the liquid solvent is a liquid in which metal is dissolved.

24. A method for producing an electron-emitting device, comprising the steps of:

performing surface processing on a surface of a substrate so as to improve stability and reproducibility of a shape of a droplet to be applied onto the substrate;

applying the droplet onto the surface of the substrate by an ink jet system after the surface of the substrate is surface processed in the performing, the droplet including a liquid solvent and an ingredient which constitutes a member for emitting an electron; and heating the droplet applied onto the surface of the substrate in the applying, to form the member including the ingredient, by vaporizing the liquid solvent of the applied droplet.

25. A method according to claim 24, wherein the surface processing is hydrophobic processing.

26. A method for producing a display device provided with a substrate and a plurality of electron-emitting devices arranged in a matrix on the substrate, the method comprising the steps of:

performing surface processing on a surface of the substrate so as to improve stability and reproducibility of a shape of a droplet to be applied onto the substrate;

applying the droplet onto the surface of the substrate by an ink jet system after the surface of the substrate is surface processed in the performing, the droplet including a liquid solvent and an ingredient which constitutes a member for emitting an electron; and heating the droplet applied onto the surface of the substrate in the applying, to form the member including the ingredient, by vaporizing the liquid solvent of the applied droplet.

27. A method for producing a display device provided with a substrate and a plurality of thin film elements through which current flows, the thin film elements being arranged in a matrix on the substrate, the method comprising the steps of:

performing surface processing on a surface of the substrate so as to improve stability and reproducibility of a shape of at least one droplet to be applied onto the substrate;

applying the at least one droplet onto the surface of the substrate by an ink jet system after the surface of the substrate is surface processed in the performing, the at least one droplet including a liquid solvent and an ingredient constituting at least one of the thin film elements; and heating the at least one droplet applied onto the surface of the substrate in the applying, to form the at least one of the thin film elements including the ingredient, by vaporizing the liquid solvent of the applied at least one droplet.

28. A method for producing a display device provided with a substrate and a plurality of thin film elements arranged in a matrix on the substrate, each element being disposed on at least one electrode, the method comprising the steps of:

performing surface processing on a surface of the substrate on which the at least one electrode has been formed so as to improve stability and reproducibility of a shape of at least one droplet to be applied onto the substrate;

applying the at least one droplet onto the surface of the substrate by an ink jet system after the surface of the substrate is surface processed in the performing, the at least one droplet including a liquid solvent and an ingredient constituting at least one of the thin film elements; and heating the at least one droplet applied onto the surface of the substrate in the applying, to form the at least one of the thin film elements including the ingredient, by vaporizing the liquid solvent of the applied at least one droplet.

* * * * *

UNITED STATES PATENT AND TRADEMARK OFFICE

CERTIFICATE OF CORRECTION

PATENT NO. : 6,761,925 B2
APPLICATION NO. : 09/288823
DATED : July 13, 2004
INVENTOR(S) : Yoshikazu Banno et al.

It is certified that error appears in the above-identified patent and that said Letters Patent is hereby corrected as shown below:

COLUMN 5:

Line 11, “sate” should read --state--.

COLUMN 20:

Line 33, “the” (2nd occurrence) should be deleted; and
Line 43, “are” should read --is--.

COLUMN 22:

Line 52, “denote” should read --denotes--.

COLUMN 38:

Line 3, “600 μmm” should read --600 μm,--; and
Line 18, “600 μmm” should read --600 μm,--.

COLUMN 41:

Line 30, “to” should read --to achieve--.

COLUMN 44:

Line 10, “are” should read --is--.

Signed and Sealed this

Seventeenth Day of October, 2006

JON W. DUDAS
*Director of the United States Patent and Trademark Office*